US007931313B2

(12) United States Patent
Carabalona

(10) Patent No.: US 7,931,313 B2
(45) **Date of Patent: *Apr. 26, 2011**

(54) MAGNETIC LATCH MECHANISM

(75) Inventor: Eric Carabalona, Kenilworth (GB)

(73) Assignee: Southco, Inc., Concordville, PA (US)

( * ) Notice: Subject to any disclaimer, the term of this patent is extended or adjusted under 35 U.S.C. 154(b) by 868 days.

This patent is subject to a terminal disclaimer.

(21) Appl. No.: 11/816,093

(22) PCT Filed: Feb. 11, 2006

(86) PCT No.: PCT/US2006/004971

§ 371 (c)(1),
(2), (4) Date: Aug. 10, 2007

(87) PCT Pub. No.: WO2006/088775

PCT Pub. Date: Aug. 24, 2006

(65) Prior Publication Data

US 2008/0265588 A1 Oct. 30, 2008

Related U.S. Application Data

(60) Provisional application No. 60/652,295, filed on Feb. 12, 2005, provisional application No. 60/666,694, filed on Mar. 29, 2005.

(51) Int. Cl.
*E05C 17/56* (2006.01)
*E05C 19/16* (2006.01)

(52) U.S. Cl. ..... 292/251.5; 292/44; 292/45; 292/51; 292/54

(58) Field of Classification Search ..... 292/44–55, 292/251.5, DIG. 21, DIG. 71
See application file for complete search history.

(56) References Cited

U.S. PATENT DOCUMENTS

| | | | | |
|---|---|---|---|---|
| 2,342,848 | A | 2/1944 | Endter | |
| 2,446,336 | A * | 8/1948 | Vennice et al. | 49/395 |
| 2,565,891 | A * | 8/1951 | Sherman | 292/251.5 |
| 2,797,655 | A * | 7/1957 | Morehouse | 109/63.5 |
| 2,889,164 | A * | 6/1959 | Clark | 292/229 |
| 2,898,138 | A | 8/1959 | Noord | |
| 3,288,511 | A * | 11/1966 | Tavano | 292/251.5 |
| 3,332,713 | A | 7/1967 | DeClaire | |
| 3,596,958 | A * | 8/1971 | Bowerman | 292/201 |
| 4,195,236 | A | 3/1980 | Kalinichenko et al. | |
| 4,262,830 | A | 4/1981 | Haves | |
| 4,268,076 | A | 5/1981 | Itoi | |
| 4,355,837 | A | 10/1982 | Shimizu et al. | |
| 4,518,180 | A | 5/1985 | Kleefeldt et al. | |

(Continued)

FOREIGN PATENT DOCUMENTS

DE 145325 * 12/1902

(Continued)

OTHER PUBLICATIONS

Tech-Train Bulletin—Steven E. Young, Issue #16, 2002, 3 pages.

(Continued)

*Primary Examiner* — Carlos Lugo
(74) *Attorney, Agent, or Firm* — Paul & Paul

(57) ABSTRACT

A latch with dual rotary magnets is particularly suited for releasably securing dual doors of a compartment in the closed position. Each rotary magnet holds in a closed position a magnetic insert attached to a respective door by magnetic attraction to secure both doors in the closed position relative to the compartment.

12 Claims, 62 Drawing Sheets

U.S. PATENT DOCUMENTS

| | | | | |
|---|---|---|---|---|
| 4,518,181 | A | | 5/1985 | Yamada |
| 4,569,544 | A | | 2/1986 | Escaravage |
| 4,597,598 | A | | 7/1986 | Bascou |
| 4,732,432 | A | * | 3/1988 | Keil et al. ..... 312/406.2 |
| 4,763,936 | A | | 8/1988 | Rogakos et al. |
| 4,796,932 | A | | 1/1989 | Tame |
| 4,848,809 | A | | 7/1989 | Escaravage |
| 4,861,089 | A | | 8/1989 | Compeau et al. |
| 4,867,496 | A | | 9/1989 | Thomas |
| 4,875,723 | A | | 10/1989 | Compeau et al. |
| 4,892,340 | A | | 1/1990 | Matumoto |
| 4,927,196 | A | | 5/1990 | Girard et al. |
| 4,978,478 | A | | 12/1990 | Vonderau et al. |
| 5,033,789 | A | | 7/1991 | Hayashi et al. |
| 5,046,340 | A | | 9/1991 | Weinerman et al. |
| 5,180,198 | A | | 1/1993 | Nakamura et al. |
| 5,188,406 | A | | 2/1993 | Sterzenbach et al. |
| 5,222,775 | A | | 6/1993 | Kato |
| 5,309,680 | A | * | 5/1994 | Kiel ..... 49/478.1 |
| 5,411,302 | A | | 5/1995 | Shimada |
| 5,413,391 | A | | 5/1995 | Clavin et al. |
| 5,429,400 | A | | 7/1995 | Kawaguchi et al. |
| 5,498,040 | A | | 3/1996 | Silye |
| 5,544,925 | A | | 8/1996 | Ikeda |
| 5,620,226 | A | | 4/1997 | Sautter, Jr. |
| 5,632,515 | A | | 5/1997 | Dowling |
| 5,642,636 | A | | 7/1997 | Mitsui |
| 5,765,884 | A | | 6/1998 | Armbruster |
| 5,816,080 | A | * | 10/1998 | Jeziorowski ..... 62/441 |
| 5,927,772 | A | | 7/1999 | Antonucci et al. |
| 5,941,104 | A | | 8/1999 | Sadler |
| 5,975,661 | A | * | 11/1999 | Jeziorowski et al. ..... 312/296 |
| 5,984,383 | A | | 11/1999 | Parikh et al. |
| 6,048,006 | A | | 4/2000 | Antonucci et al. |
| 6,076,868 | A | | 6/2000 | Roger, Jr. et al. |
| 6,113,161 | A | | 9/2000 | Jung et al. |
| 6,139,073 | A | | 10/2000 | Heffner et al. |
| 6,176,528 | B1 | | 1/2001 | Taga |
| 6,267,420 | B1 | | 7/2001 | Miyagawa |
| 6,327,879 | B1 | | 12/2001 | Malsom |
| 6,341,807 | B2 | | 1/2002 | Cetnar et al. |
| 6,386,599 | B1 | | 5/2002 | Chevalier |
| 6,460,902 | B1 | | 10/2002 | Kyle |
| 6,463,773 | B1 | | 10/2002 | Dimg |
| 6,471,260 | B1 | | 10/2002 | Weinerman et al. |
| 6,705,140 | B1 | | 3/2004 | Dimg et al. |
| 6,715,815 | B2 | | 4/2004 | Toppani |
| 6,719,333 | B2 | | 4/2004 | Rice et al. |
| 6,730,867 | B2 | | 5/2004 | Hyp |
| 6,761,382 | B2 | | 7/2004 | Ji et al. |
| 6,832,793 | B2 | | 12/2004 | Bingle et al. |
| D506,120 | S | | 6/2005 | Straka, Jr. et al. |
| 6,942,259 | B2 | | 9/2005 | Marzolf et al. |
| 6,948,745 | B2 | | 9/2005 | Chevalier |
| 6,966,583 | B2 | | 11/2005 | Ji et al. |
| 6,997,488 | B2 | | 2/2006 | Kurten et al. |
| 7,004,517 | B2 | | 2/2006 | Vitry et al. |
| 7,065,992 | B2 | | 6/2006 | Talukdar et al. |
| 7,080,531 | B2 | | 7/2006 | Vitry et al. |
| 7,185,927 | B2 | | 3/2007 | Talukdar et al. |
| 7,267,378 | B2 | * | 9/2007 | Drumm ..... 292/251.5 |
| 2002/0084666 | A1 | | 7/2002 | Toppani |
| 2002/0167175 | A1 | | 11/2002 | Weyerstall et al. |
| 2003/0025339 | A1 | | 2/2003 | Vitry et al. |
| 2003/0094024 | A1 | | 5/2003 | Dimig |
| 2003/0193199 | A1 | | 10/2003 | Talukdar et al. |
| 2005/0067840 | A1 | | 3/2005 | Koveal et al. |
| 2005/0200137 | A1 | | 9/2005 | Nelsen et al. |
| 2007/0007775 | A1 | * | 1/2007 | Gallas et al. ..... 292/251.5 |
| 2007/0216173 | A1 | | 9/2007 | Vitry |
| 2008/0191494 | A1 | * | 8/2008 | Carabalona et al. ..... 292/2 |
| 2008/0231060 | A1 | * | 9/2008 | Carabalona et al. ..... 292/251.5 |

FOREIGN PATENT DOCUMENTS

| | | | | |
|---|---|---|---|---|
| DE | 1505721 | | | 7/1970 |
| DE | 2455520 | | * | 5/1976 |
| DE | 3333746 | A1 | | 6/1985 |
| DE | 10009370 | A1 | | 9/2001 |
| EP | 0239229 | A3 | | 2/1987 |
| EP | 0546668 | B1 | | 5/1995 |
| FR | 0408951 | A2 | | 6/1990 |
| FR | 2860023 | A1 | | 3/2005 |
| JP | 54013000 | A | * | 1/1979 |
| JP | 54102046 | A | * | 8/1979 |
| JP | 5340149 | | * | 6/1991 |
| WO | WO0138671 | A2 | | 5/2001 |
| WO | WO 0204773 | | * | 1/2002 |
| WO | WO2006034057 | A1 | | 3/2006 |

OTHER PUBLICATIONS

TrMark Website print out—www.trimarkcorp.com, 050-0410 Floating Striker Single Rotor Latch Single Position, 19 pages. Printed out on Apr. 13, 2004.

Photographs showing a TriMark latch similar to those shown in TriMark's Website.

* cited by examiner

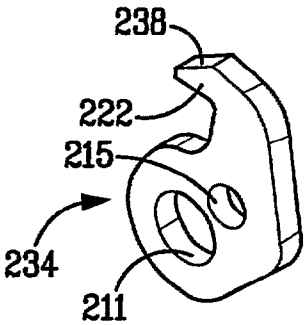
FIG. 55
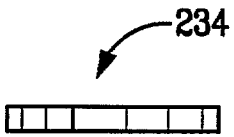
FIG. 54
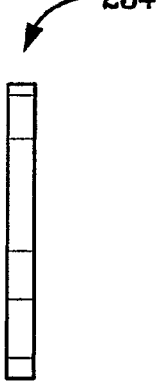
FIG. 58
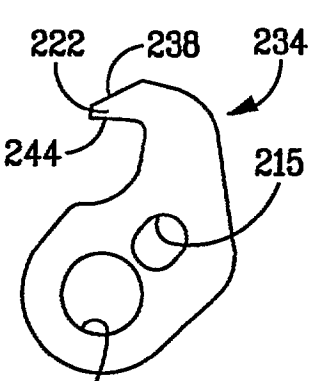
FIG. 59
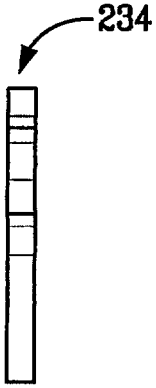
FIG. 56
FIG. 57
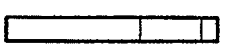
FIG. 60

MAGNETIC LATCH MECHANISM

BACKGROUND OF THE INVENTION

1. Field of Invention

This invention relates to latch having magnets for use in securing one or more closure panels of a compartment in the closed position.

2. Brief Description of the Related Art

In many applications the need arises to secure a panel in a closed position relative to a compartment opening or another panel. For example, in the automotive industry the panels acting as closures for the interior compartments of the vehicle must be secured in the closed position when the compartment is not being accessed. Examples of such compartments include the vehicle's glove compartment and the center console compartment between a vehicle's front seats. The closure members for such compartments are selectively secured in the closed position by latches in order to secure the contents of the compartments while allowing a user to selectively open the closure members to access the contents of the compartments. Many latches for this purpose have been proposed in the art. Examples of such latches can be seen in U.S. Pat. Nos. 5,927,772 and 6,761,278. However, none of the known latches are seen to teach or suggest the novel and unique latch of the present invention.

SUMMARY OF THE INVENTION

The present invention is directed to a latch mechanism that is particularly advantageous for, but is not limited to, releasably securing dual doors of a compartment in the closed position. The latch has two rotary magnets, and each rotary magnet holds a respective one of the doors securely in the closed position relative to the compartment by magnetically attracting a magnetic insert attached to the respective door. In a second embodiment mechanical hook-like rotary pawls supplement the action of the magnets. The latch according to the present invention is well suited for use in applications where the dual doors are linked. In such applications closing one of the doors also moves the other door to the closed position. However, the mechanical linkage between the doors is not perfect and the closing of the doors is not always simultaneous. Often one door wilt slightly lag behind the other door in closing. The latch of the present invention is designed to effect proper securing of the doors in the closed position even when one door lags behind the other.

BRIEF DESCRIPTION OF THE DRAWINGS

FIGS. 54-60 are views showing the hook-shaped pawl of the second embodiment of the magnetic latch mechanism of the present invention.

Like reference numerals indicate like elements throughout the several views.

DETAILED DESCRIPTION OF THE INVENTION

Figure 1:
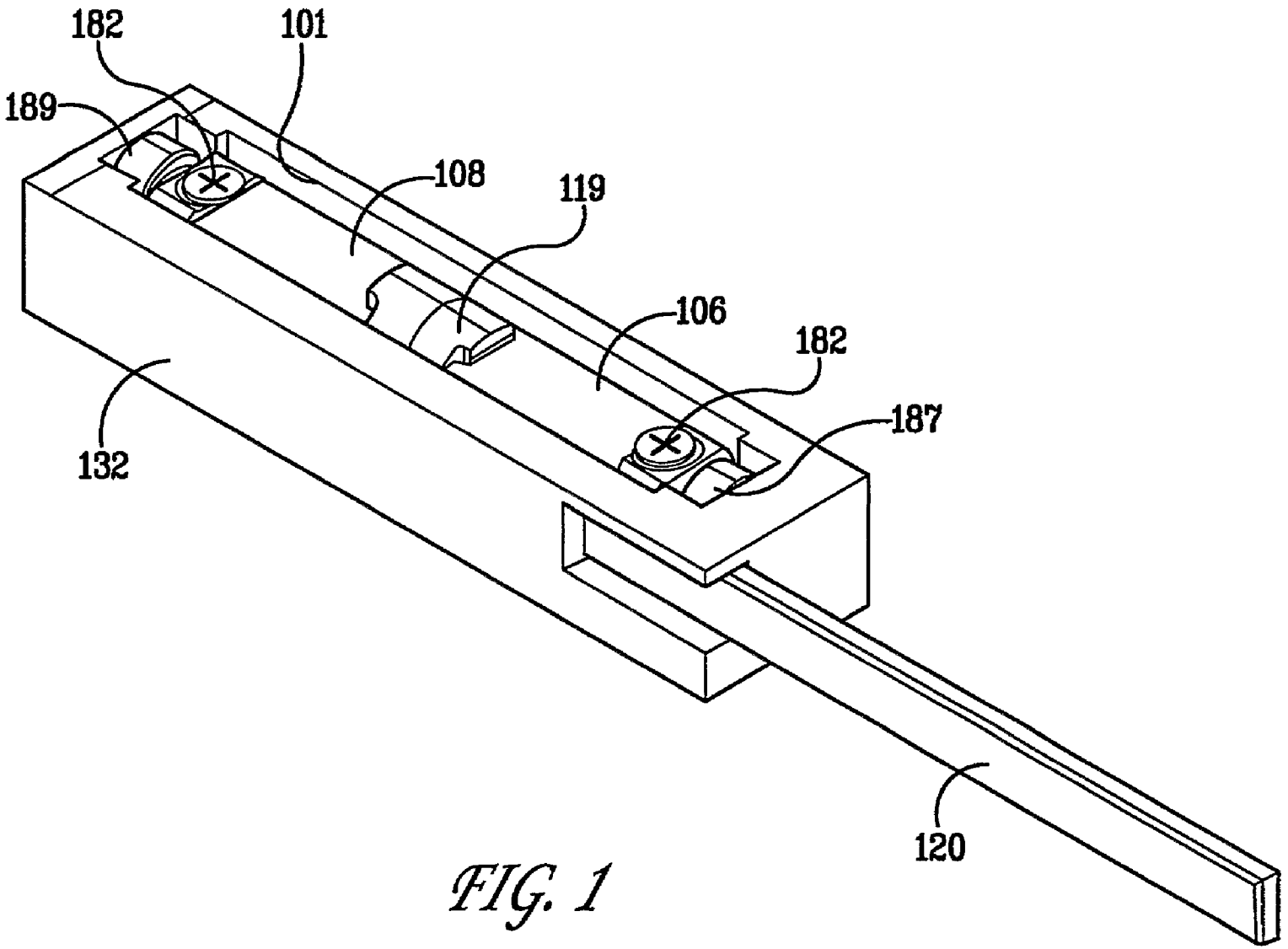
FIG. 1 is a perspective view of the rotary magnet assembly of the first embodiment of the magnetic latch mechanism of the present invention showing the rotary magnets in the latched position.
Figure 2:
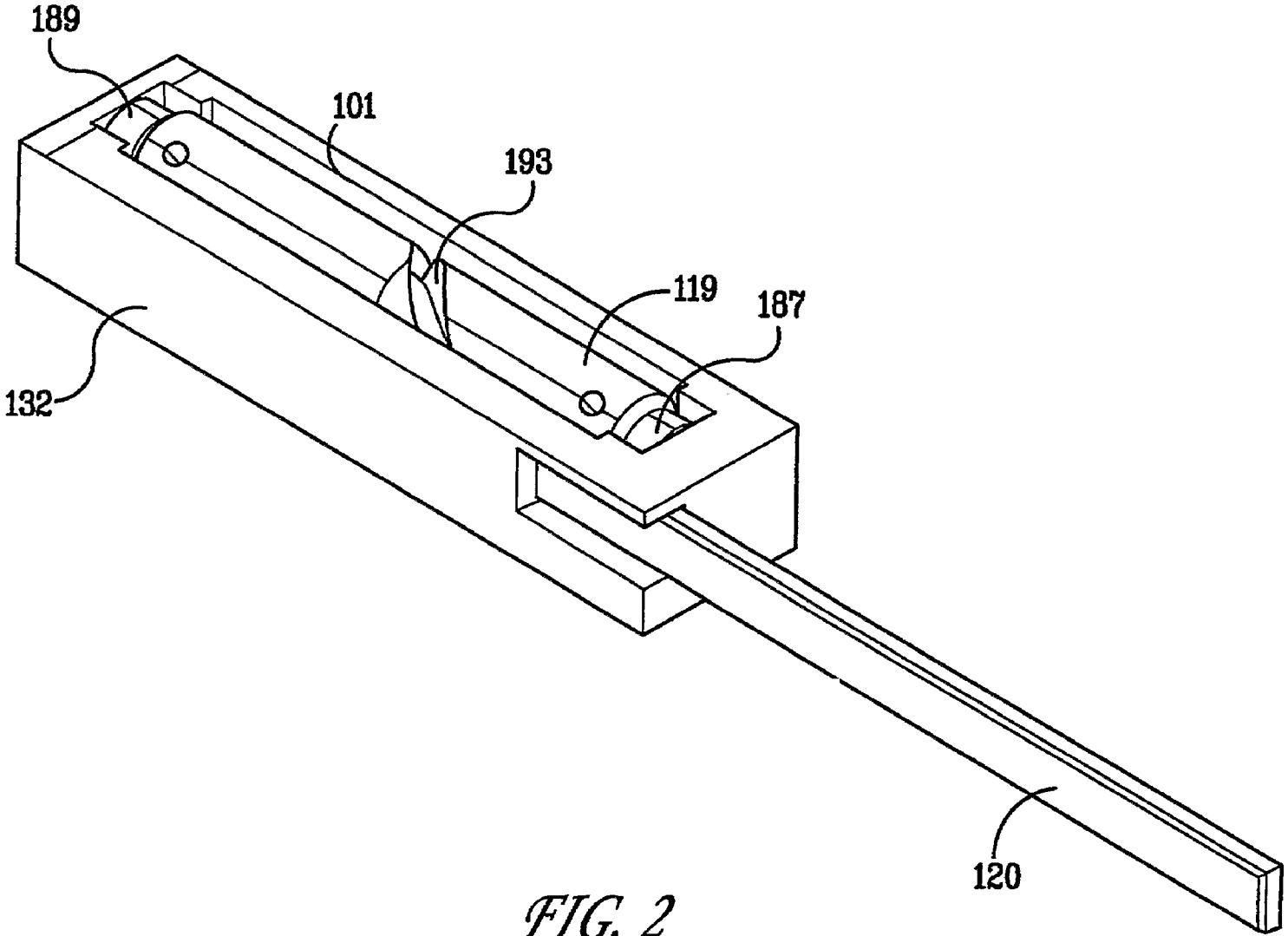
FIG. 2 is a perspective view of the rotary magnet assembly of the first embodiment of the magnetic latch mechanism of the present invention showing the rotary magnets in the unlatched position.
Figure 3:
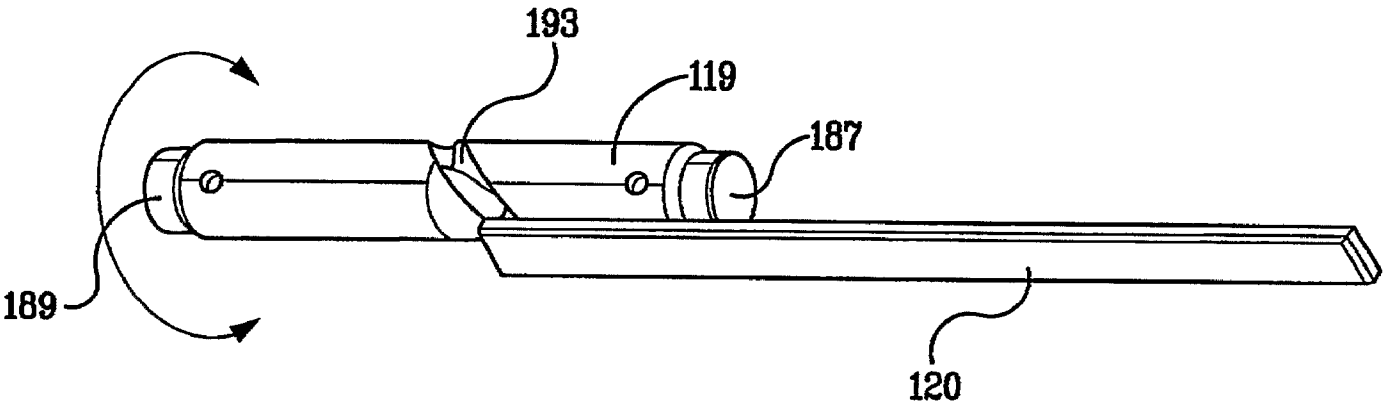
FIG. 3 shows the operation of the mechanism for rotating the rotary magnets of the first embodiment of the magnetic latch mechanism of the present invention with the rotary magnets shown in the unlatched position.
Figure 4:
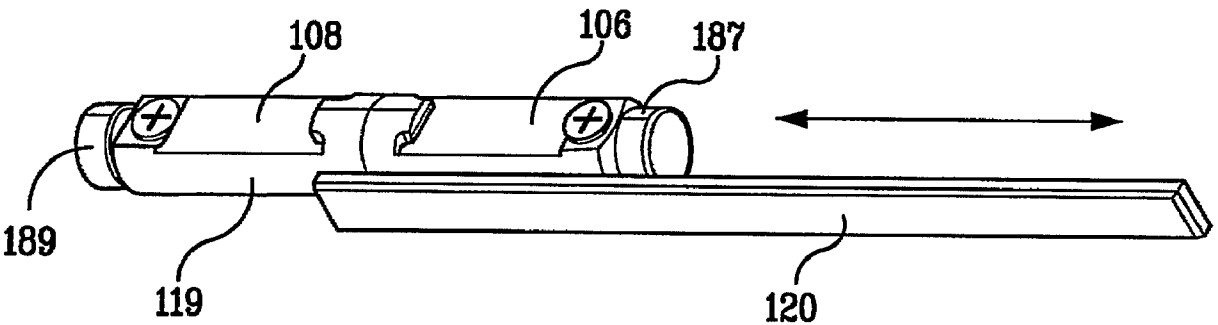
FIG. 4 shows the operation of the mechanism for rotating the rotary magnets of the first embodiment of the magnetic latch mechanism of the present invention with the rotary magnets shown in the latched position.
Figure 5:
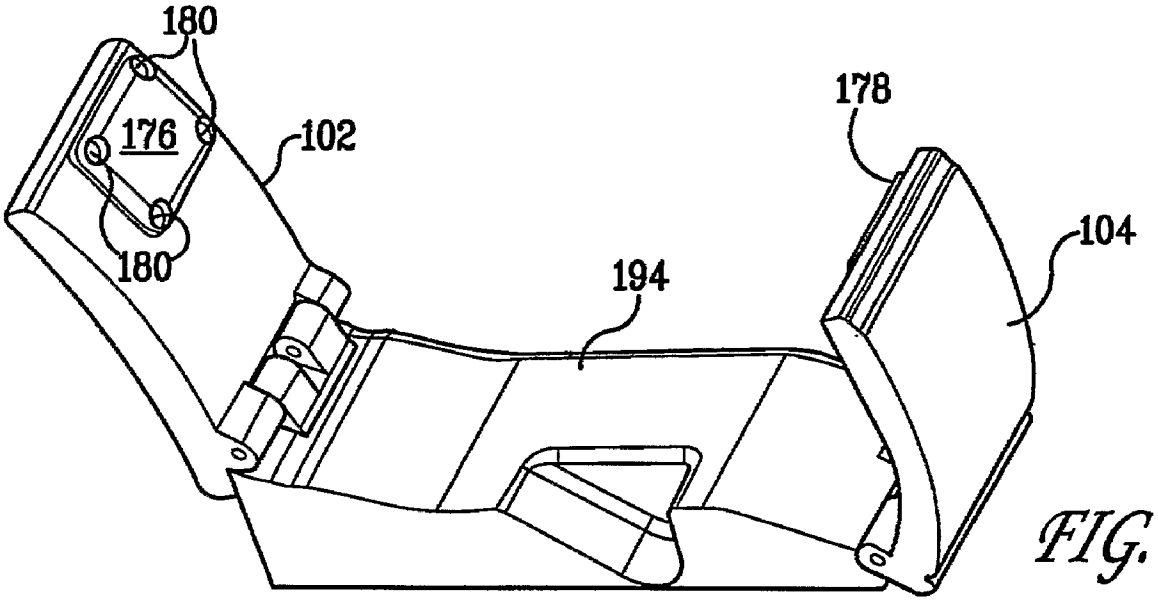
FIG. 5 is a fragmentary environmental view showing a compartment with dual doors incorporating the first embodiment of the magnetic latch mechanism of the present invention and with the doors in the open position.
Figure 6:
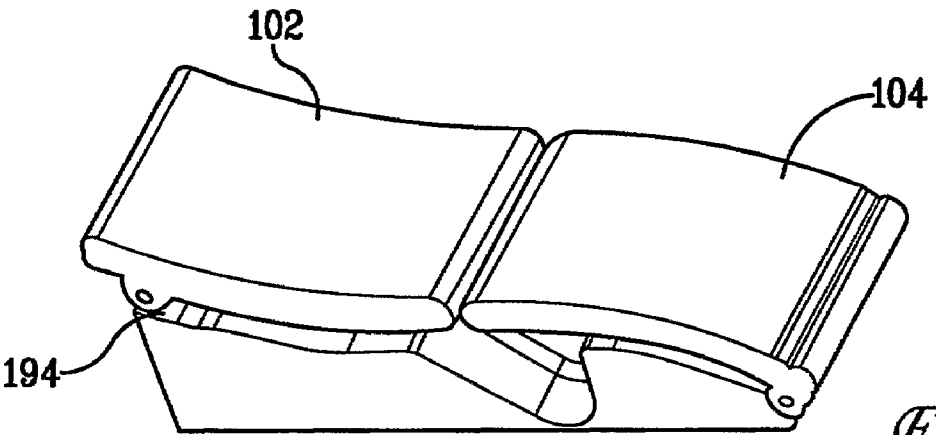
FIG. 6 is a fragmentary environmental view showing a compartment with dual doors incorporating the first embodiment of the magnetic latch mechanism of the present invention and with the doors in the closed position.
Figure 7:
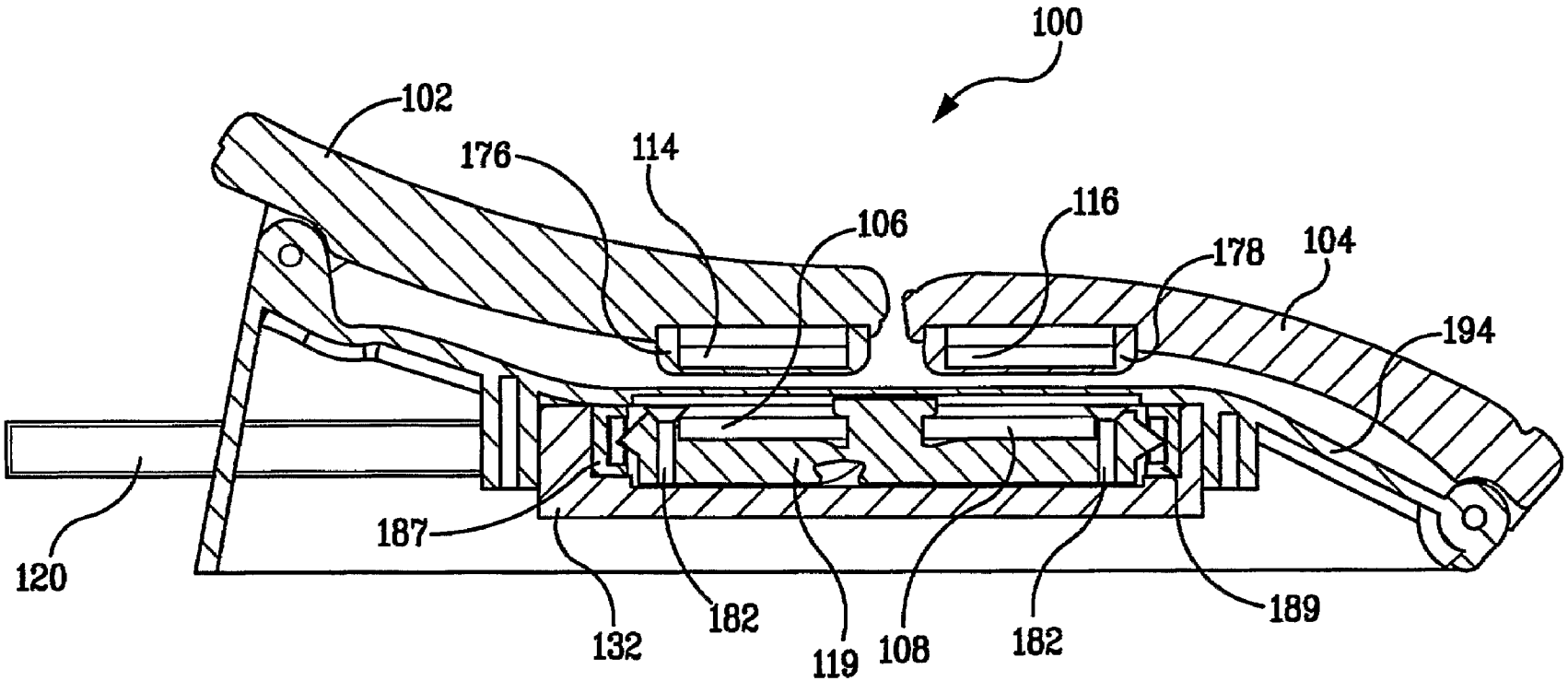
FIG. 7 is a cross sectional view showing a compartment with dual doors incorporating the first embodiment of the magnetic latch mechanism of the present invention and with the doors in the closed position.
Figure 8:
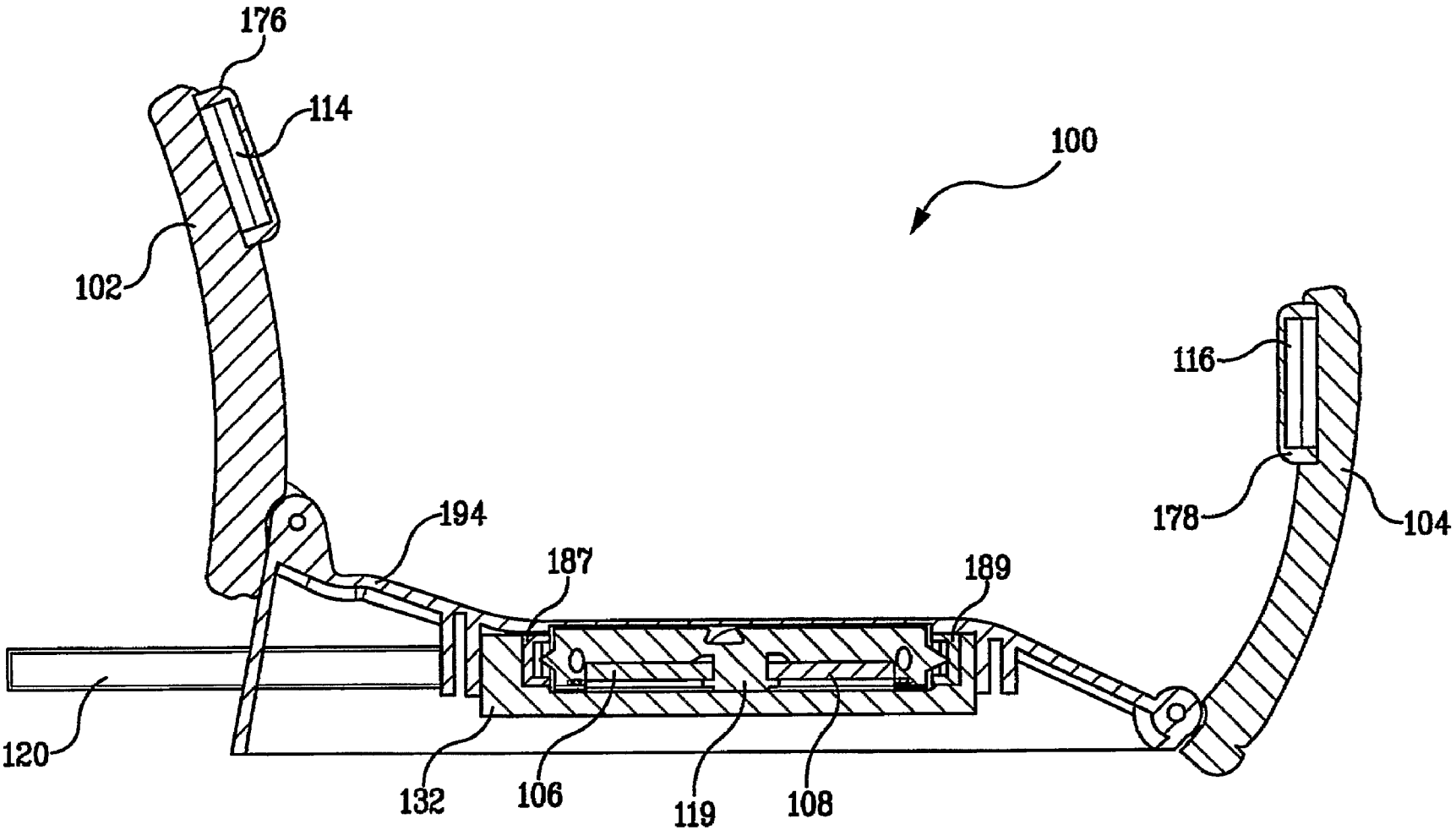
FIG. 8 is a cross sectional view showing a compartment with dual doors incorporating the first embodiment of the magnetic latch mechanism of the present invention and with the doors in the open position.
Figure 9:
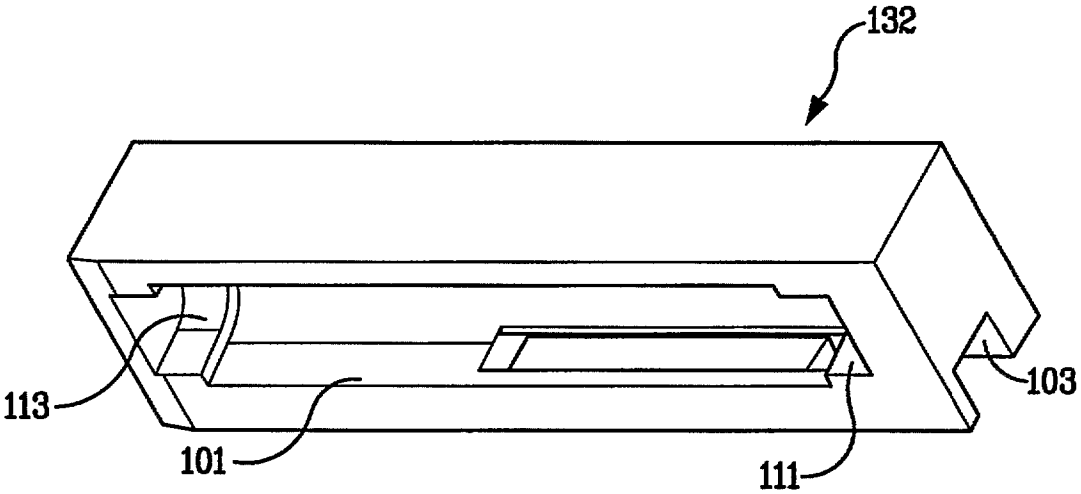
FIGS. 9-10 are views showing the housing of the first embodiment of the magnetic latch mechanism of the present invention.
Figure 10:
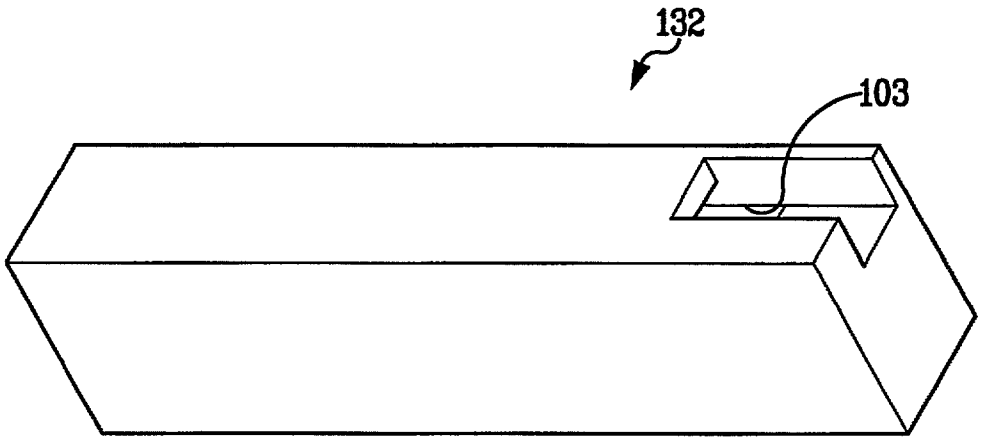
Figure 11:
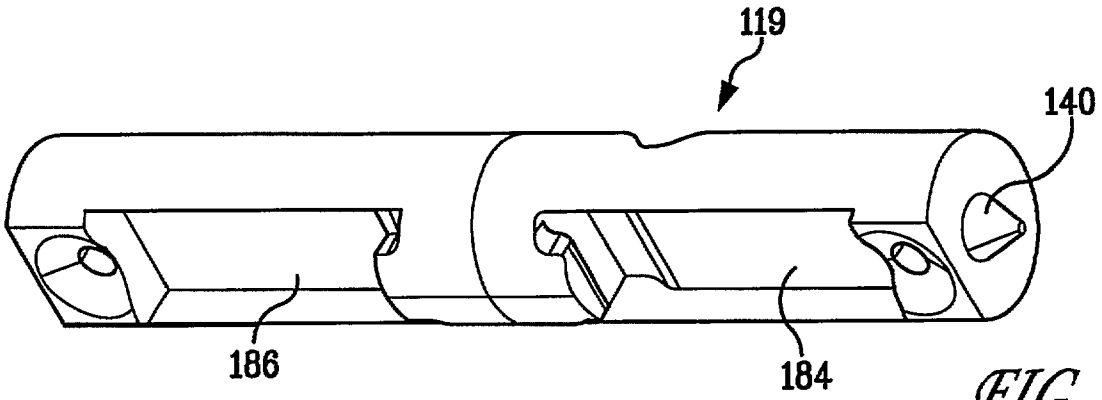
FIGS. 11-18 are views showing the rotary magnet carrier of the first embodiment of the magnetic latch mechanism of the present invention.
Figure 12:
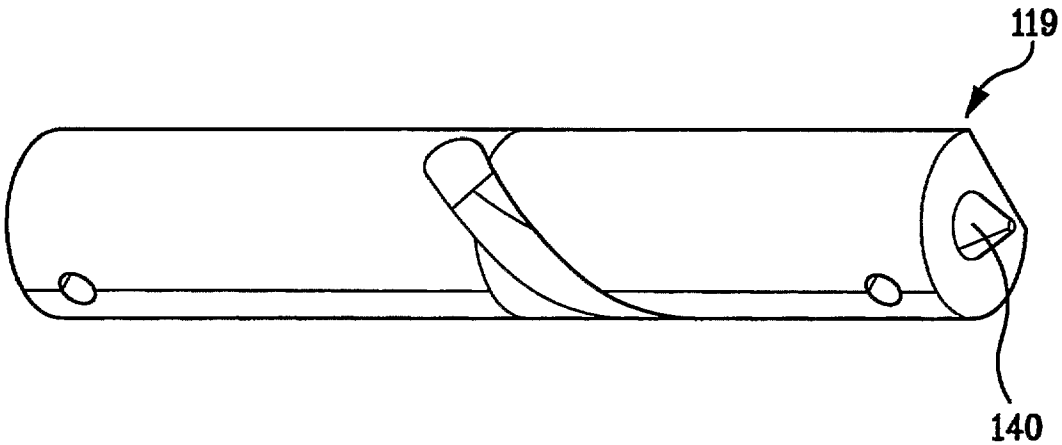
Figure 17:
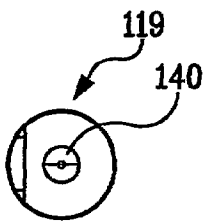
Figure 13:
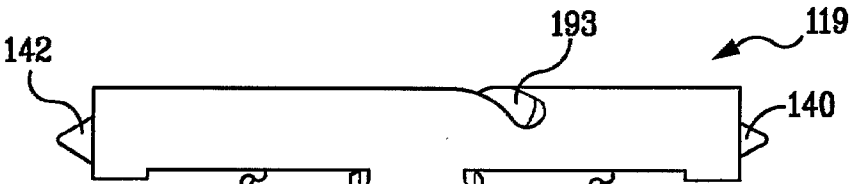
Figure 14:
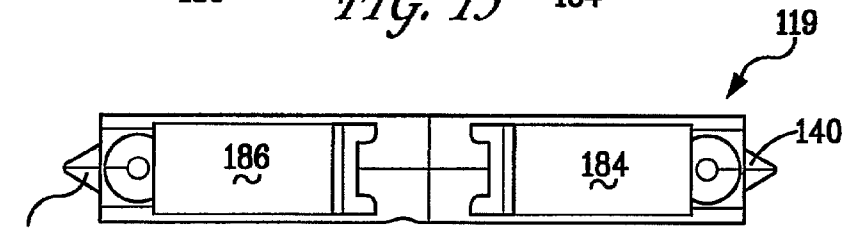
Figure 15:
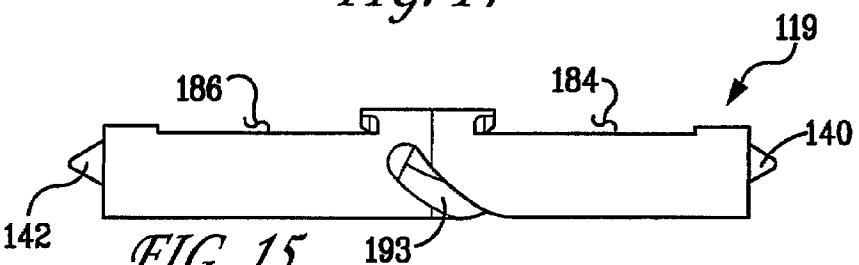
Figure 16:
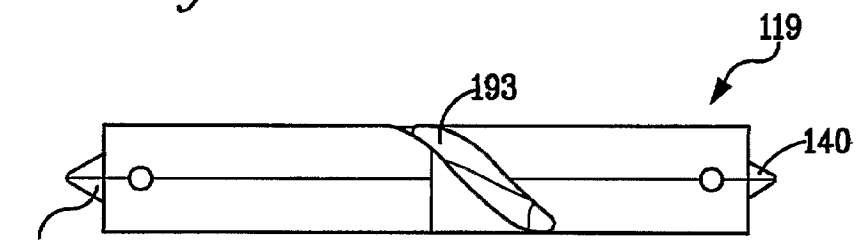
Figure 18:
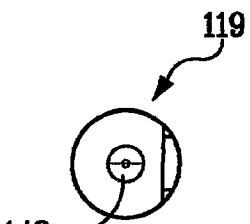
Figure 19:
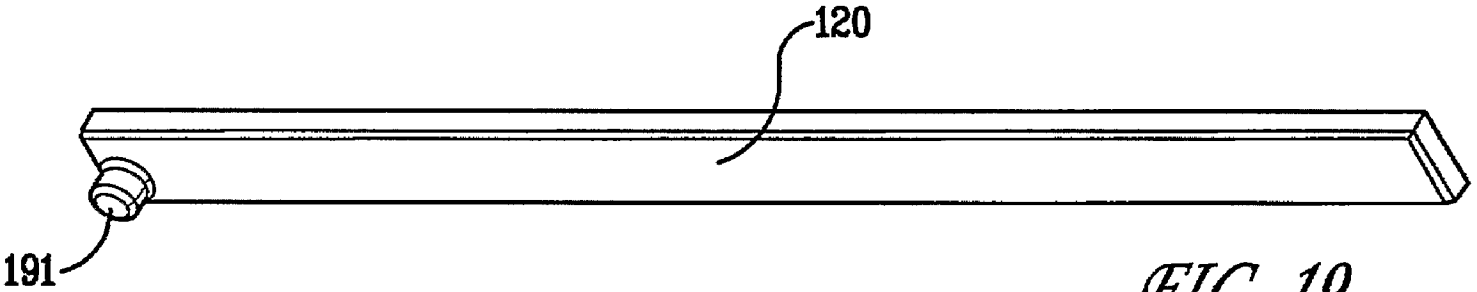
FIGS. 19-20 are views showing the operating rod of the first embodiment of the magnetic latch mechanism of the present invention.
Figure 20:
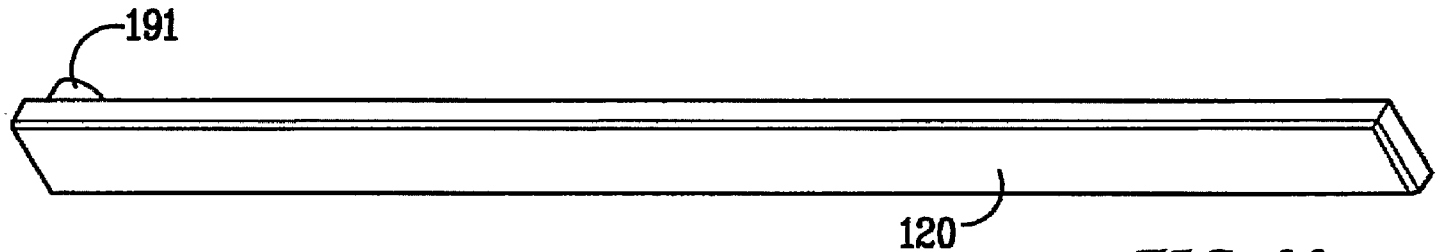
Figure 21:
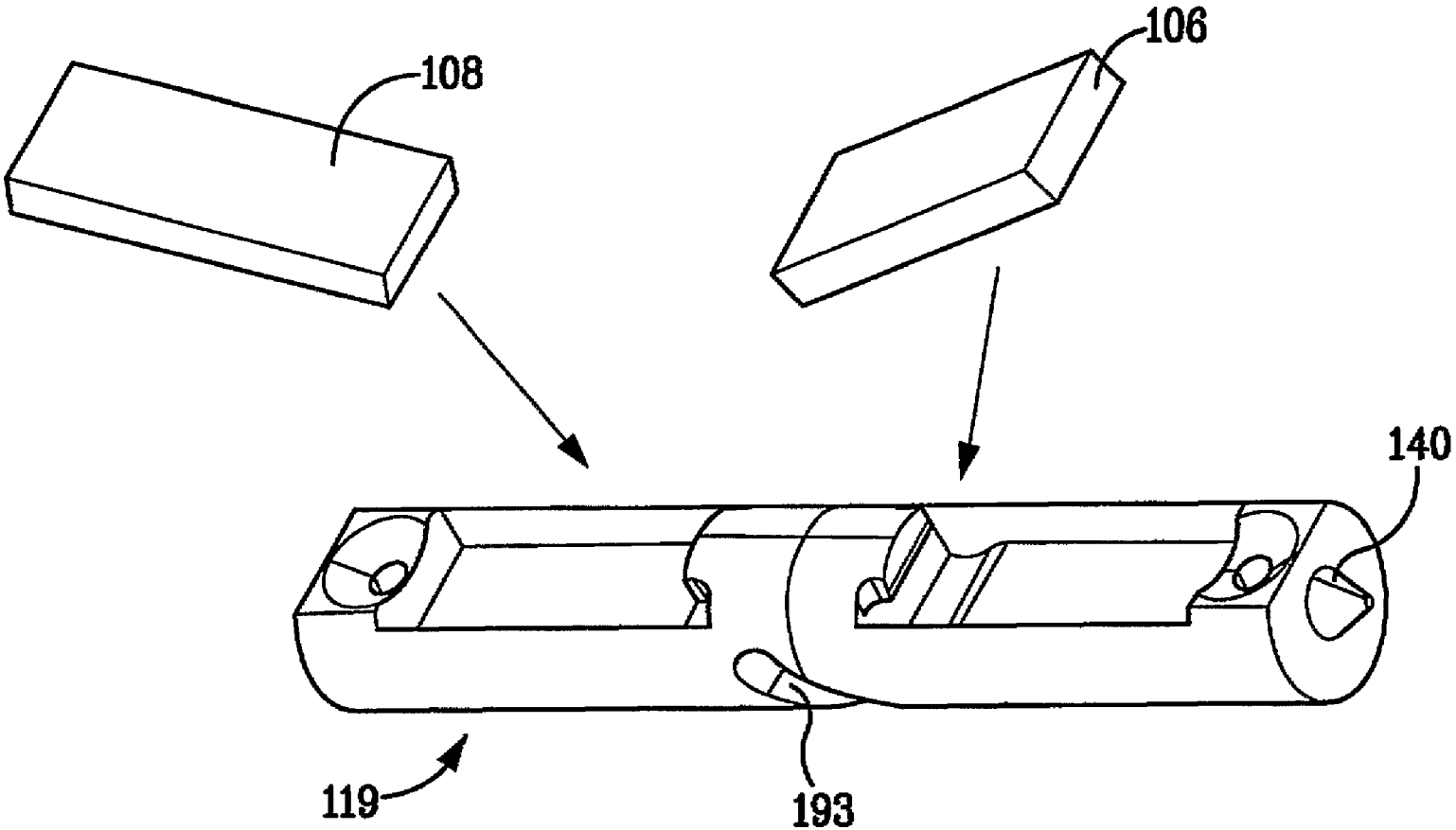
FIGS. 21-27 are views showing the assembly sequence of the first embodiment of the magnetic latch mechanism of the present invention.
Figure 22:
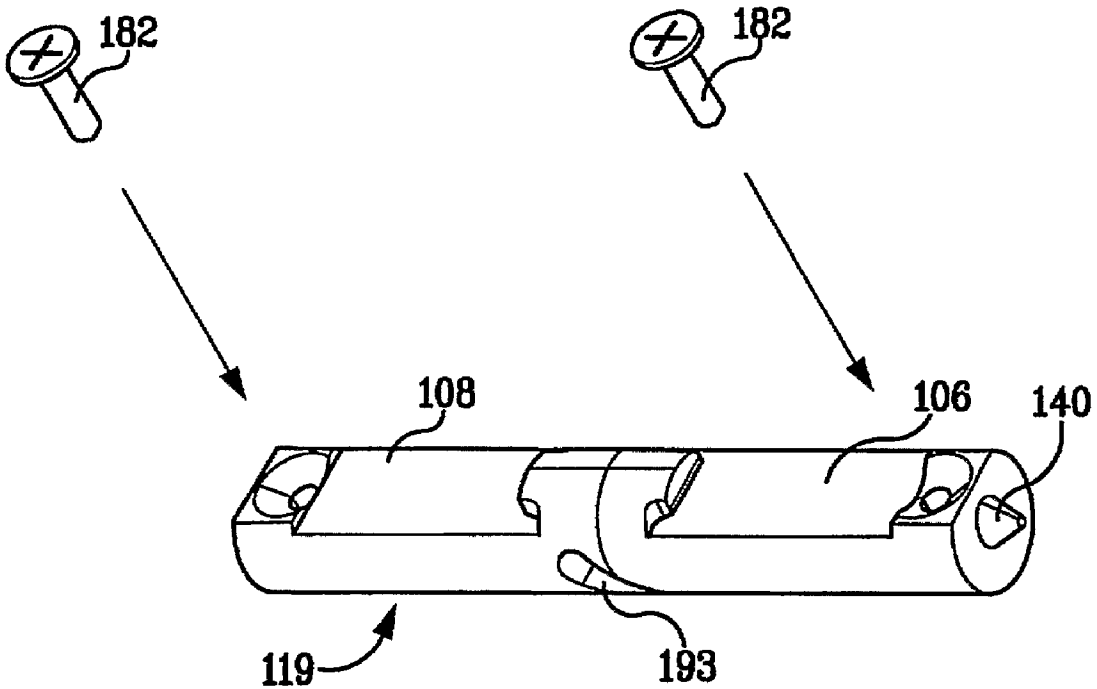
Figure 23:
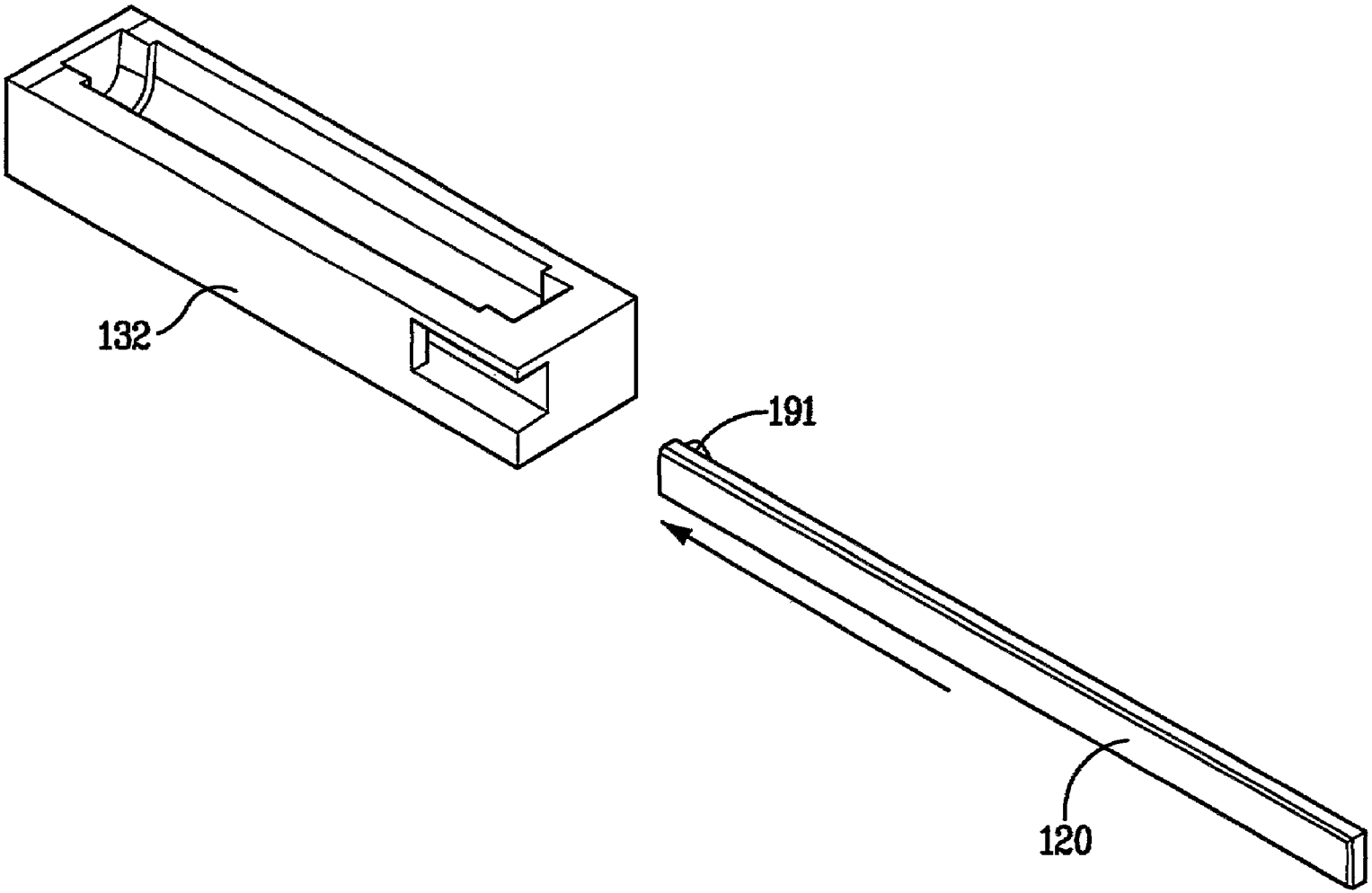
Figure 24:
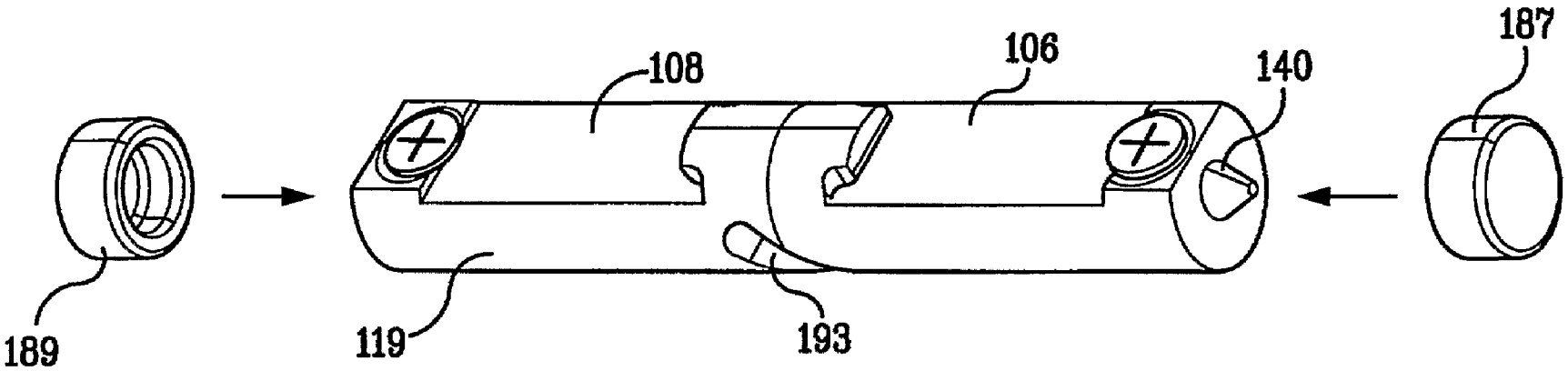
Figure 25:
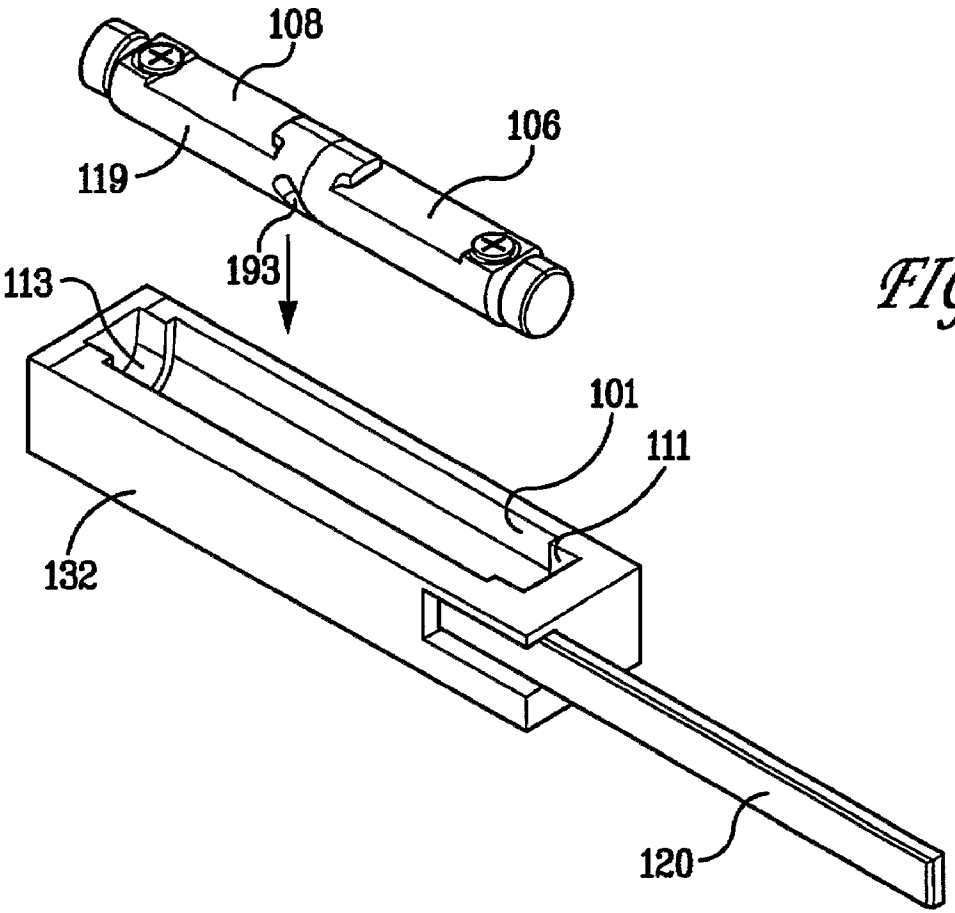
Figure 26:
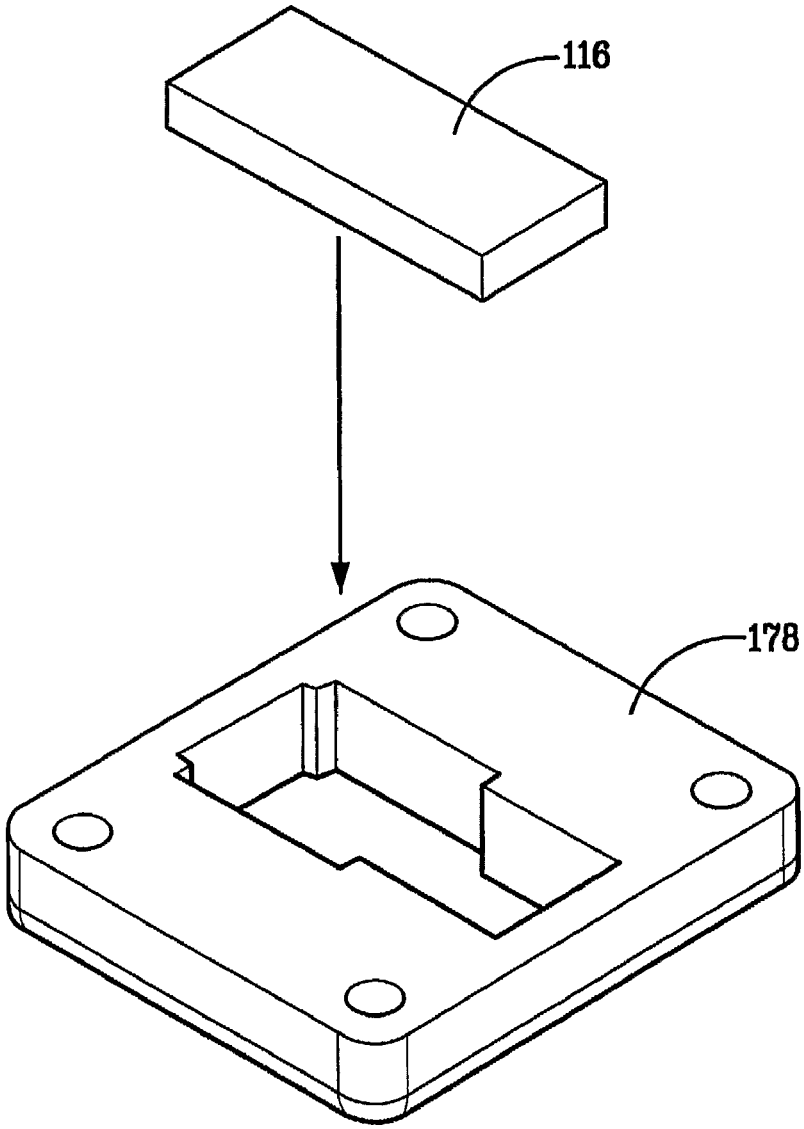
Figure 27:
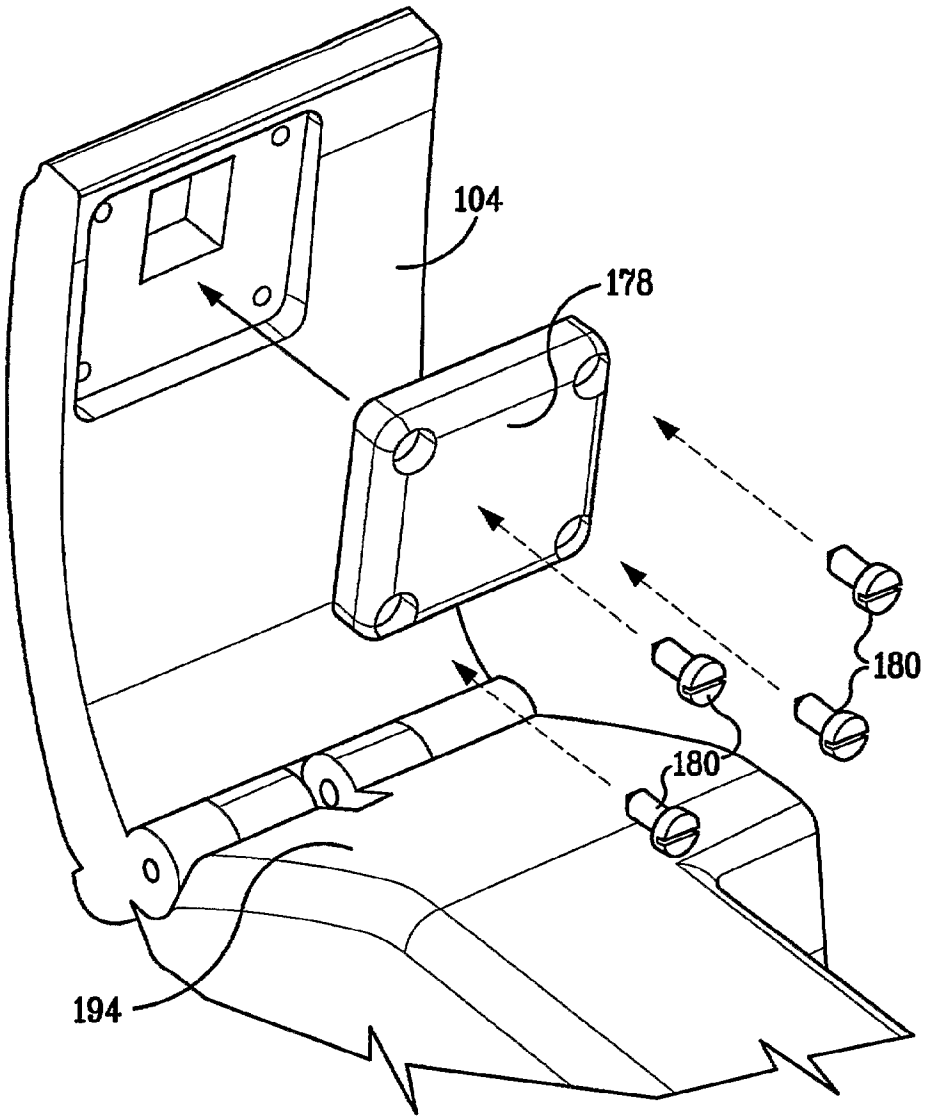

The present invention is directed to a magnetic latch mechanism for securing a first member in a closed position relative to a second member, the first member being movable between the closed position and an open position relative to the second member. The first member may, for example, be a door and the second member may, for example, be a compartment or a doorframe. In the illustrated examples, the one or more doors provide closures for the compartment. The latch according to the present invention is particularly well suited for use in applications where dual doors that are mechanically linked are to be secured in the closed position. In such applications closing one of the doors also moves the other door to the closed position. However, the mechanical linkage between the doors is not perfect and the closing of the doors is not always simultaneous. Often one door will slightly lag behind the other door in closing. With the magnetic latch of the present invention, once the door is within the region of the influence of the magnetic field of the latch magnet, the door will be pulled to the final closed position by magnetic attraction. Therefore, movement of each door to the final closed position in a dual door application will be properly effected regardless of significant variations in relative positions of the doors as the doors approach their closed positions. Accordingly, the latch of the present invention is designed to effect proper securing of the doors in the closed position even when one door lags behind the other.

In its most basic form the magnetic latch mechanism includes a magnetic insert capable of attachment to the first member, a housing adapted for attachment to the second member, at least one magnet rotationally supported by the housing, and an actuation mechanism capable of selectively moving the magnet from the latched position to the unlatched position responsive to an input from a user.

In its most basic form the magnetic insert can be made of any magnetically attractable material and the term magnetic as used herein is intended to broadly refer to any material that is attracted by a magnet. However, it is preferred that the magnetic insert itself be a magnet and most preferably a permanent magnet. Both the rotationally supported magnet and the magnetic insert can be permanent magnets selected from types that include, but are not limited to, rare earth magnets.

The rotary magnet is rotationally supported by the housing such that the magnet is rotationally movable between latched and unlatched positions. In the latched position, the rotary magnet is positioned such that with the first member in the closed position relative to the second member the rotary magnet holds the first member with the magnetic insert attached thereto in the closed position through magnetic attraction between the rotary magnet and the magnetic insert. In the latched position the pole of the rotary magnet facing the magnetic insert is of an opposite type (i.e. north, south) as compared to the pole of the magnetic insert facing the rotary magnet. Accordingly, an attractive force is exerted between the rotary magnet and the magnetic insert with the result that the first member or door to which the magnetic insert is attached is held in the closed position.

When the rotary magnet is in the unlatched position, the rotary magnet is positioned such that with the first member in the closed position relative to the second member the rotary magnet repels the magnetic insert that is attached to the first member so as to cause the first member to move from the closed position toward the open position relative to the second member. In the unlatched position the pole of the rotary magnet substantially facing the magnetic insert is of the same type (i.e. north, south) as the pole of the magnetic insert facing the rotary magnet. Accordingly, a force is exerted between the rotary magnet and the magnetic insert that tends to repel one from the other with the result that the first member or door to which the magnetic insert is attached is moved from the closed position toward the open position.

The actuation mechanism selectively moves the rotary magnet from the latched position to the unlatched position responsive to an input from a user. Thus, a user can move the rotary magnet from the latched to the unlatched position in order to open the first member or door.

In a second embodiment the magnetic latch mechanism further includes a striker capable of attachment to the first member, and a hook-shaped pawl supported for rotation with the rotary magnet. The pawl engages the striker to mechanically prevent the first member from being moved to the open position when the rotary magnet is in the latched position.

In dual door applications at least one rotary magnet and a corresponding magnetic insert would be provided for each door. The rotary magnets can be linked so that they move in unison and can be moved from the latched position to the unlatched position by a common actuation mechanism in order to provide for the simultaneous opening of the dual doors.

Referring to FIGS. 1-27, a magnetic latch mechanism 100 with dual rotary magnets according to the present invention can be seen. The latch mechanism 100 is a remotely operated latch mechanism designed to secure two doors 102 and 104 in the closed position substantially simultaneously, using two rotating magnets 106 and 108. The latch mechanism 100 is designed to be installed between the pivots or hinges of the doors 102, 104 with the rotary magnets 106, 108 supported for rotation about coincident axes of rotation. Also the rotary magnets 106, 108 rotate in the same direction. The rotary magnets 106 and 108 are supported by a common magnet carrier 119 that is rotationally supported by the housing 132. The rotary magnets 106, 108 are attached to the magnet carrier 119 such that the rotary magnets and the magnet carrier rotate as one unit. The rotary magnets 106, 108 are rotationally movable between respective latched and unlatched positions. The magnetic latch mechanism 100 also includes magnetic inserts 114 and 116 that can be attached to the doors 102 and 104, respectively. Each of the magnetic inserts 114 and 116 corresponds to a respective one of the rotary magnets 106, 108. When the rotary magnets 106, 108 are in their latched positions and the doors 102 and 104 are in their closed positions, the pole of each of each of the rotary magnets 106, 108 facing the respective magnetic insert 114, 116 is of an opposite type (i.e. north, south) as compared to the pole of the magnetic insert 114, 116 facing its respective rotary magnet 106, 108. Accordingly, an attractive force is exerted between each rotary magnet 106, 108 and its respective magnetic insert 114, 116 with the result that the doors 102, 104 to which the magnetic inserts 114, 116 are attached are held in the closed position.

When the rotary magnets 106, 108 are in their unlatched positions and the doors 102 and 104 are in their closed positions, the pole of each of each of the rotary magnets 106, 108 substantially facing the respective magnetic insert 114, 116 is of the same type (i.e. north, south) as compared to the pole of the magnetic insert 114, 116 facing its respective rotary magnet 106, 108. Accordingly, a repulsive force is exerted between each rotary magnet 106, 108 and its respective magnetic insert 114, 116 with the result that the doors 102, 104 to which the magnetic inserts 114, 116 are attached are moved from the closed position toward the open position. By "substantially facing" it is meant that the rotary magnets 106, 108 are rotated away from the latched position until such a point as the repulsive force exerted on the pole of the magnetic insert 114, 116 facing its respective rotary magnet 106, 108 by the like pole of the respective rotary magnet 106, 108 is greater and overcomes the attractive force exerted on the pole of the magnetic insert 114, 116 facing its respective rotary magnet 106, 108 by the opposite type pole of the respective rotary magnet 106, 108. In the illustrated embodiment the rotary magnets 106, 108 are rotated 145° from the latched position. Of course, the amount of rotation from the latched position could range from the point of incipient repulsion described previously, which would occur at some angle greater than 90° and less than 145°, up to 180°.

Similar considerations indicate that the opposite type pole of the respective rotary magnet 106, 108 need not directly face the pole of the magnetic insert 114, 116 facing its respective rotary magnet 106, 108 in the latched position. The rotary magnets 106, 108 may deviate from the preferred direct facing relationship between the opposite type poles of the rotary magnets and of their respective magnetic inserts by an angle θ in the range of $0° \leqq \theta \leqq 90°$. Of course the direct facing relationship between the opposite type poles of the rotary magnets and of their respective magnetic inserts (i.e. at or about 0°) is preferred for the latched position because that position gives the greatest holding power to the latch mechanism.

Each magnetic insert 114, 116 is attached to a respective one of the doors 102, 104 by being inserted in a magnetic insert housing 176, 178, respectively, which in turn are attached to a respective one of the doors 102, 104. In the illustrated example, the magnetic insert housings 176, 178 are attached to the doors 102, 104 by screws 180.

The means for attaching the magnetic insert housings 176, 178 to the doors 102, 104 is not critical to the present invention and any suitable fastening means including screws, rivets, pins, nails and adhesives may be used. Furthermore, the magnetic insert housings 176, 178 may be of unitary construction with the doors 102, 104. The magnetic insert housings 176, 178 may also be dispensed with entirely and the magnetic inserts 114, 116 may be attached to the doors 102, 104 directly. As with the housings 176, 178, any suitable fastening means including screws, rivets, pins, nails and adhesives may be used to attach the magnetic inserts 114, 116 to the doors 102, 104. As yet another alternative, the magnetic inserts 114, 116 may be embedded in the material of the doors 102, 104.

The magnetic latch mechanism 100 includes a housing 132 that rotationally supports the magnet carrier 119 having the rotary magnets 106, 108 attached thereto. The top opening 101 of the housing 132 allows the magnet carrier 119 to be placed inside the housing 132 during assembly of the latch mechanism 100.

The magnet carrier 119 is elongated and is provided with two cavities 184, 186 for receiving the rotary magnets 106 and 108, respectively. The rotary magnets 106 and 108 are held in place in the cavities 184, 186 by screws 182. The cavities 184, 186 open to the same side of the carrier 119 and are positioned in tandem along the longitudinal axis of the carrier 119. Conical spindles 140, 142 project from either end of the carrier 119 along the longitudinal axis thereof. The spindles 140, 142 are centered in cylindrical bearings 187 and 189, respectively. The bearings 187 and 189 are in turn received in U-shaped recesses 111, 113 to thereby rotationally support the carrier 119 in the housing 132. The particular modality used for rotationally supporting the carrier 119 in the housing 132 is not critical to the present invention. The illustrated modality for rotationally supporting the carrier 119 in the housing 132 was selected for ease of assembly and durability and to allow the use of diverse materials. Alternatively, the ends of the carrier 119 could be directly supported for rotation by the housing 132 or through the use of axles, shafts or pins.

The housing 132 has an opening 103 that allows the operating rod 120 to extend out of the housing 132 where it can be directly or indirectly manipulated by a user. One end of the rod 120 is located within the housing 132 and is referred to as the inner end of the rod 120. The inner end of the rod 120 is supported for rectilinear movement in the longitudinal direction of the rod 120 by the housing 132. A peg 191 projects laterally from the rod 120 at about the inner end of the rod 120. The peg 191 is received in the spiral groove 193 formed in the carrier 119. The peg 191 and the spiral groove 193 cooperate to impart rotational movement to the carrier 119 in response to the rectilinear movement of the rod 120. The actuation mechanism comprises the rod 120, the peg 191 and the spiral groove 193. The operating rod 120 can be remotely operated by a Bowden cable or directly and the operation can be manual or by using an electrical actuator. Generally some type of remotely located handle or push button would be provided as a user interface for the manual or electrical operation of the latch mechanism 100, respectively.

The latch mechanism 100 is mounted to the frame or compartment 194 by mounting the housing 132 to the frame or compartment 194. The rotary magnets 106 and 108 need not be exposed or visible when viewed from the position of the magnetic inserts 114, 116. The means for attaching the housing 132 to the doorframe 194 is not critical to the present invention and any suitable fastening means including screws, rivets, pins, nails and adhesives may be used. Furthermore, the housing 132 may be of unitary construction with the doorframe 194.

The latch mechanism 100 can be used as an adjunct to a mechanical latching mechanism to open and close the doors 102, 104. The magnets 106, 108 pull the doors 102, 104 in to ensure they both latch correctly. The magnets 106, 108 control the final movement and position and the gap conditions of the doors 102, 104 in the closed position. The magnets 106, 108 also aid the opening of the doors 102, 104 when the mechanism is unlatched.

To open the latch mechanism 100 the button, for example, is pushed. This operates both the magnetic latch mechanism 100 and the adjunct mechanical latch mechanism that mechanically releases the doors 102 and 104. In the magnet mechanism 100, the rod 120 is pulled 15 mm, this rotates the magnet carrier 119 and the magnets 106, 108, 145 degrees away from their latched positions due to the interaction of the peg 191 and the spiral groove 193. In this "unlatched" position these magnets repel the magnetic inserts 114, 116 attached to the doors 102, 104, forcing the doors to swing open. Once the magnetic inserts 114, 116 are clear of the magnetic field of the rotary magnets 106, 108, the rod 120, which is preferably spring biased toward the latched position, returns the carrier 119 and the rotary magnets 106, 108 to their original latched positions.

To close the doors 102, 104, one of the doors 102, 104 is pushed closed. This action pulls the other door shut through the mechanical linkage between the doors (not shown), however, one door will lag behind the other due to the free play of the linkage. Once the doors 102, 104 are almost closed the magnets 106, 108 will pull both lids in flush so they can be held in position mechanically by the adjunct mechanical latch mechanism (not shown). Thus, the magnetic latch mechanism 100 provides a latching system that tolerates the free play of the mechanical linkage of the doors 102, 104 and the positional difference between the doors near closing, but still closes the doors flush and simultaneously.

Figure 28:
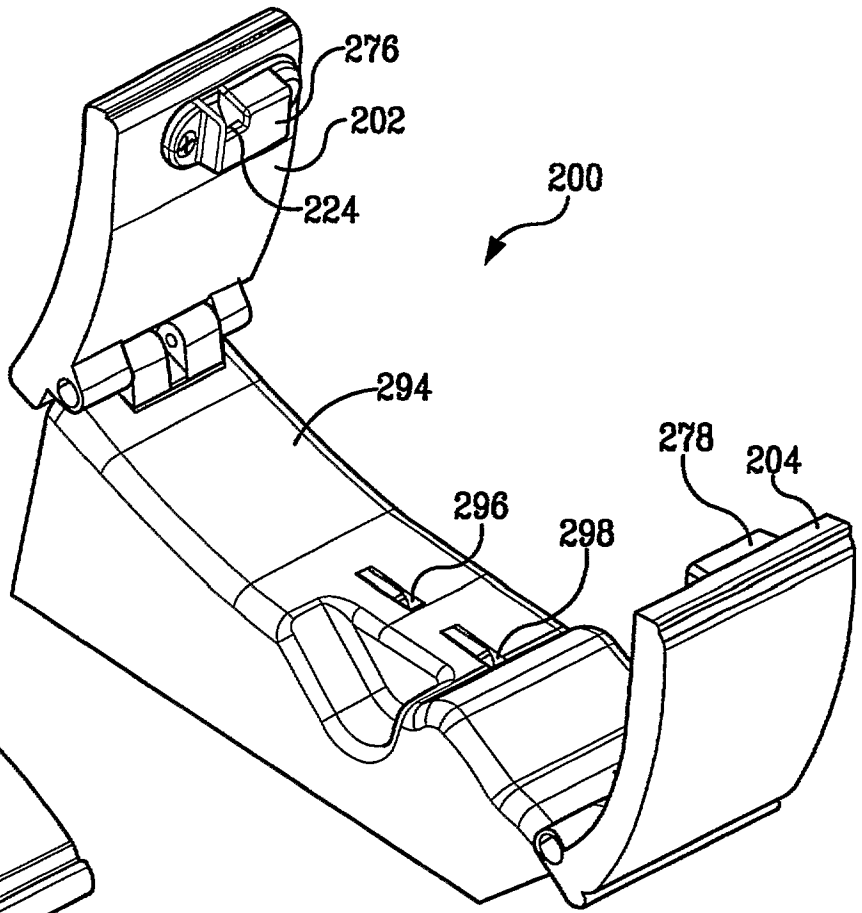
FIG. 28 is a fragmentary environmental view showing a compartment with dual doors incorporating the second embodiment of the magnetic latch mechanism of the present invention and with the doors in the open position.
Figure 83:
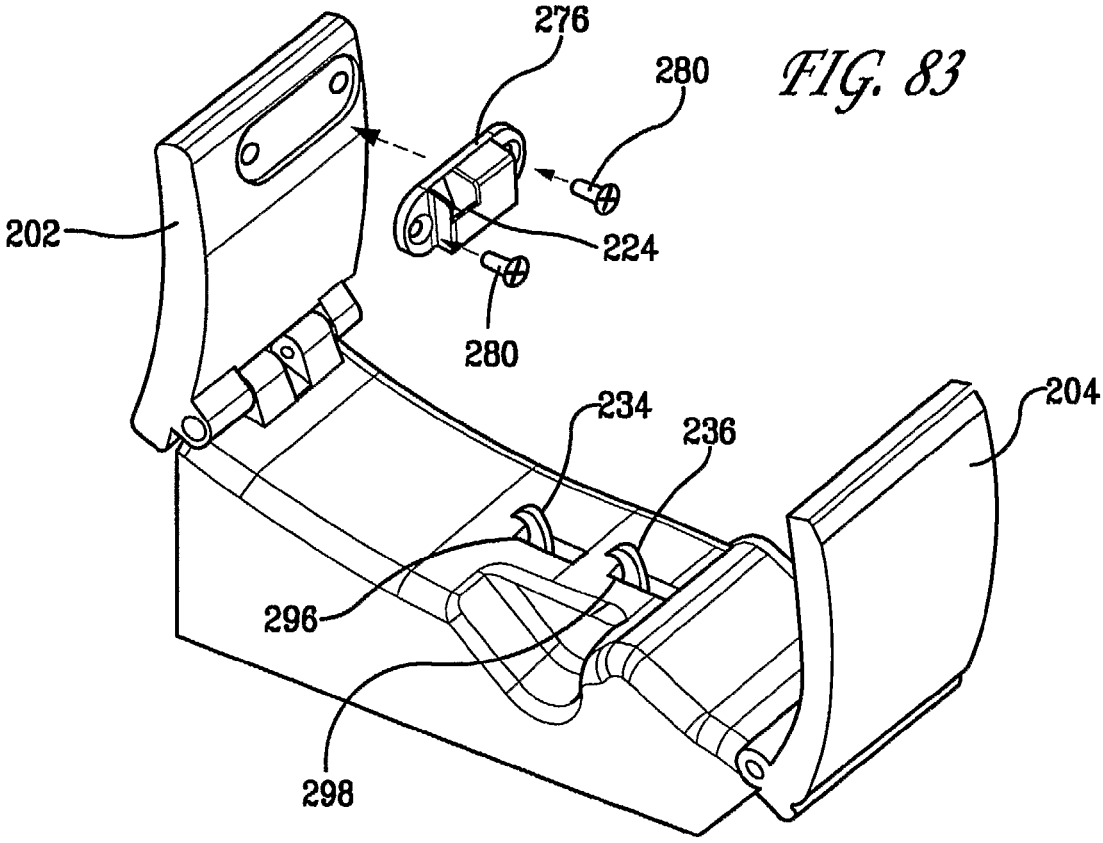

Referring to FIGS. 28-83, a second embodiment 200 of the magnetic latch mechanism with dual rotary magnets according to the present invention can be seen. The latch mechanism 200 is a remotely operated latch mechanism designed to secure two doors 202 and 204 in the closed position substantially simultaneously, using two rotating magnets 206 and 208. The latch mechanism 200 is designed to be installed between the pivots or hinges of the doors 202, 204 with the rotary magnets 206, 208 supported for rotation about parallel and spaced-apart axes of rotation. Also, the rotary magnets 206, 208 rotate in the same direction. Each of the rotary magnets 206 and 208 are supported by a separate magnet carrier 218, 219, respectively. Each magnet carrier 218, 219 is rotationally supported by the housing 232. Each of the rotary magnets 206, 208 are attached to the respective magnet carrier 218, 219 such that the rotary magnet and its respective magnet carrier rotate as one unit. Each of the rotary magnets 206, 208, and their respective magnet carriers 218, 219, are rotationally movable between respective latched and unlatched positions.

The magnetic latch mechanism 200 also includes a pair of hook-shaped pawls 234, 236. Each hook-shaped pawl 234, 236 is supported by a respective magnet carrier 218, 219 such that the hook-shaped pawl 234, 236 and the respective magnet carrier 218, 219 rotate as a unit. Each hook-shaped pawl 234, 236 has a hooked head 222 with a beveled cam surface 238 that faces away from the respective magnet carrier 218, 219 and a catch surface 244 that faces toward the respective magnet carrier 218, 219.

The magnetic latch mechanism 200 also includes magnetic inserts 214 and 216 that can be attached to the doors 202 and 204, respectively. Each of the magnetic inserts 214 and 216 corresponds to a respective one of the rotary magnets 206, 208. When the rotary magnets 206, 208 are in their latched positions and the doors 202 and 204 are in their closed positions, the pole of each of each of the rotary magnets 206, 208 facing the respective magnetic insert 214, 216 is of an opposite type (i.e. north, south) as compared to the pole of the magnetic insert 214, 216 facing its respective rotary magnet 206, 208. In the illustrated example, the magnetic inserts 214, 216 are positioned such that their south poles face their respective rotary magnet 206, 208 when the doors 202 and 204 are in their closed positions. Also in the illustrated example, the rotary magnets 206, 208 are positioned in their carriers 218, 219 such that their north poles face their respective magnetic inserts 214, 216 when the rotary magnets 206, 208 and their carriers are in their latched positions and the doors 202 and 204 are in their closed positions. Accordingly, an attractive force is exerted between each rotary magnet 206, 208 and its respective magnetic insert 214, 216 with the result that the doors 202, 204 to which the magnetic inserts 214, 216 are attached are held in the closed position.

Furthermore, the hook-shaped pawls 234, 236 engage respective strikers 224, 226 to mechanically block the movement of the doors 202, 204 from the closed position to the open position. This feature prevents the doors 202, 204 from being forcibly pried open from the exterior of the compartment being secured by the doors 202, 204.

The magnetic latch mechanism 200 includes the pair of strikers 224, 226 each of which corresponds to a respective one of the pair of hook-shaped pawls 234, 236. Each striker 224, 226 is supported by a respective door 202, 204 such that the striker is spaced apart from the respective door's interior surface and the head 222 of the hook-shaped pawl 234, 236 can fit between the respective striker 224, 226 and the respective door 202, 204. Each striker 224, 226 has a cam surface 228 that faces away from the respective door 202, 204 and a catch surface 230 that faces toward the respective door 202, 204. The cam surface 228 of each striker can interact with the cam surface 238 of the respective hook-shaped pawl 234, 236 to move the pawl out of the way of the striker 224, 226 and allow the respective door to move to the closed position if the respective hook-shaped pawl happens to be in the latched position when the respective door is being moved to the closed position. Once the door 202, 204 is in the closed position, the magnetic attraction between the respective rotary magnet 206, 208 and the respective magnetic insert 214, 216 moves the respective hook-shaped pawl 234, 236 to the latched position. In the latched position, the head 222 of the respective hook-shaped pawl 234, 236 is positioned between the respective striker 224, 226 and the respective door 202, 204, where the catch surface 244 of the respective hook-shaped pawl 234, 236 can engage the catch surface 230 of the respective striker 224, 226 to thereby mechanically block the movement of the respective door 202, 204 from the closed position to the open position.

Figure 29:
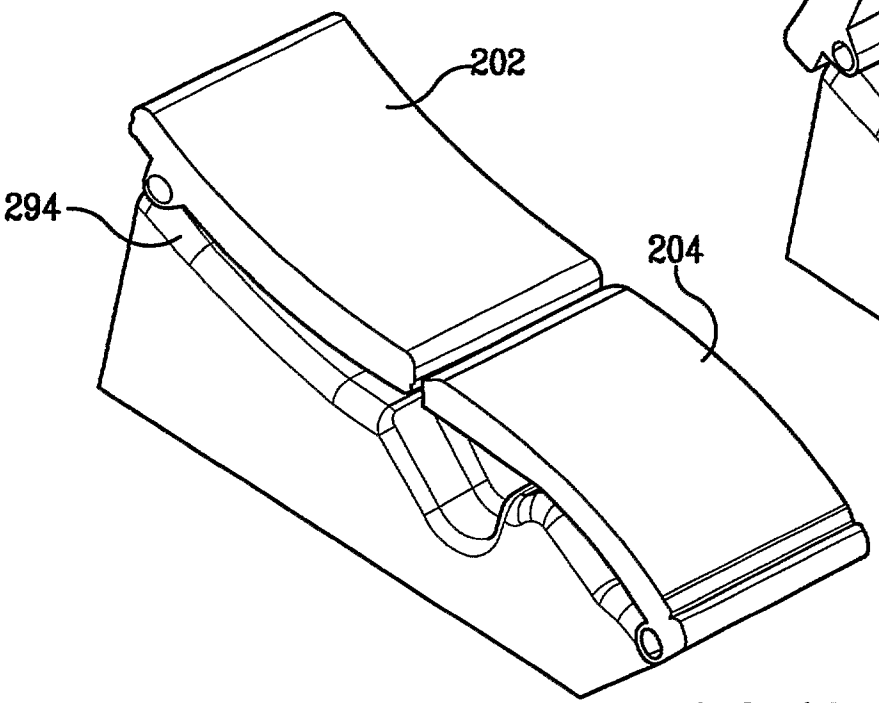
FIG. 29 is a fragmentary environmental view showing a compartment with dual doors incorporating the second embodiment of the magnetic latch mechanism of the present invention and with the doors in the closed position.
Figure 31:
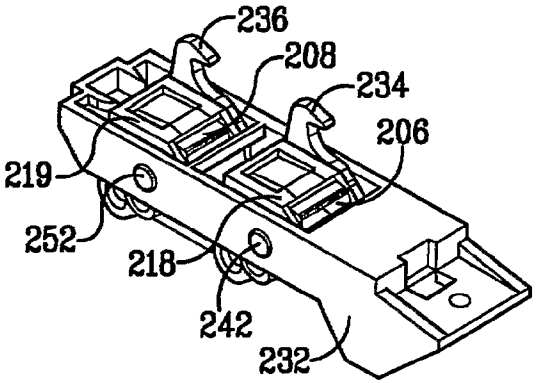
FIGS. 30-35 are views showing the rotary magnet assembly of the second embodiment of the magnetic latch mechanism of the present invention showing the rotary magnets and the hook-shaped pawls in the latched position.
Figure 34:
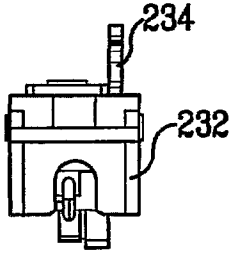
Figure 30:
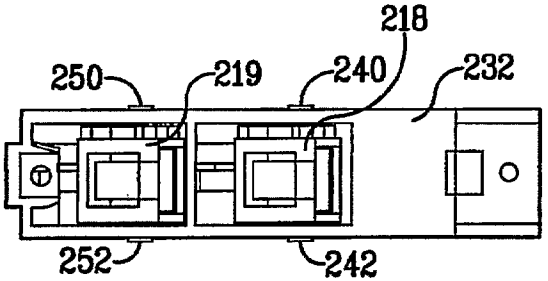
Figure 33:
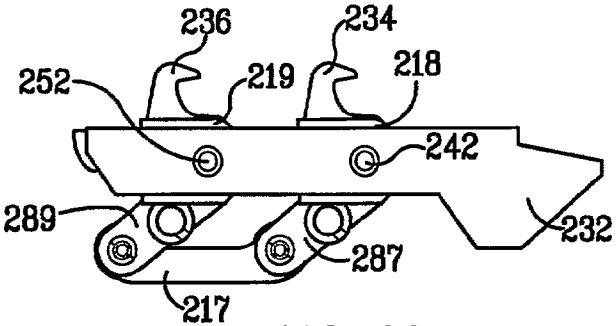
Figure 35:
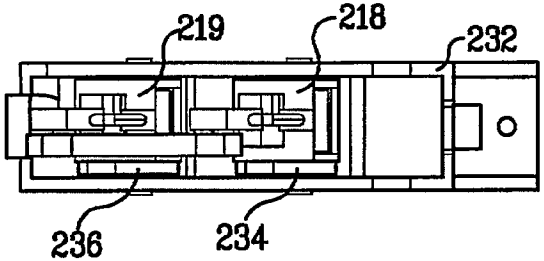
Figure 32:
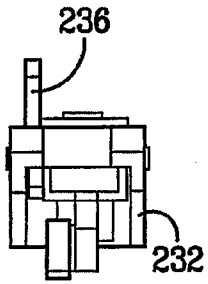
Figure 36:
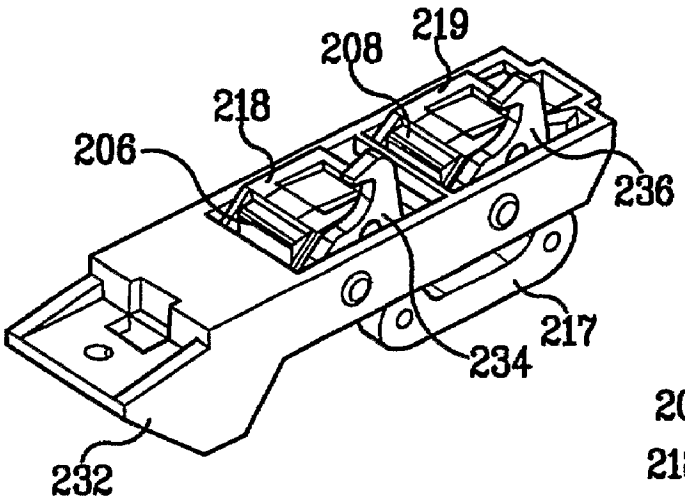
FIG. 36 is a perspective view of the rotary magnet assembly of the second embodiment of the magnetic latch mechanism of the present invention showing the rotary magnets and the hook-shaped pawls in the latched position.
Figure 38:
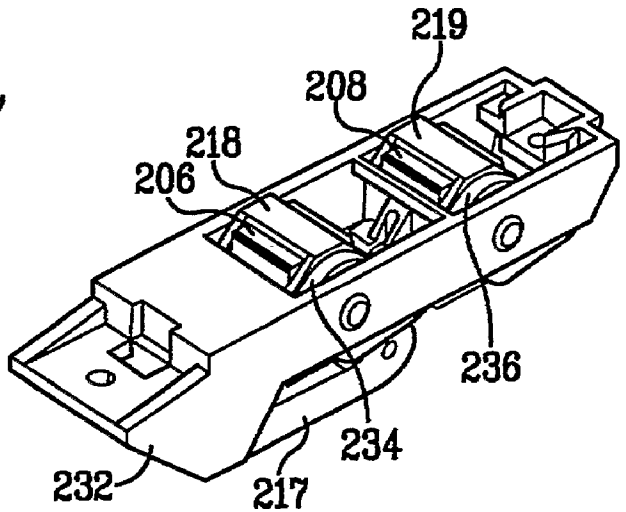
FIG. 38 is a perspective view of the rotary magnet assembly of the second embodiment of the magnetic latch mechanism of the present invention showing the rotary magnets and the hook-shaped pawls in the unlatched position.
Figure 39:
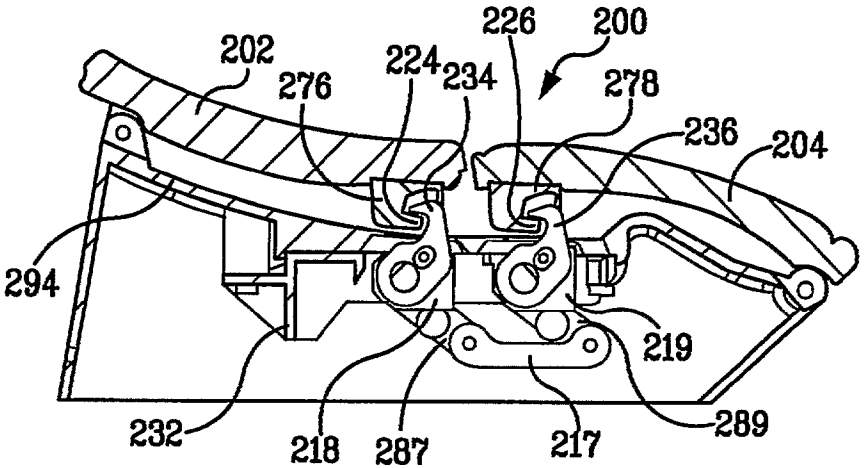
FIG. 39 is a cross sectional view showing a compartment with dual doors incorporating the second embodiment of the magnetic latch mechanism of the present invention showing the rotary magnets and the hook-shaped pawls in the latched position.
Figure 40:
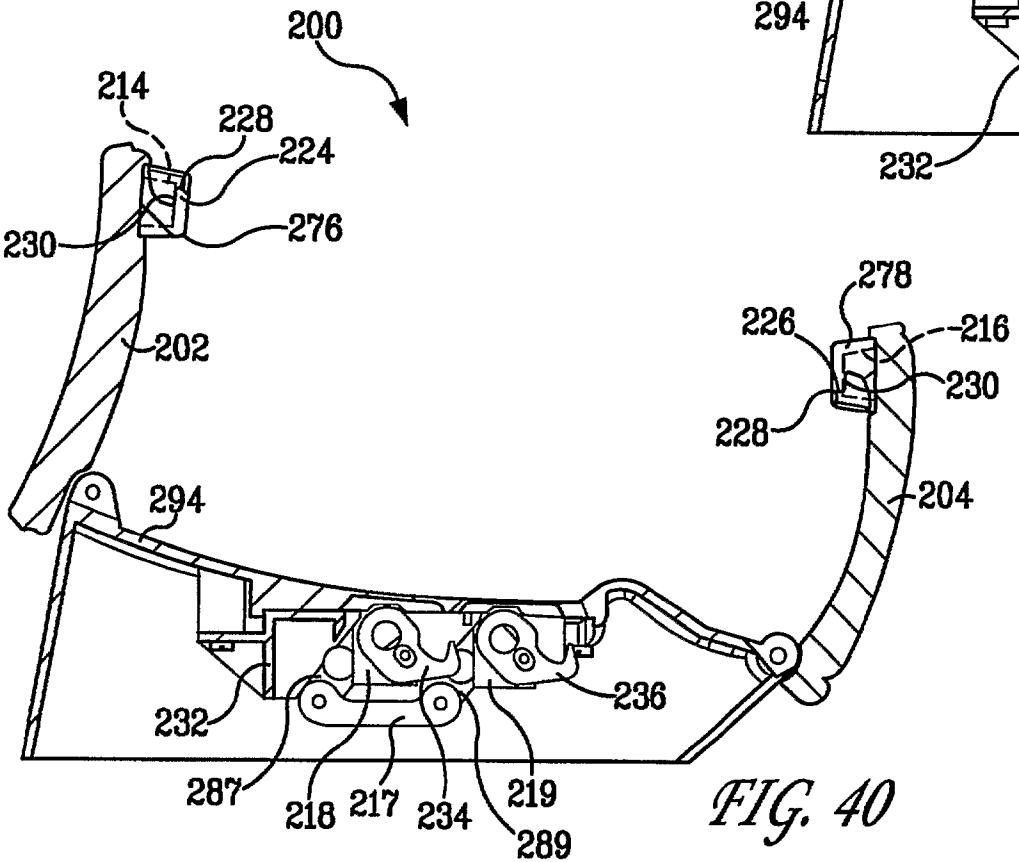
FIG. 40 is a cross sectional view showing a compartment with dual doors incorporating the second embodiment of the magnetic latch mechanism of the present invention showing the rotary magnets and the hook-shaped pawls in the unlatched position.
Figure 42:
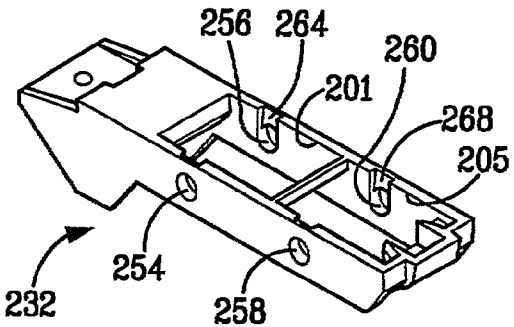
FIGS. 41-46 are views showing the housing of the second embodiment of the magnetic latch mechanism of the present invention.
Figure 45:
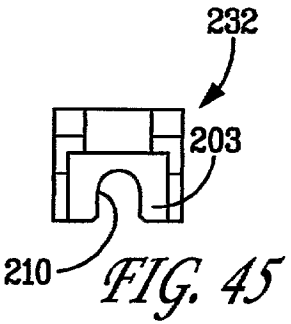
Figure 41:
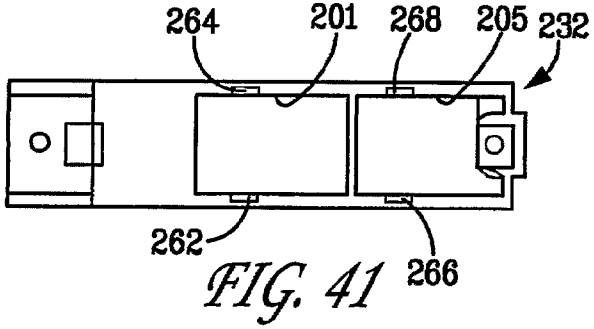
Figure 44:
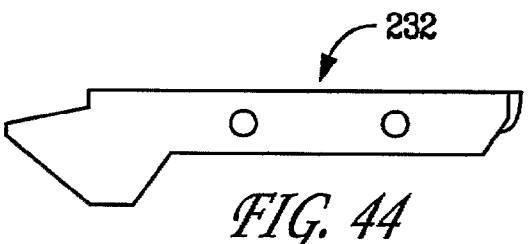
Figure 46:
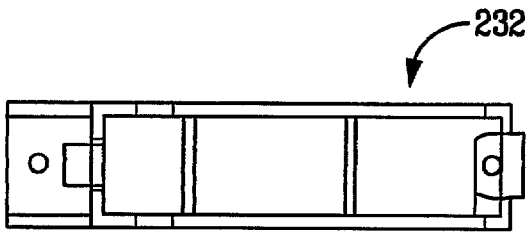
Figure 43:
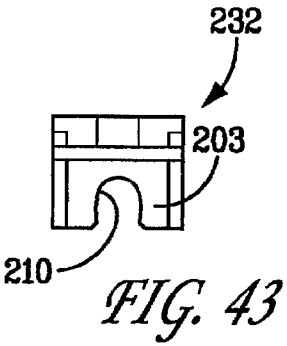
Figure 47:
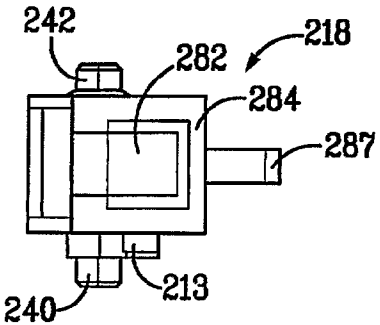
FIGS. 47-53 are views showing the rotary magnet carrier of the second embodiment of the magnetic latch mechanism of the present invention.
Figure 48:
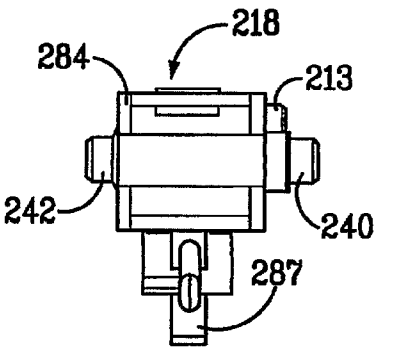
Figure 49:
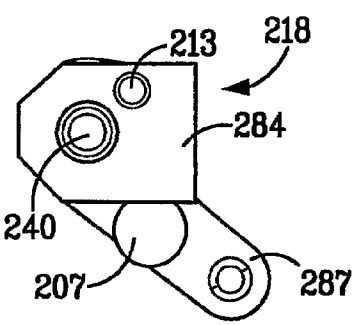
Figure 50:
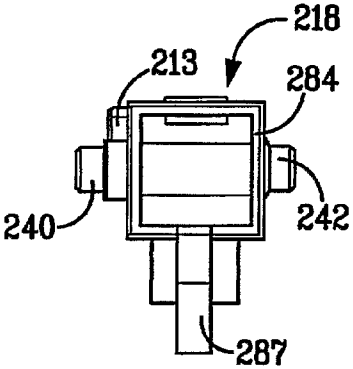
Figure 51:
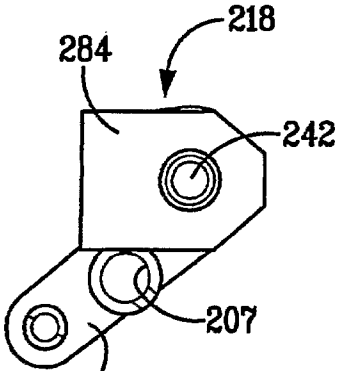
Figure 52:
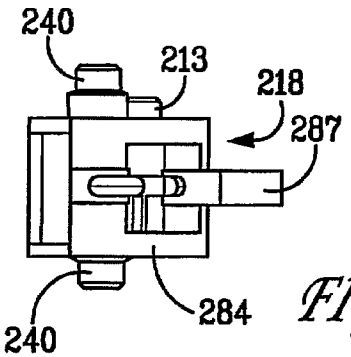
Figure 53:
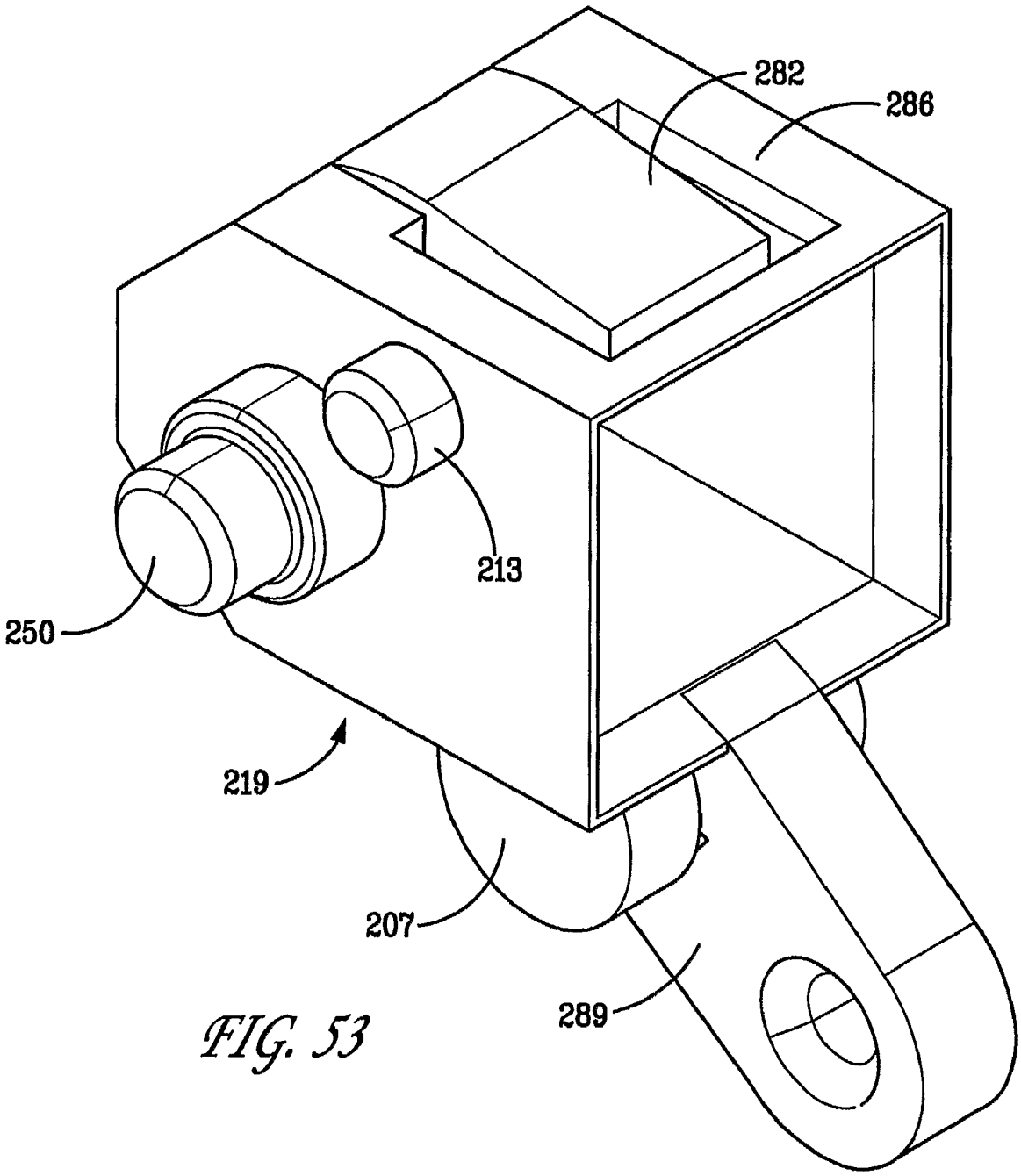
Figure 62:
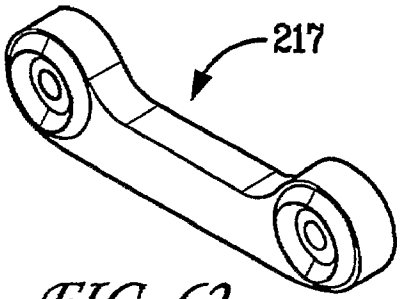
FIGS. 61-67 are views showing the linkage bar of the second embodiment of the magnetic latch mechanism of the present invention.
Figure 66:
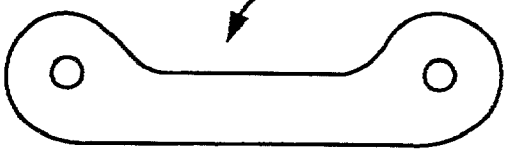
Figure 65:
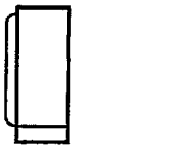
Figure 61:
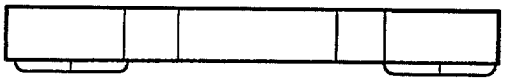
Figure 64:
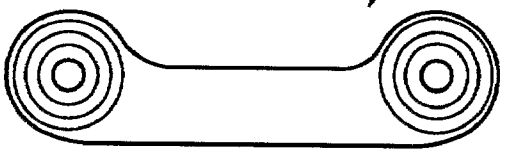
Figure 67:
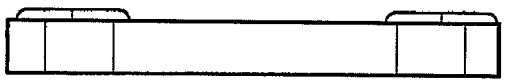
Figure 63:
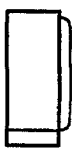
Figure 69:
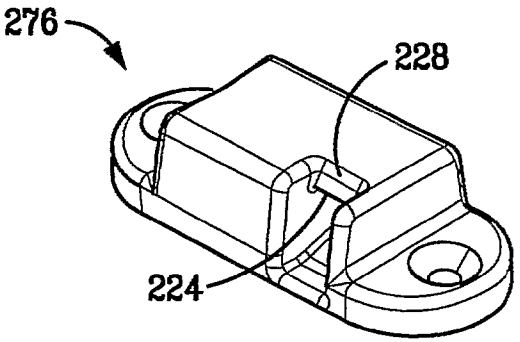
FIGS. 68-75 are views showing the magnetic insert housing having an integral striker of the second embodiment of the magnetic latch mechanism of the present invention.
Figure 74:
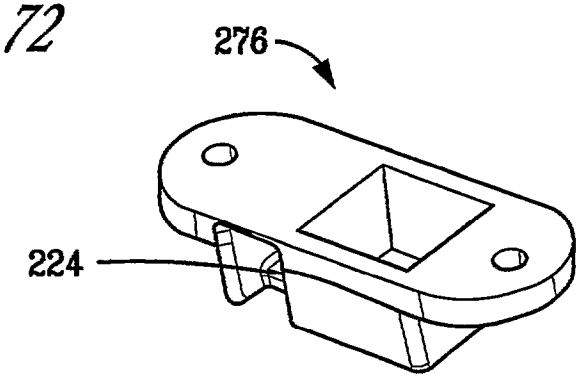
Figure 72:
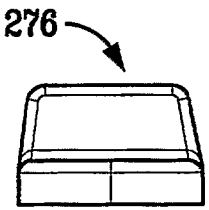
Figure 68:
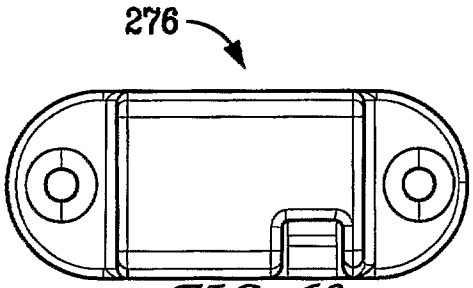
Figure 71:
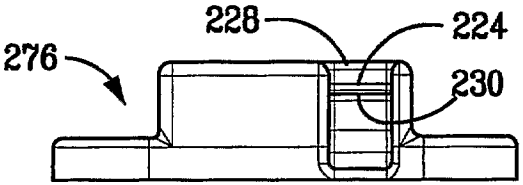
Figure 73:
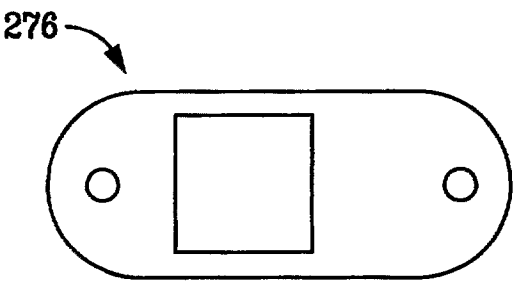
Figure 70:
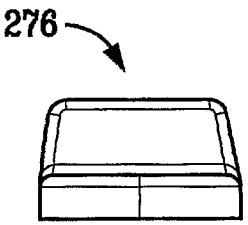
Figure 75:
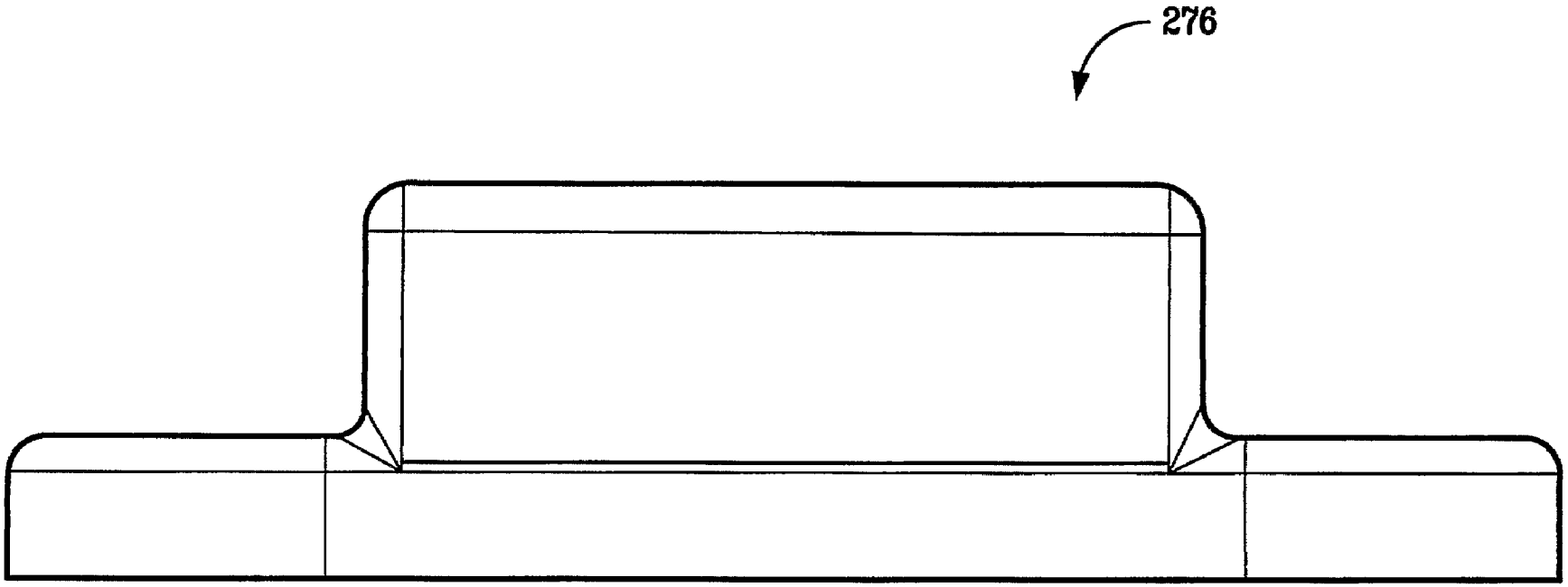
Figure 76:
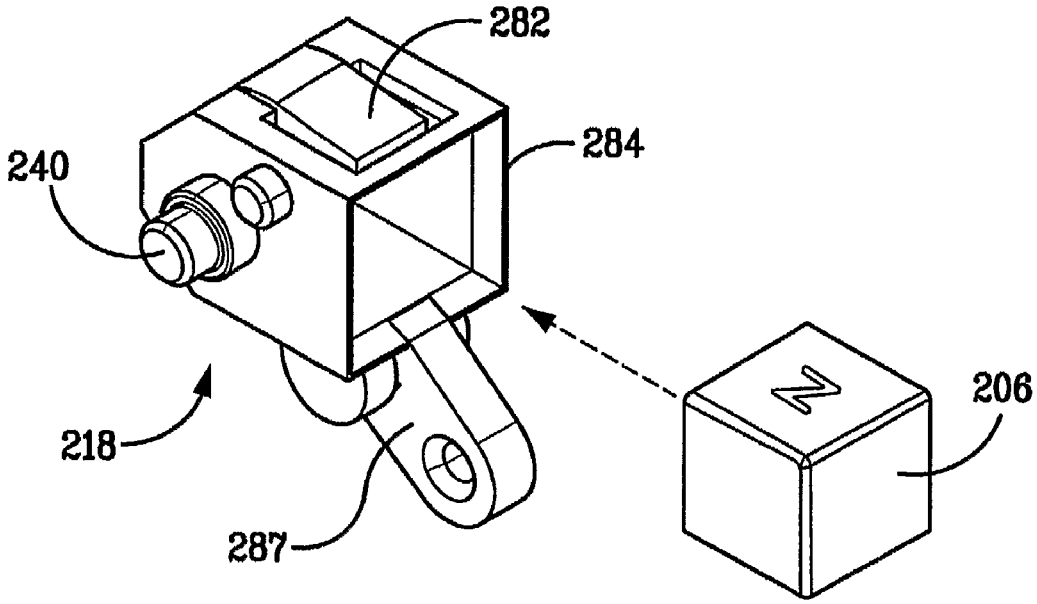
FIGS. 76-83 show the sequence of assembly of the second embodiment of the magnetic latch mechanism of the present invention.
Figure 77:
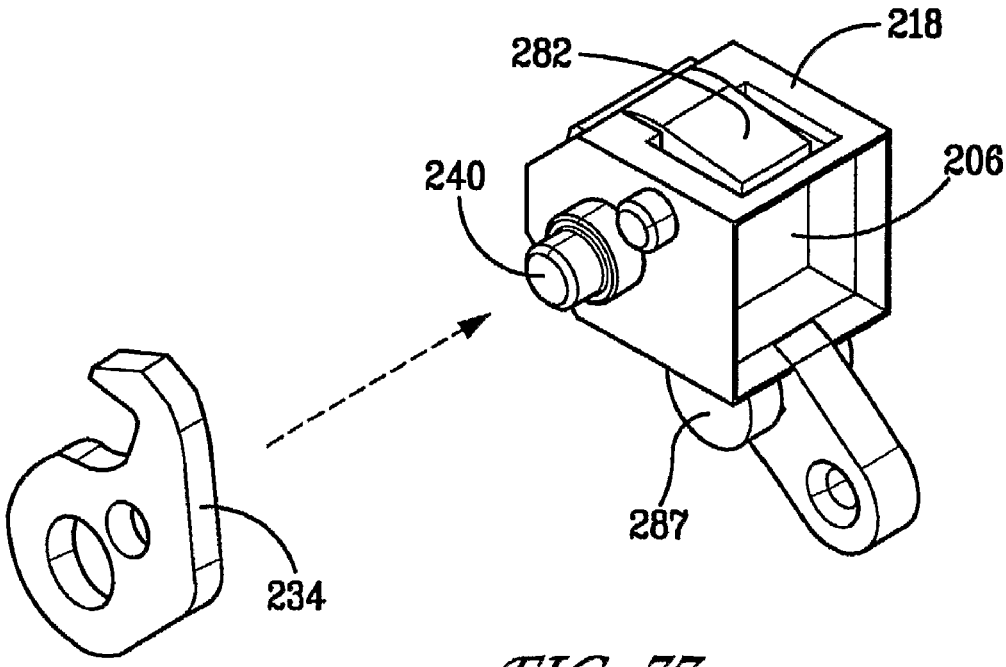
Figure 78:
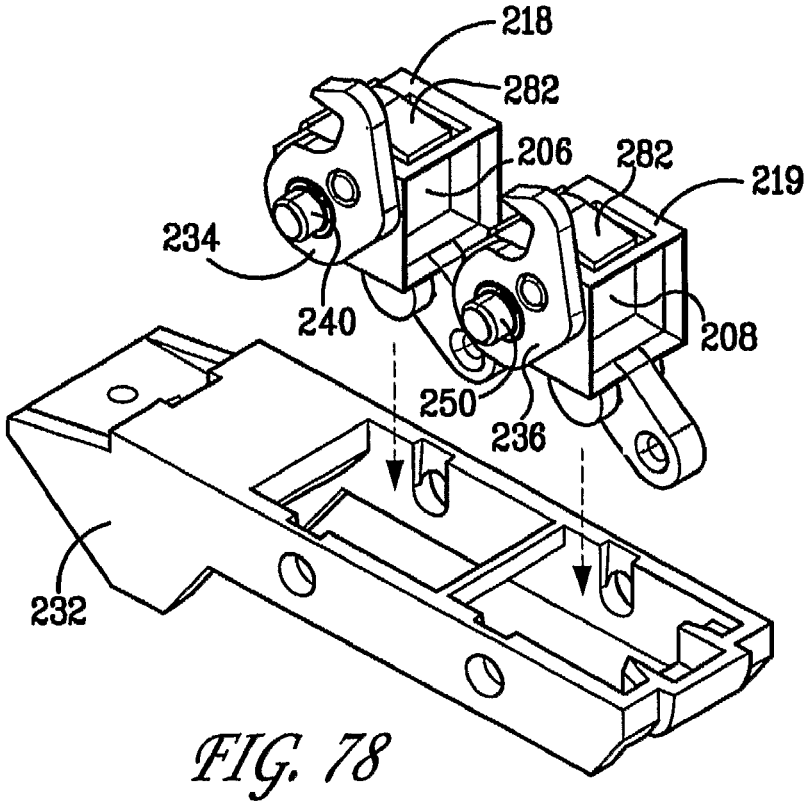
Figure 79:
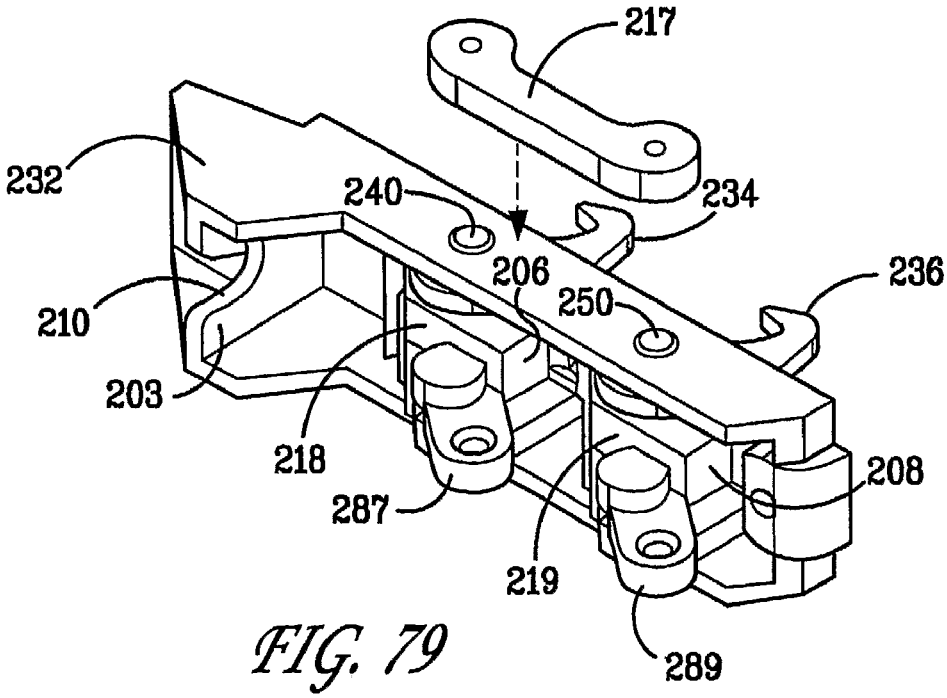
Figure 80:
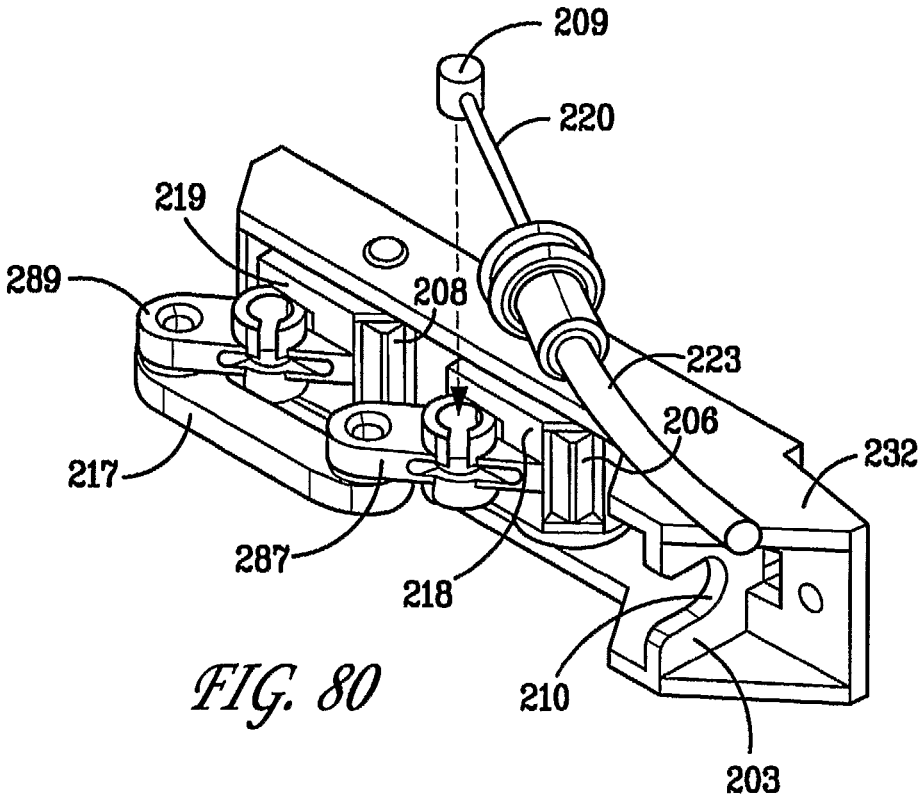
Figure 81:
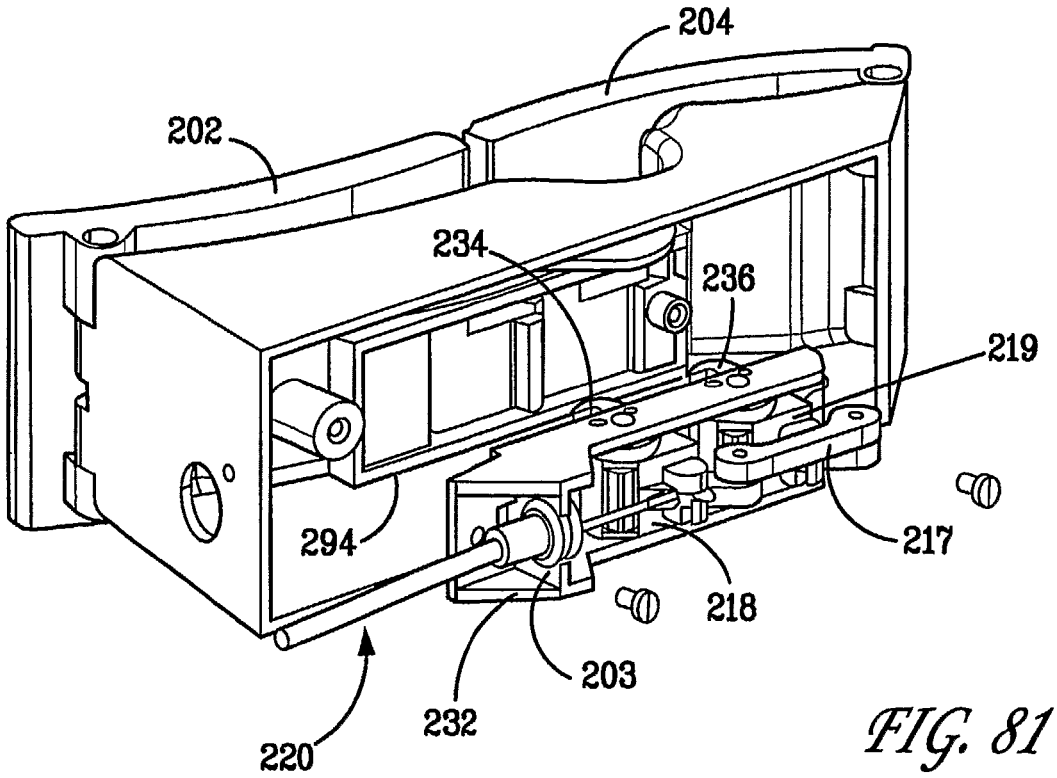
Figure 82:
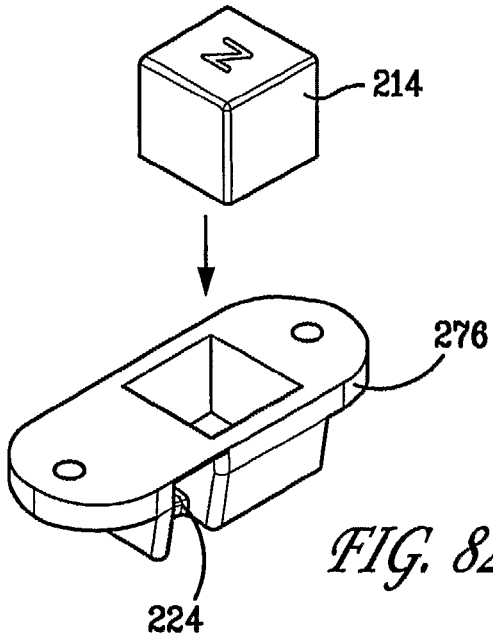

When the rotary magnets 206, 208 are in their unlatched positions (illustrated in FIGS. 28, 38 and 40) and the doors 202 and 204 are in their closed positions (illustrated in FIGS. 29 and 39), the pole of each of each of the rotary magnets 206, 208 that is of an opposite type compared to the pole of the respective magnetic insert 214, 216 facing the rotary magnet 206, 208, is positioned farther from the respective magnetic insert 214, 216, while the pole of each of each of the rotary magnets 206, 208 that is of the same type compared to the pole of the respective magnetic insert 214, 216 facing the rotary magnet 206, 208, is positioned closer to the respective magnetic insert 214, 216, relative to the latched position of the rotary magnets 206, 208. In the unlatched position, the repulsive force between the like poles of each rotary magnet 206, 208 and the respective magnetic insert 214, 216 overcomes the attractive force between the opposite poles of each rotary magnet 206, 208 and the respective magnetic insert 214, 216. Accordingly, a net repulsive force is exerted between each rotary magnet 206, 208 and its respective magnetic insert 214, 216. In addition, the hook-shaped pawls 234, 236 rotate to their unlatched positions along with the rotary magnets 206, 208 and their magnet carriers 218, 219, which removes the mechanical impediment to the opening of the doors 202, 204, with the result that the doors 202, 204 to which the magnetic inserts 214, 216 are attached are moved from the closed position toward the open position.

Recall that in the illustrated example, the magnetic inserts 214, 216 are positioned such that their south poles face their respective rotary magnet 206, 208 when the doors 202 and 204 are in their closed positions. In the illustrated example, the north poles of the rotary magnets 206, 208 move away from the south poles of their respective magnetic inserts 214, 216 and the south poles of the rotary magnets 206, 208 move toward the south poles of their respective magnetic inserts 214, 216 as the rotary magnets 206, 208 and their carriers 218, 219 move from the latched position to the unlatched position, such that a net repulsive force is exerted between each rotary magnet 206, 208 and its respective magnetic insert 214, 216 when the rotary magnets 206, 208 reach their unlatched positions.

The rotary magnets 206, 208 and their carriers 218, 219 move through an angle in the range of greater than 10° and less than or equal to 180° as they move from the latched position to the unlatched position. More preferably, the rotary magnets 206, 208 and their carriers 218, 219 move through an angle in the range of greater than or equal to 30° and less than or equal to 180° as they move from the latched position to the unlatched position. Even more preferably, the rotary magnets 206, 208 and their carriers 218, 219 move through an angle in the range of greater than or equal to 45° and less than or equal to 145° as they move from the latched position to the unlatched position. Yet even more preferably, the rotary magnets 206, 208 and their carriers 218, 219 move through an angle in the range of greater than or equal to 60° and less than or equal to 120° as they move from the latched position to the unlatched position.

As with the embodiment 100, the opposite type pole of the respective rotary magnet 206, 208 need not directly face the pole of the magnetic insert 214, 216 facing its respective rotary magnet 206, 208 in the latched position. The rotary magnets 206, 208 may deviate from the preferred direct facing relationship between the opposite type poles of the rotary magnets and of their respective magnetic inserts by an angle $\theta$ in the range of $0° \leqq \theta < 90°$. The position of the hook-shaped pawls relative to the rotary magnets 206, 208 would of course have to be adjusted accordingly. Of course, the direct facing relationship between the opposite type poles of the rotary magnets and of their respective magnetic inserts (i.e. at or about 0°) is preferred for the latched position because that position gives the greatest holding power to the latch mechanism.

Each magnetic insert 214, 216 is attached to a respective one of the doors 202, 204 by being inserted in a magnetic insert housing 276, 278, respectively, which in turn are attached to a respective one of the doors 202, 204. In the illustrated example, the magnetic insert housings 276, 278 are attached to the doors 202, 204 by screws 280.

The means for attaching the magnetic insert housings 276, 278 to the doors 202, 204 is not critical to the present invention and any suitable fastening means including screws, rivets, pins, nails and adhesives may be used. Furthermore, the magnetic insert housings 276, 278 may be of unitary construction with the doors 202, 204. The magnetic insert housings 276, 278 may also be dispensed with entirely and the magnetic inserts 214, 216 may be attached to the doors 202, 204 directly. As with the housings 276, 278, any suitable fastening means including screws, rivets, pins, nails and adhesives may be used to attach the magnetic inserts 214, 216 to the doors 202, 204. As yet another alternative, the magnetic inserts 214, 216 may be embedded in the material of the doors 202, 204.

In the illustrated embodiment, the strikers 224, 226 are of unitary construction with the magnetic insert housings 276, 278, respectively. As with the housings 276, 278, the means for attaching the strikers 224, 226 to the doors 202, 204 are not critical to the present invention. Any suitable structure that supports the striker 224, 226 such that the striker is spaced apart a sufficient amount from the respective door's interior surface in order for the head 222 of the hook-shaped pawl 234, 236 to fit between the respective striker 224, 226 and the respective door 202, 204 may be employed and any suitable fastening means including screws, rivets, pins, nails and adhesives may be used to attach the structure to the respective door. Furthermore, the strikers 224, 226 may be of unitary construction with the doors 202, 204.

The magnetic latch mechanism 200 includes a housing 232 that rotationally supports the magnet carriers 218, 219 having the rotary magnets 206, 208, respectively, attached thereto. The top openings 201 and 205 of the housing 232 allow the magnet carriers 218, 219 to be placed inside the housing 232 during assembly of the latch mechanism 200. Furthermore, the top openings 201 and 205 of the housing 232 allow the hook-shaped pawls 234, 236 to extend out of the housing 232 to engage the strikers 224, 226 in the latched position.

Each magnet carrier 218, 219 is in the form of a receptacle 284, 286 for receiving the respective rotary magnet 206, 208. The rotary magnets 206 and 208 are held in place in the receptacles 284, 286 by resilient catch arms 282. Each receptacle 284, 286 has a spindle, 240, 242 and 250, 252, respectively, projecting from either side thereof. The receptacles 284, 286, and consequently carriers 218, 219, are positioned in tandem along the longitudinal axis of the housing 232 with their axes of rotation being transverse, i.e. perpendicular, to the longitudinal axis of the housing 232. The spindles 240, 242, 250, 252 are received in and rotationally supported by the holes 254, 256, 258, 260 in the sides of the housing 232, respectively. The spindles 240, 242, 250, 252 snap into the holes 254, 256, 258, 260 aided by lead-in ramps 262, 264, 266, 268, respectively. The particular modality used for rotationally supporting the magnet carriers 218, 219 in the housing 232 is not critical to the present invention. The illustrated modality for rotationally supporting the carriers 218, 219 in the housing 232 was selected for ease of assembly. Alternatively, the carriers 218, 219 could be supported for rotation by the housing 232 through the use of axles, shafts, or pins, or with other types of bearing arrangements used in place of the holes 254, 256, 258, 260.

Each hook-shaped pawl 234, 236 has a hole 211 through which a respective spindle 240, 250 passes. Each magnet carrier 218, 219 has a projection 213 that is eccentrically located relative to the longitudinal axis of the respective spindle 240, 250. In the illustrated embodiment, the longitudinal axis of the respective spindle 240, 250 coincides with the axis of rotation of the respective carrier 218, 219. The projection 213 of each carrier 218, 219 is received in a hole 215 formed in the respective hook-shaped pawl 234, 236. Thus, relative rotation between each carrier 218, 219 and the respective hook-shaped pawl 234, 236 is prevented and each hook-shaped pawl 234, 236 and the respective magnet carrier 218, 219 rotate as a unit.

Alternatively, some range of relative motion between each carrier 218, 219 and the respective hook-shaped pawl 234, 236 may be provided for. In this case each hook-shaped pawl 234, 236 would need to be spring biased toward their current position illustrated in the drawings relative to the respective carrier 218, 219. This relative motion would allow each hook-shaped pawl 234, 236 to move out of the way of the respective striker 224, 226, and allow the respective door to move to the closed position if the respective hook-shaped pawl happens to be in the latched position when the respective door is being moved to the closed position, without necessarily moving the respective rotary magnet 206, 208.

Each receptacle 284, 286 has a lever arm 287, 289 extending from it. The lever arms 287, 289 are linked by a linkage bar 217 that is pivotally connected at each end to a respective one of the lever arms 287, 289. The linkage bar 217 causes the magnet carriers 218, 219 to move in unison such that they and the rotary magnets 206, 208 can be moved from the latched position to the unlatched position by a common actuation mechanism in order to provide for the simultaneous opening of the dual doors 202, 204. Each of the lever arms 287, 289 has a receptacle 207 adapted for receiving the cylindrical dowel 209 at the end of a respective Bowden cable for actuating the latch mechanism 200. Only one of the receptacles 207 is used in the illustrated embodiment.

The housing 232 has a bracket 203 with a U-shaped slot 210 that can support one end of the sheath 223 of the Bowden cable 220. The Bowden cable 220 allows the remote operation of the latch mechanism 200. With the one end of the sheath 223 of the Bowden cable 220 installed in the U-shaped slot 210 of the bracket 203, pulling the remote end (not illustrated) of the Bowden cable 220 will cause the rotation of the rotary magnets 206, 208, magnet carriers 218, 219, and hook-shaped pawls 234, 236 from their latched positions, assuming them to initially be in the latched position, to their unlatched positions.

The remote end of the Bowden cable 220 can be pulled manually or by using an electrical actuator. Generally some type of remotely located handle or push button would be provided as a user interface for the manual or electrical operation of the latch mechanism 200, respectively.

The latch mechanism 200 is mounted to the frame or compartment 294 by mounting the housing 232 to the frame or compartment 294. The rotary magnets 206 and 208 need not be exposed or visible when viewed from the position of the magnetic inserts 214, 216. However, slots 296 and 298 or the like must be provided in the doorframe 294 allow the hook-shaped pawls 234, 236 to extend through the doorframe 294 to engage the strikers 224, 226 as they rotate to their latched positions. The means for attaching the housing 232 to the doorframe 294 is not critical to the present invention and any suitable fastening means including screws, rivets, pins, nails and adhesives may be used. Furthermore, the housing 232 may be of unitary construction with the doorframe 294.

The magnets 206, 208 pull the doors 202, 204 in to ensure they both latch correctly. The magnets 206, 208 control the final movement and position and the gap conditions of the doors 202, 204 in the closed position. The magnets 206, 208 also aid the opening of the doors 202, 204 when the mechanism is unlatched.

To open the latch mechanism 200 the button (not shown), for example, is pushed. This would cause the remote end of the Bowden cable 220 to be pulled by one of the mechanisms previously mentioned. The pulling of the Bowden cable 220 causes the rotation of the rotary magnets 206, 208, magnet carriers 218, 219, and hook-shaped pawls 234, 236 from their latched positions to their unlatched positions. This action disengages the hook-shaped pawls 234, 236 from their respective strikers 224, 226, which mechanically releases the doors 202 and 204. In addition, the magnets 206, 208 are rotated to their unlatched positions where these magnets repel the magnetic inserts 214, 216 attached to the doors 202, 204, forcing the doors to swing open. Once the magnets 206, 208 are clear of the influence of the magnetic field of the magnetic inserts 214, 216 and the Bowden cable 220 is released, the magnetic attraction of the north pole of one of the magnets 206, 208 for the south pole of the other one of the magnets 206, 208, or vice versa, will maintain the rotary magnets 206, 208, the magnet carriers 218, 219, and the hook-shaped pawls 234, 236 near their unlatched positions. In the illustrated embodiment, the magnetic attraction of the north pole of the rotary magnet 206 for the south pole of the rotary magnet 208 maintains the rotary magnets 206, 208, the magnet carriers 218, 219, and the hook-shaped pawls 234, 236 in a position close enough to their unlatched positions such that the rotary magnets 206, 208 and the hook-shaped pawls 234, 236 stand ready to secure the doors 202, 204 in the closed position as the doors 202, 204 are moved toward the closed position.

Figure 37:
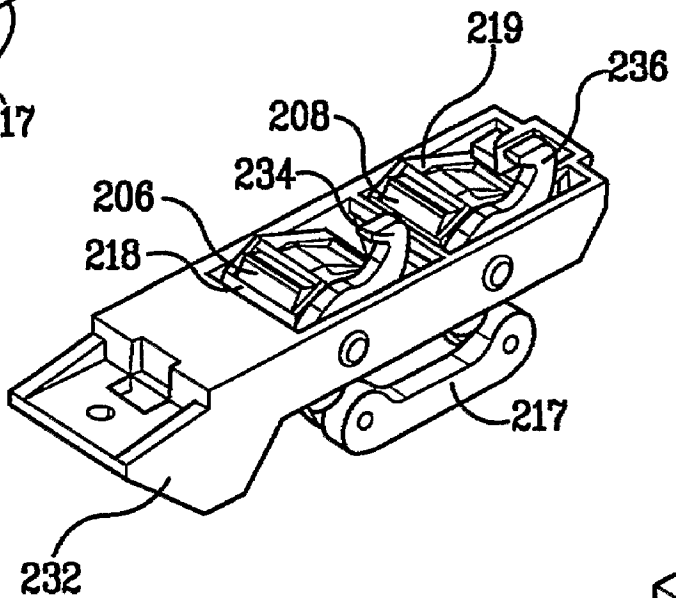
FIG. 37 is a perspective view of the rotary magnet assembly of the second embodiment of the magnetic latch mechanism of the present invention showing the rotary magnets and the hook-shaped pawls in a position intermediate the latched and unlatched positions.

To close the doors 202, 204, one of the doors 202, 204 is pushed closed. This action pulls the other door shut through the mechanical linkage between the doors (not shown), however, one door will lag behind the other due to the free play of the linkage. Once the doors 202, 204 are almost closed the rotary magnets 206, 208, the magnet carriers 218, 219, and the hook-shaped pawls 234, 236 will begin to rotate toward their latched positions under the influence of the magnetic field of the magnetic inserts 214, 216, such that they will be in an intermediate position similar to that illustrated in FIG. 37. At this point the strong magnetic attraction between the magnetic inserts 214, 216 and their respective rotary magnets 206, 208 causes the lagging door to accelerate such that both doors close simultaneously, and the rotary magnets 206, 208 and the hook-shaped pawls 234, 236 simultaneously rotate to their latched positions. At this point the hook-shaped pawls 234, 236 engage the strikers 224, 226 and there is strong magnetic attraction between the magnetic inserts 214, 216 and their respective rotary magnets 206, 208. Accordingly, both doors are held in the closed position mechanically and magnetically. Thus, the magnetic latch mechanism 200 provides a latching system that tolerates the free play of the mechanical linkage of the doors 202, 204 and the positional difference between the doors near closing, but still closes the doors flush and simultaneously.

If the lag between the doors 202, 204 is great enough, one door may close completely, causing both rotary magnets 206, 208 and both hook-shaped pawls 234, 236 to move to their respective latched positions, before the lagging door reaches its closed position. In such event, the striker of the lagging door will move the respective hook-shaped pawl out of the way as previously described and allow the lagging door to move to the closed position where upon the respective hook-shaped pawl and respective rotary magnet return to their latched positions to secure the previously lagging door in the closed position. Because of the linkage between the magnet carriers 218 and 219, the hook-shaped pawl corresponding to the leading door that is already closed may be temporarily disengaged from its respective striker, but the leading door will remain closed due to magnetic attraction such that the leading door's respective hook-shaped pawl can reengage its respective striker once the lagging door is fully closed. It should be evident from the relative proportions of the hook-shaped pawls and their respective strikers, that the movement of the rotary magnets during the closing of the lagging door will be slight enough such that a strong enough attraction exists at all times during the closing of the lagging door between the striker of the lagging door and the respective rotary magnet to accomplish the closing of the lagging door as just described.

Figure 84:
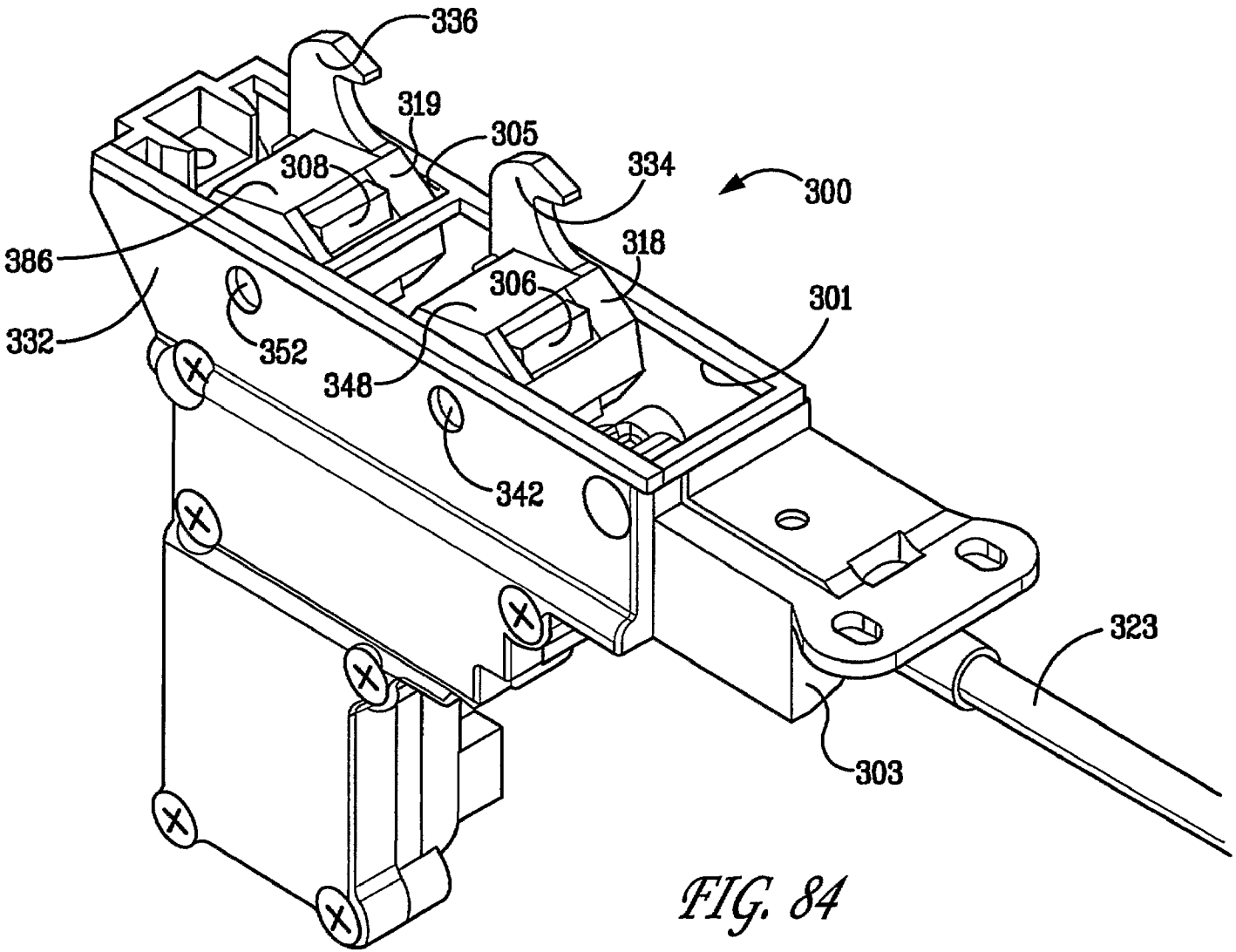
FIG. 84 is a perspective view of the magnetic latch mechanism of the present invention showing the rotary magnets in the latched position.
Figure 85:
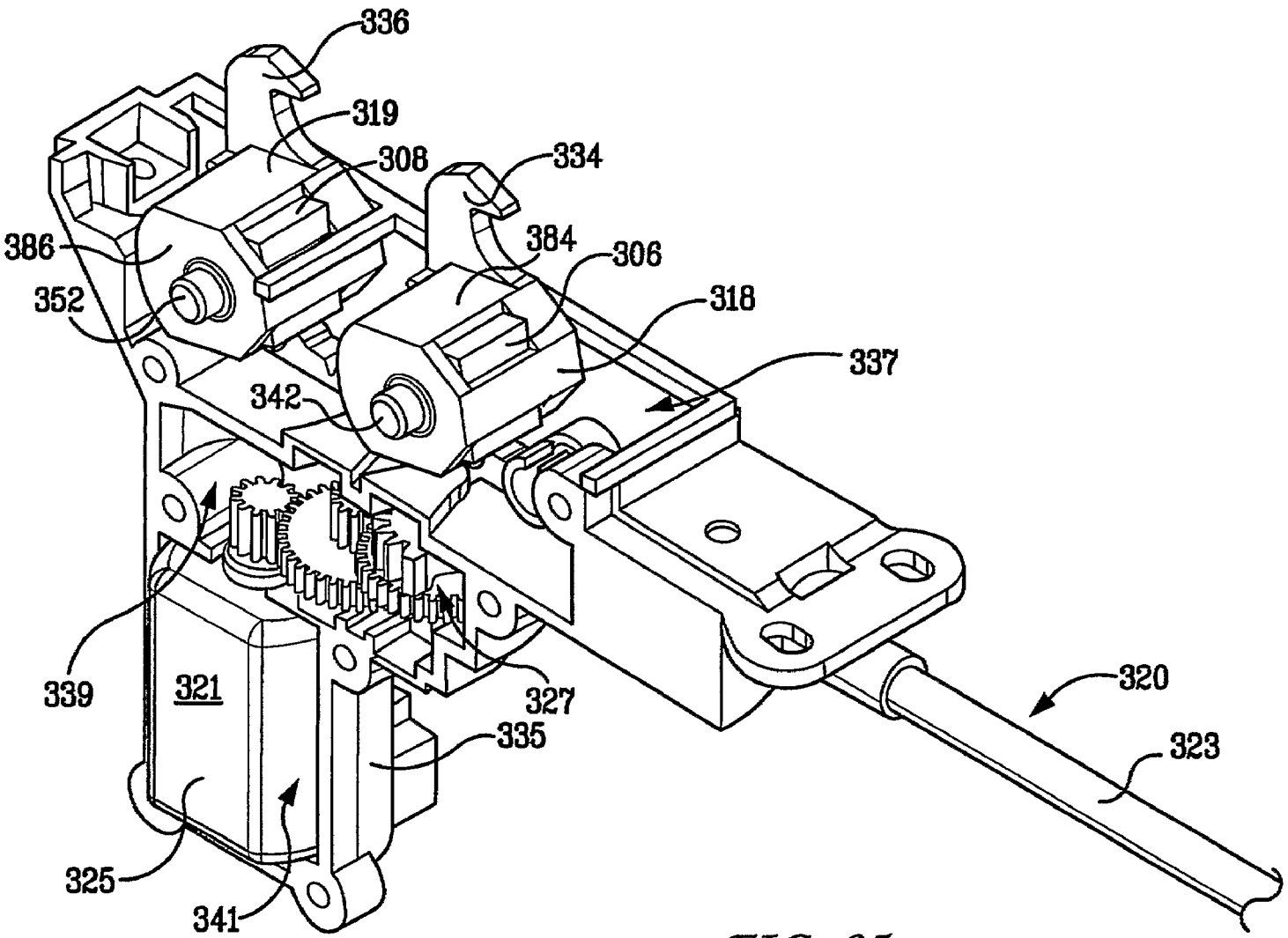
FIG. 85 is a perspective view of the magnetic latch mechanism of the present invention with the housing cover removed to reveal internal detail and showing the rotary magnets in the latched position.
Figure 86:
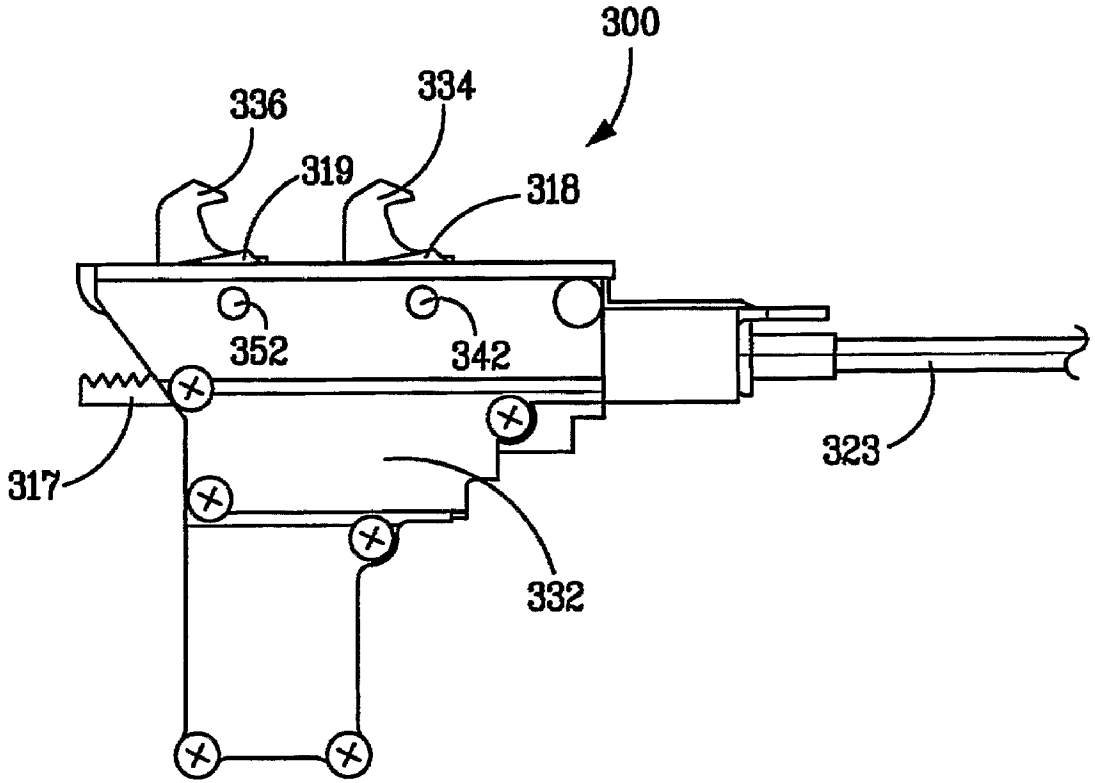
FIG. 86 is a left side view of the magnetic latch mechanism of the present invention showing the rotary magnets in the latched position.
Figure 87:
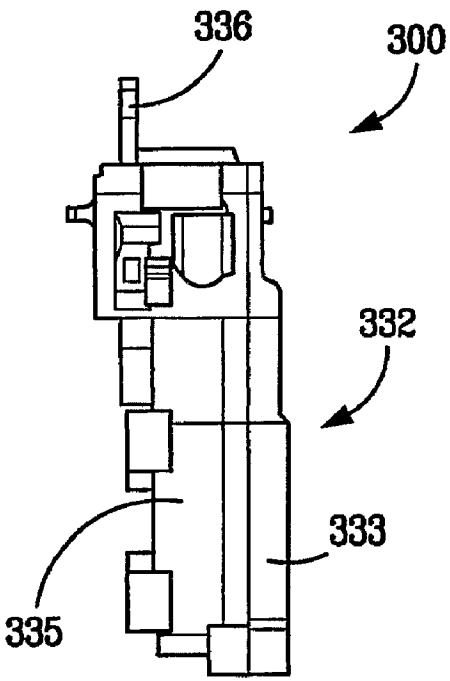
FIG. 87 is a front view of the magnetic latch mechanism of the present invention showing the rotary magnets in the latched position.
Figure 88:
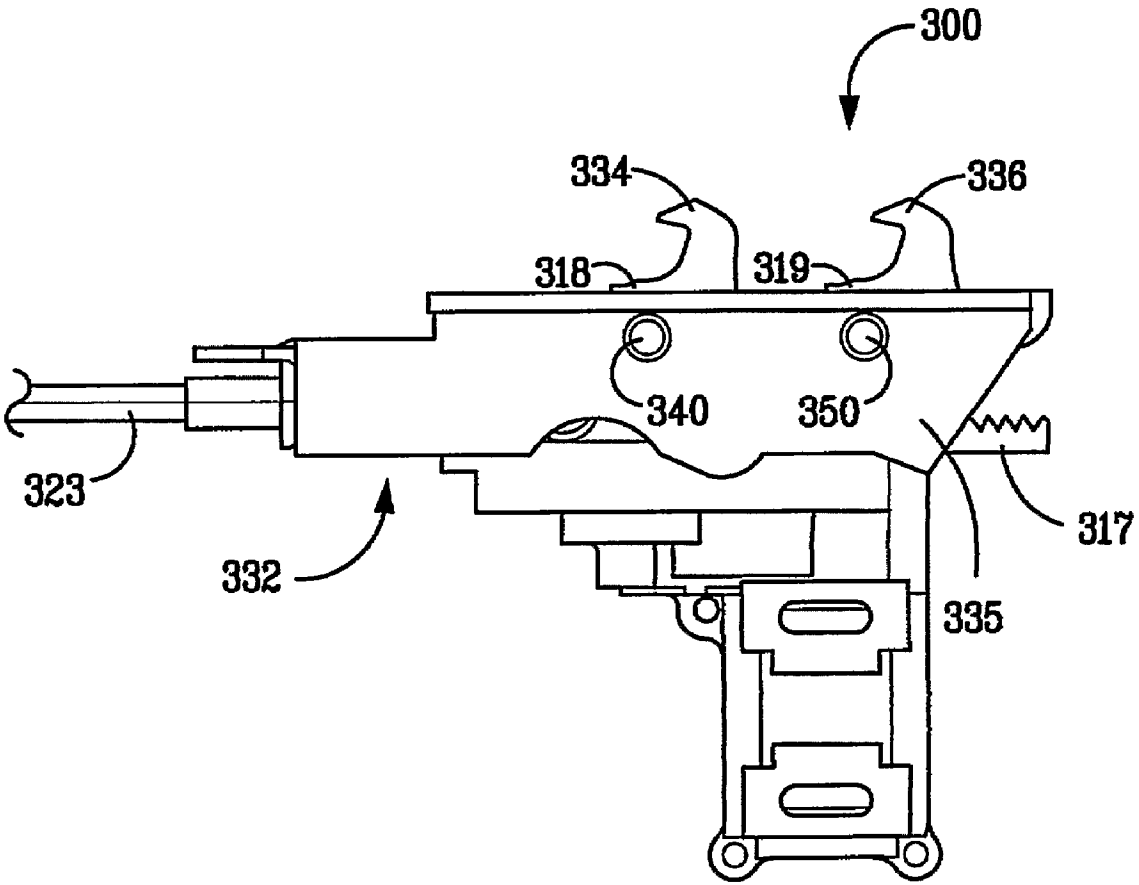
FIG. 88 is a right side view of the magnetic latch mechanism of the present invention showing the rotary magnets in the latched position.
Figure 89:
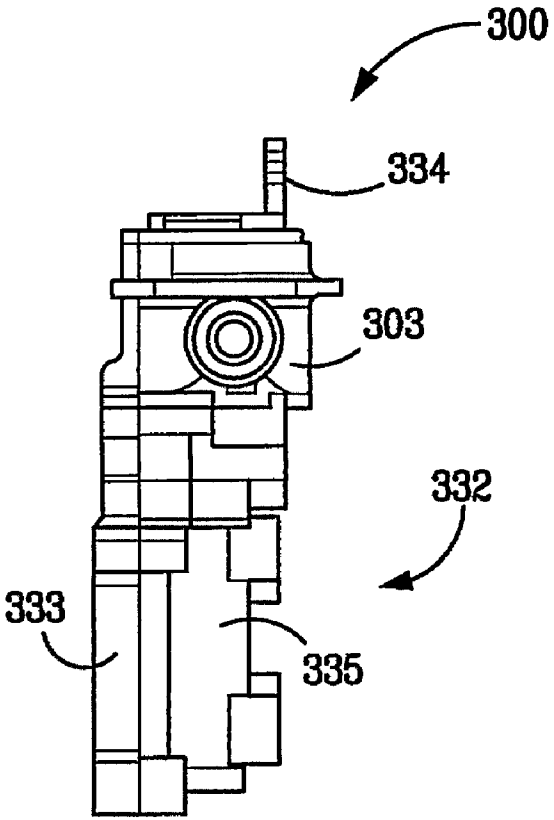
FIG. 89 is a rear view of the magnetic latch mechanism of the present invention showing the rotary magnets in the latched position.
Figure 90:
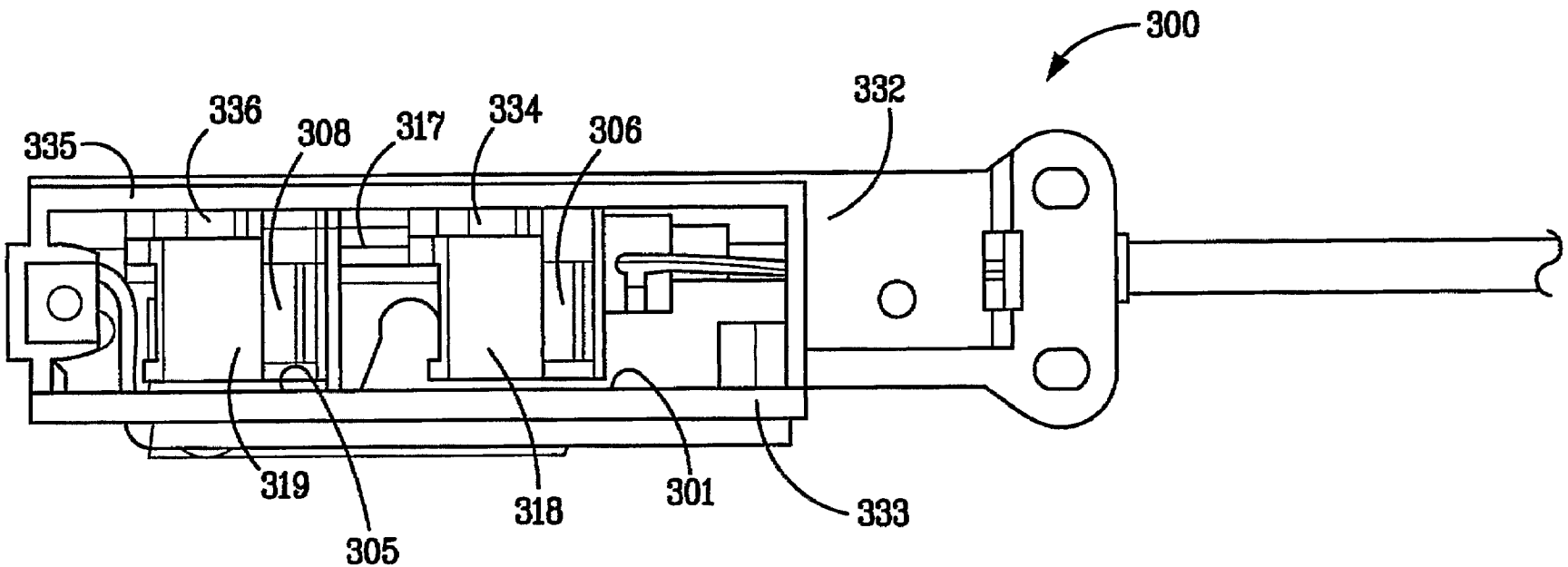
FIG. 90 is a top view of the magnetic latch mechanism of the present invention showing the rotary magnets in the latched position.
Figure 91:
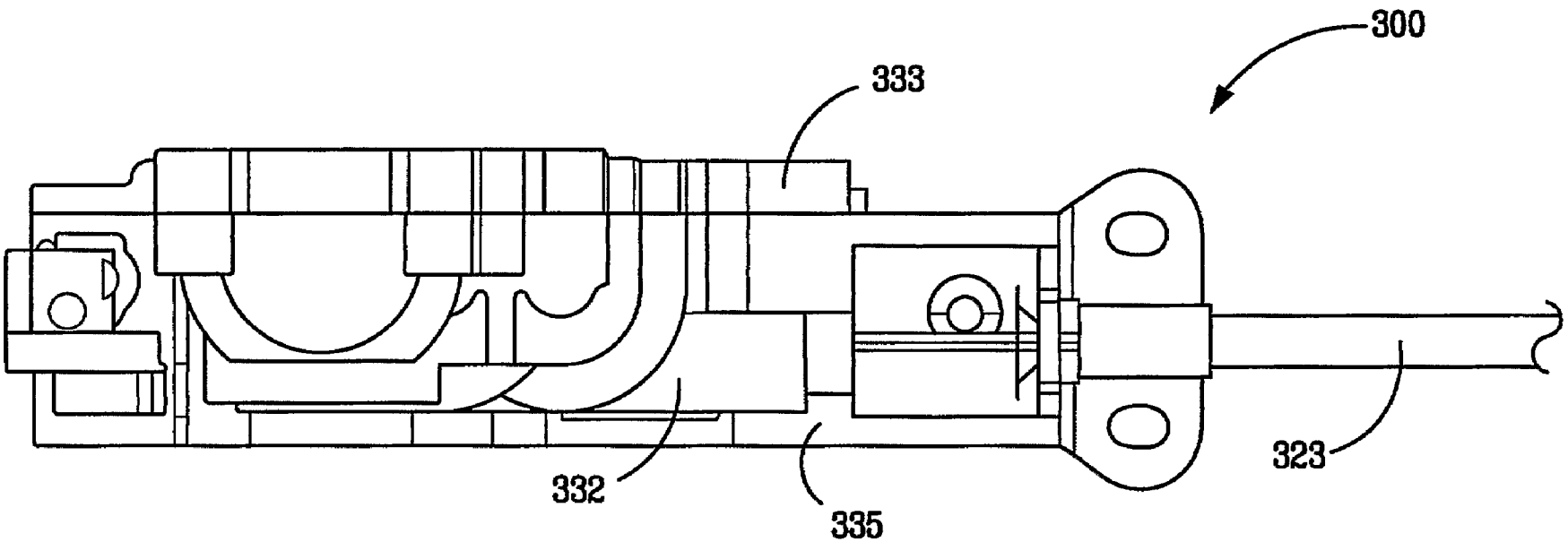
FIG. 91 is a bottom view of the magnetic latch mechanism of the present invention showing the rotary magnets in the latched position.
Figure 152:
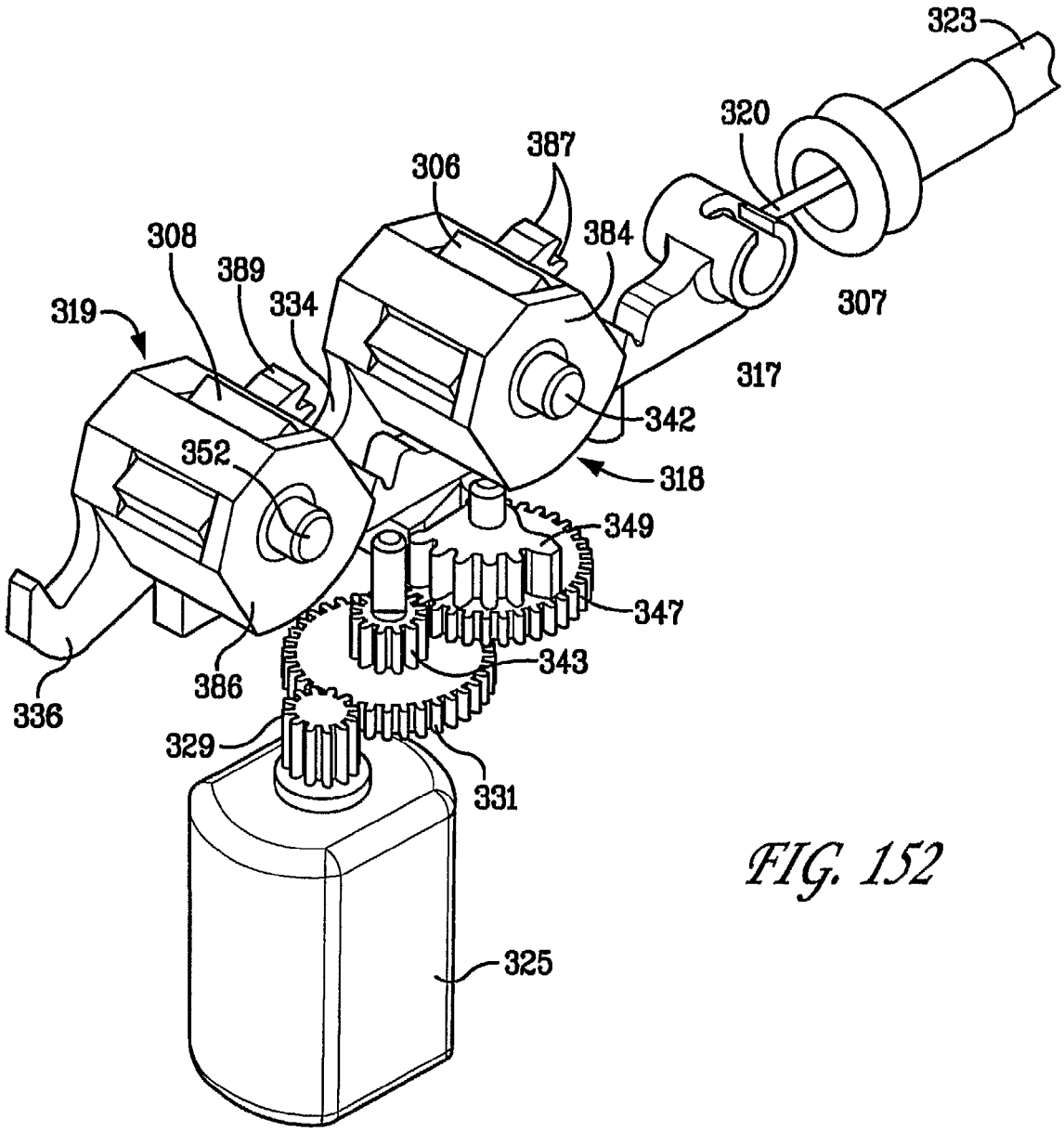
FIG. 152 is a fragmentary perspective view illustrating the operation of the magnetic latch mechanism of the present invention when the motor drive is used to actuate the magnetic latch mechanism and showing the rotary magnets and the hook-shaped pawls in the unlatched position and showing the sector gear in the final position.

Referring to FIGS. 84-152, an embodiment 300 of the magnetic latch mechanism with dual rotary magnets according to the present invention can be seen. The latch mechanism 300 is a remotely operated latch mechanism designed to secure two doors 302 and 304 in the closed position substantially simultaneously, using two rotating magnets 306 and 308. The latch mechanism 300 is designed to be installed between the pivots or hinges of the doors 302, 304 with the rotary magnets 306, 308 supported for rotation about parallel and spaced-apart axes of rotation. Also, the rotary magnets 306, 308 rotate in the same direction. Each of the rotary magnets 306 and 308 are supported by a separate magnet carrier 318, 319, respectively. Each magnet carrier 318, 319 is rotationally supported by the housing 332. Each of the rotary magnets 306, 308 are attached to the respective magnet carrier 318, 319 such that the rotary magnet and its respective magnet carrier rotate as one unit. Each of the rotary magnets 306, 308, and their respective magnet carriers 318, 319, are rotationally movable between respective latched and unlatched positions.

The magnetic latch mechanism 300 also includes a pair of hook-shaped pawls 334, 336. Each hook-shaped pawl 334, 336 is supported by a respective magnet carrier 318, 319 such that the hook-shaped pawl 334, 336 and the respective magnet carrier 318, 319 rotate as a unit. Each hook-shaped pawl 334, 336 has a hooked head 322 with a beveled cam surface 338 that faces away from the respective magnet carrier 318, 319 and a catch surface 344 that faces toward the respective magnet carrier 318, 319.

The magnetic latch mechanism 300 also includes magnetic inserts 314 and 316 that can be attached to the doors 302 and 304, respectively. Each of the magnetic inserts 314 and 316 corresponds to a respective one of the rotary magnets 306, 308. When the rotary magnets 306, 308 are in their latched positions and the doors 302 and 304 are in their closed positions, the pole of each of each of the rotary magnets 306, 308 facing the respective magnetic insert 314, 316 is of an opposite type (i.e. north, south) as compared to the pole of the magnetic insert 314, 316 facing its respective rotary magnet 306, 308. In the illustrated example, the magnetic inserts 314, 316 are positioned such that their south poles face their respective rotary magnet 306, 308 when the doors 302 and 304 are in their closed positions. Also in the illustrated example, the rotary magnets 306, 308 are positioned in their carriers 318, 319 such that their north poles face their respective magnetic inserts 314, 316 when the rotary magnets 306, 308 and their carriers are in their latched positions and the doors 302 and 304 are in their closed positions. Accordingly, an attractive force is exerted between each rotary magnet 306, 308 and its respective magnetic insert 314, 316 with the result that the doors 302, 304 to which the magnetic inserts 314, 316 are attached are held in the closed position.

Furthermore, the hook-shaped pawls 334, 336 engage respective strikers 324, 326 to mechanically block the movement of the doors 302, 304 from the closed position to the open position. This feature prevents the doors 302, 304 from being forcibly pried open from the exterior of the compartment being secured by the doors 302, 304.

The magnetic latch mechanism 300 includes the pair of strikers 324, 326 each of which corresponds to a respective one of the pair of hook-shaped pawls 334, 336. Each striker 324, 326 is supported by a respective door 302, 304 such that the striker is spaced apart from the respective door's interior surface and the head 322 of the hook-shaped pawl 334, 336 can fit between the respective striker 324, 326 and the respective door 302, 304. Each striker 324, 326 has a cam surface 328 that faces away from the respective door 302, 304 and a catch surface 330 that faces toward the respective door 302, 304. The cam surface 328 of each striker can interact with the cam surface 338 of the respective hook-shaped pawl 334, 336 to move the pawl out of the way of the striker 324, 326 and allow the respective door to move to the closed position if the respective hook-shaped pawl happens to be in the latched position when the respective door is being moved to the closed position. Once the door 302, 304 is in the closed position, the magnetic attraction between the respective rotary magnet 306, 308 and the respective magnetic insert 314, 316 moves the respective hook-shaped pawl 334, 336 to the latched position. In the latched position, the head 322 of the respective hook-shaped pawl 334, 336 is positioned between the respective striker 324, 326 and the respective door 302, 304, where the catch surface 344 of the respective hook-shaped pawl 334, 336 can engage the catch surface 330 of the respective striker 324, 326 to thereby mechanically block the movement of the respective door 302, 304 from the closed position to the open position.

Figure 92:
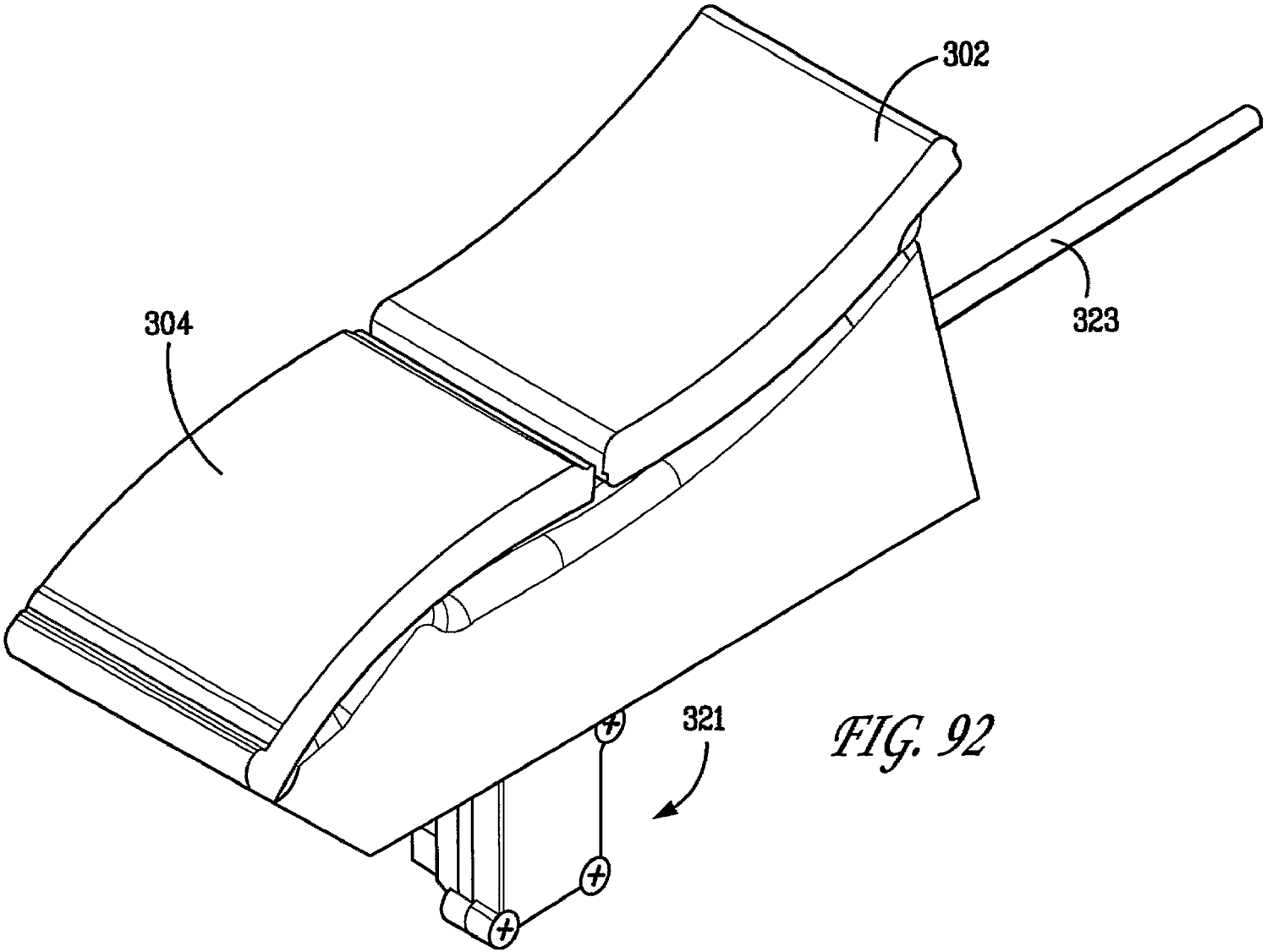
FIG. 92 is a fragmentary environmental view showing a compartment with dual doors incorporating the magnetic latch mechanism of the present invention and with the doors in the closed position.
Figure 93:
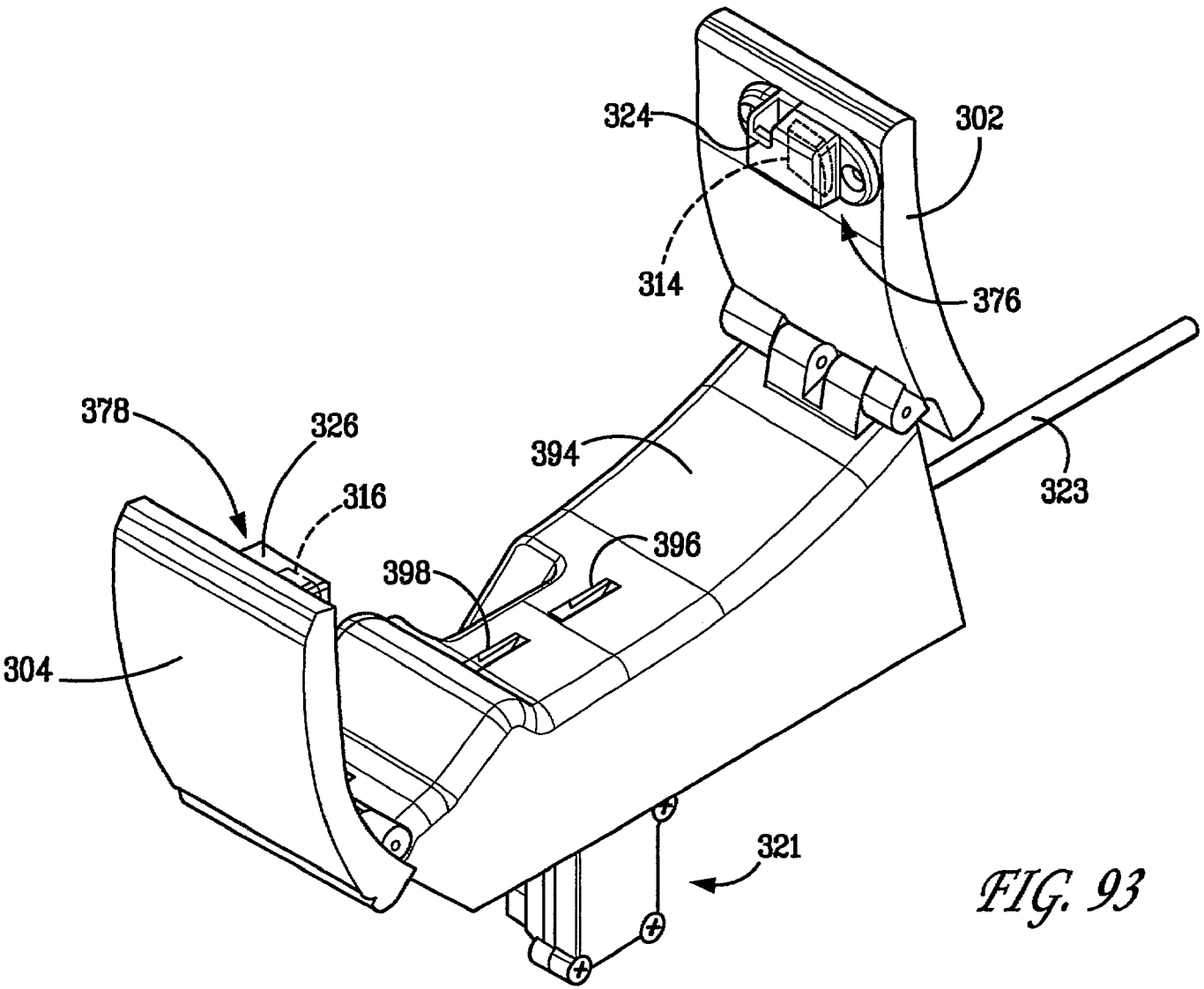
FIG. 93 is a fragmentary environmental view showing a compartment with dual doors incorporating the magnetic latch mechanism of the present invention and with the doors in the open position.
Figure 94:
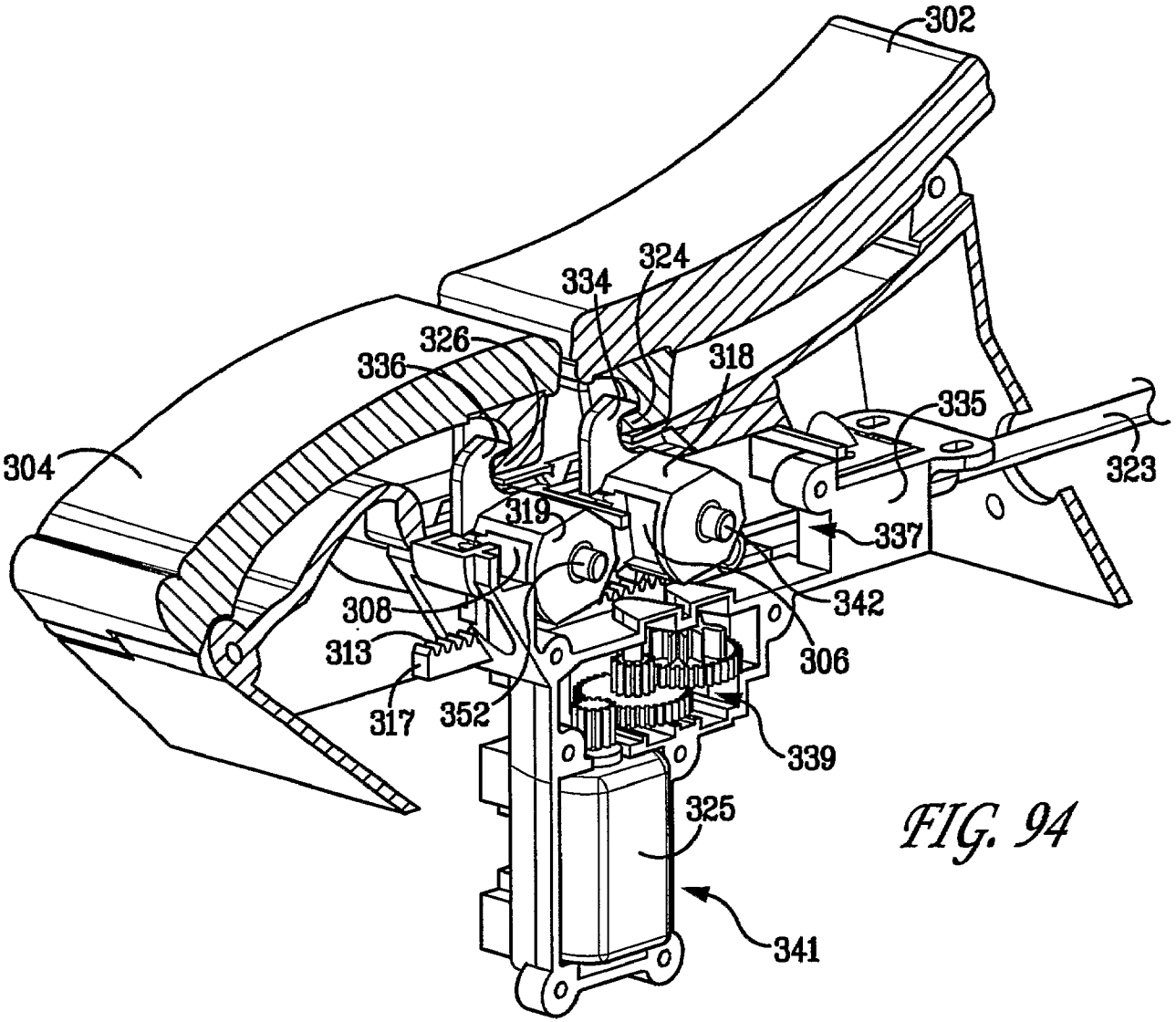
FIG. 94 is a cross sectional view showing a compartment with dual doors incorporating the magnetic latch mechanism of the present invention and with the doors in the closed position.
Figure 95:
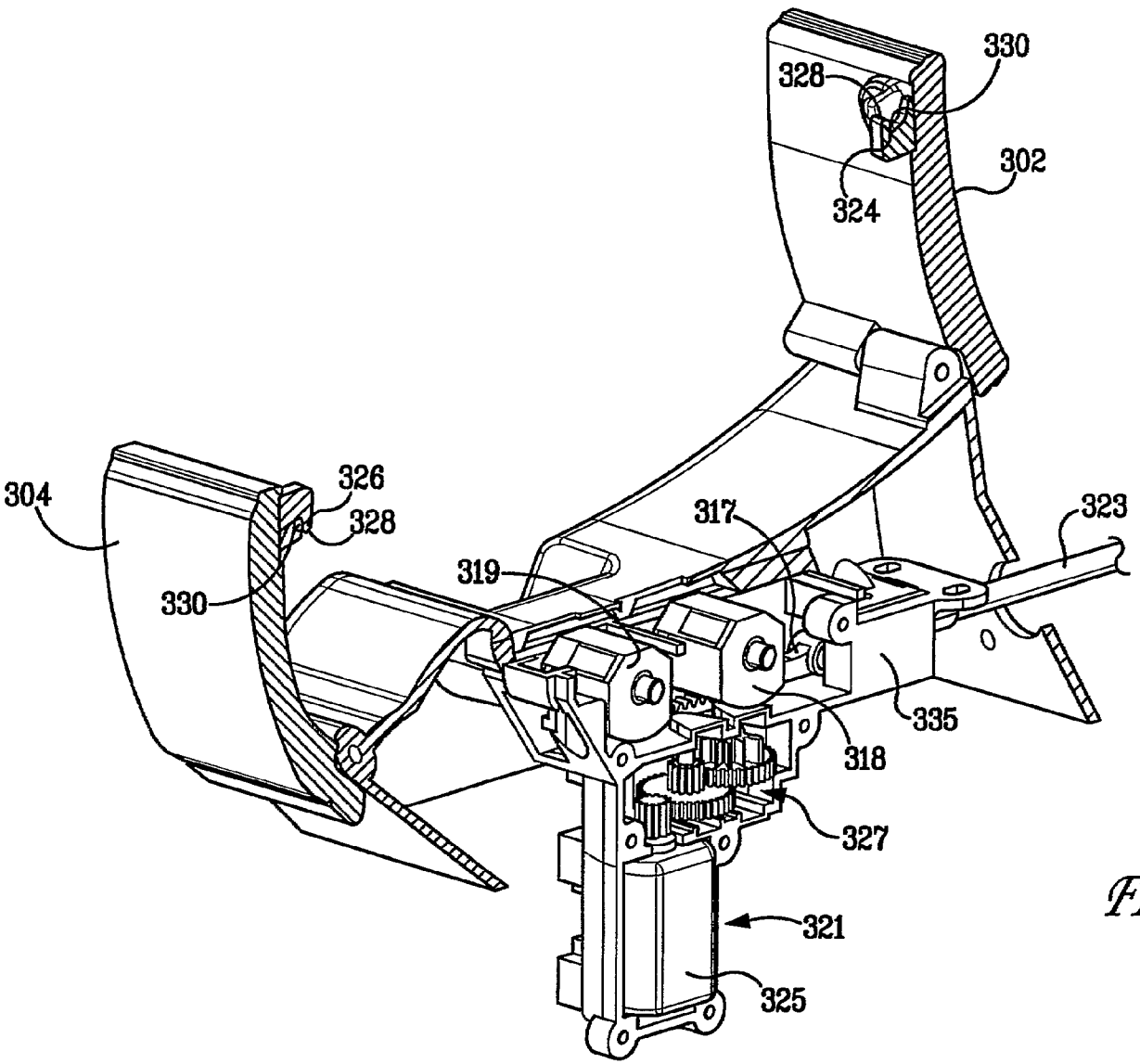
FIG. 95 is a cross sectional view showing a compartment with dual doors incorporating the magnetic latch mechanism of the present invention and with the doors in the open position.
Figure 96:
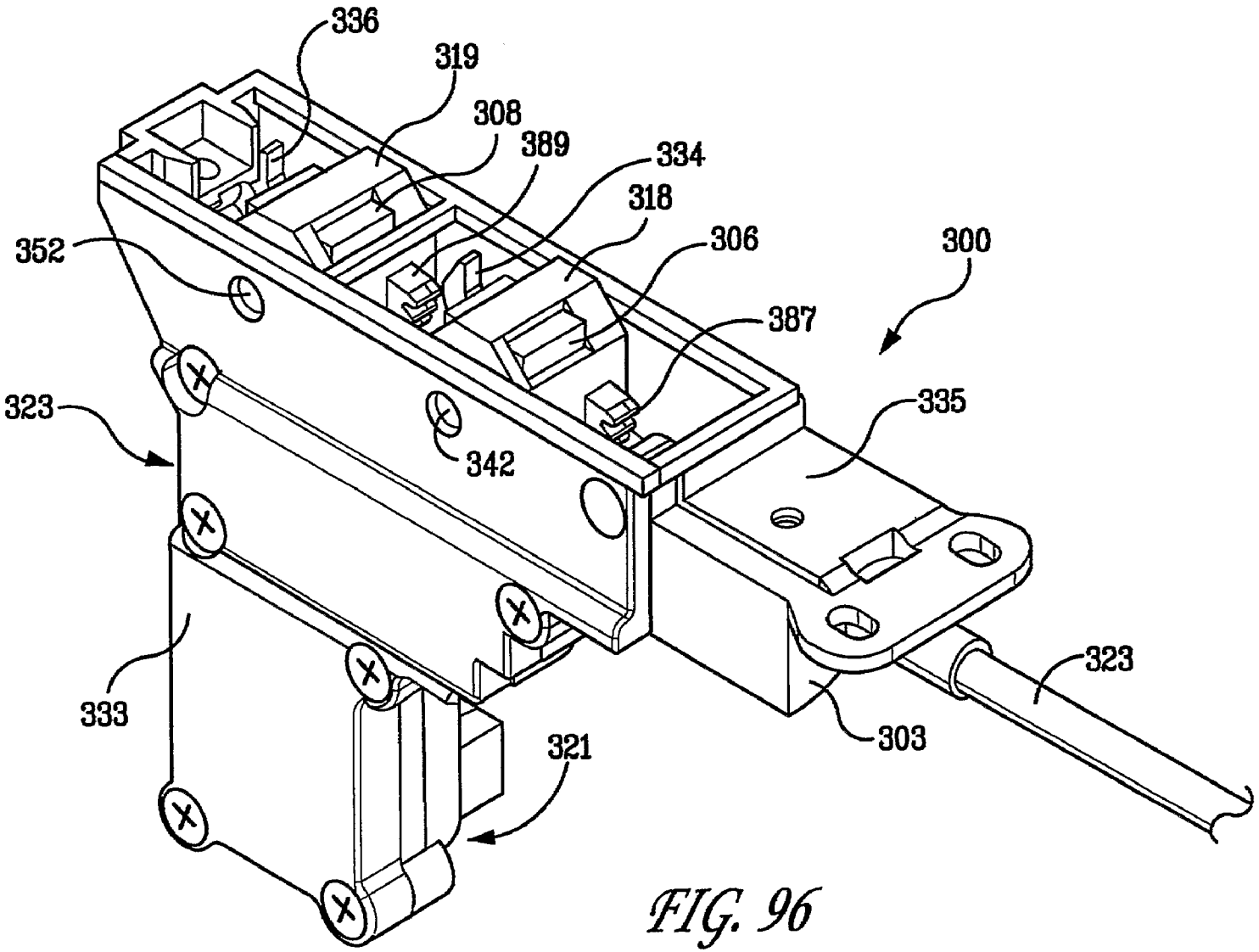
FIG. 96 is a perspective view of the magnetic latch mechanism of the present invention showing the rotary magnets in the unlatched position.
Figure 97:
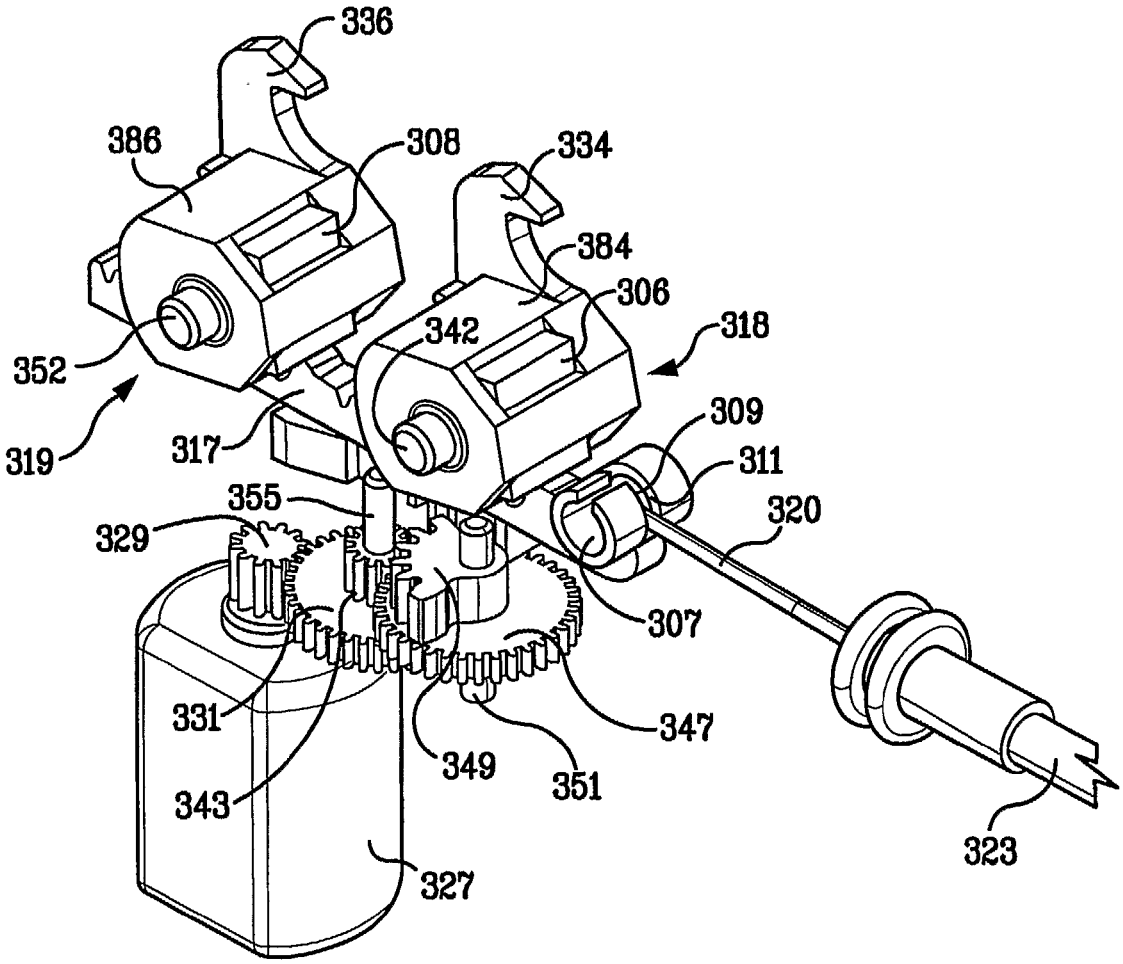
FIG. 97 is a fragmentary view illustrating the operation of the magnetic latch mechanism of the present invention when the Bowden cable is used to actuate the magnetic latch mechanism and showing the rotary magnets and the hook-shaped pawls in the latched position.
Figure 98:
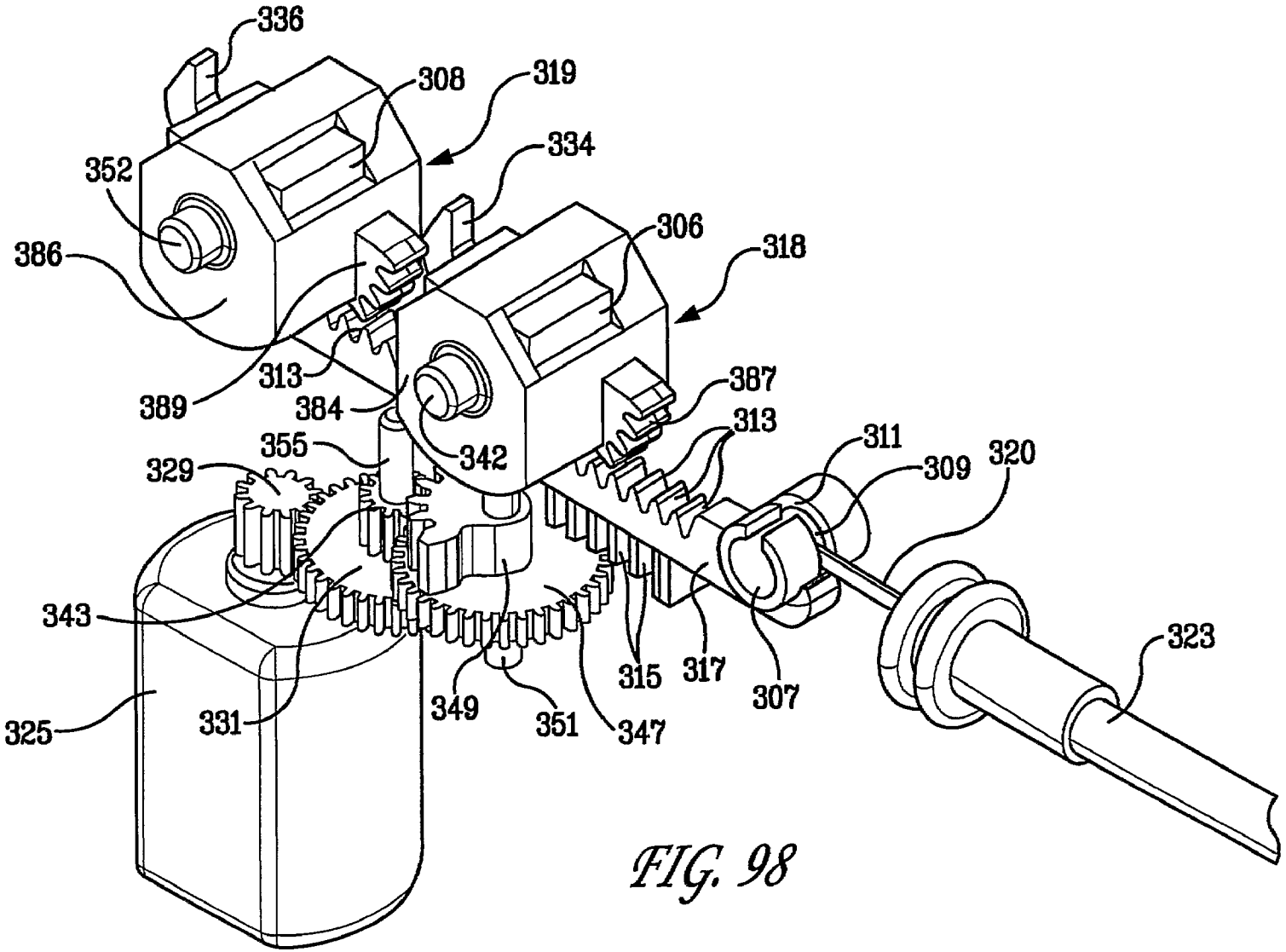
FIG. 98 is a fragmentary view illustrating the operation of the magnetic latch mechanism of the present invention when the Bowden cable is used to actuate the magnetic latch mechanism and showing the rotary magnets and the hook-shaped pawls in the unlatched position.
Figure 99:
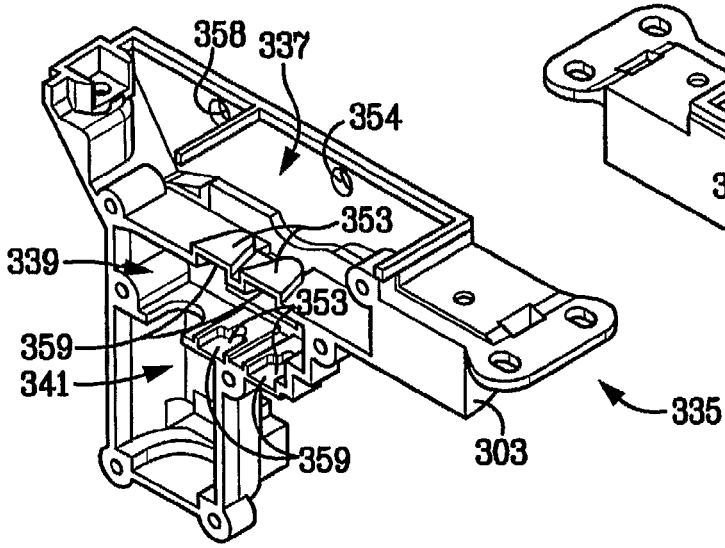
FIGS. 99-106 are views of the casing portion of the housing of the magnetic latch mechanism of the present invention.
Figure 100:
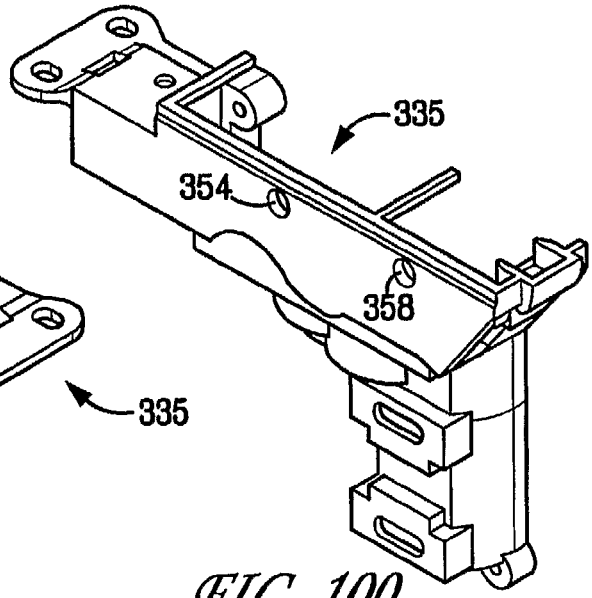
Figure 101:
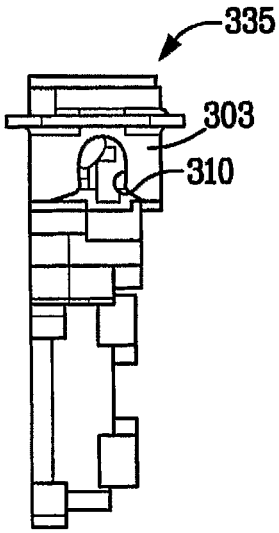
Figure 102:
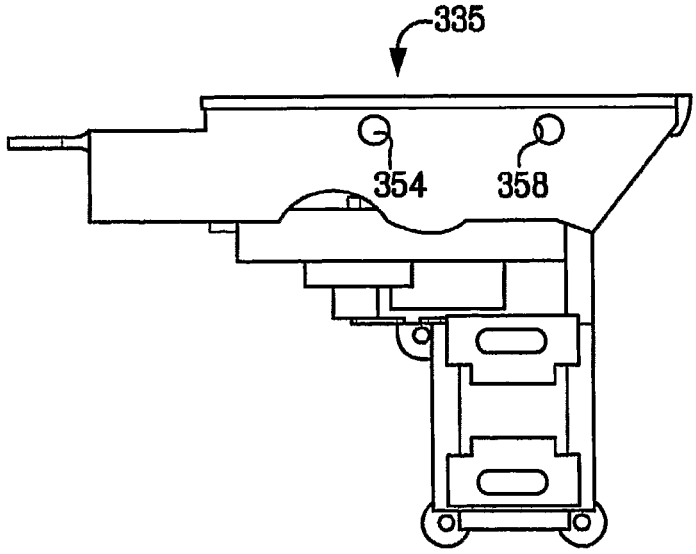
Figure 103:
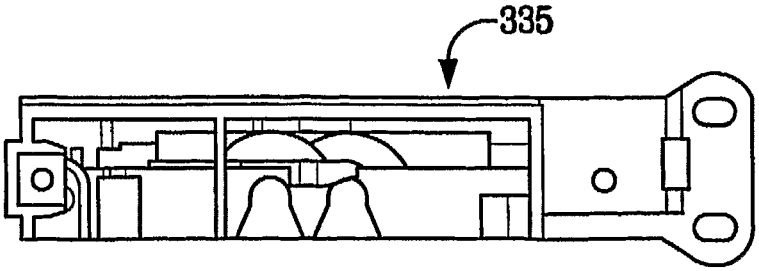
Figure 104:
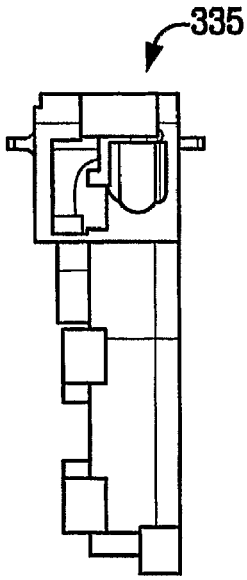
Figure 105:
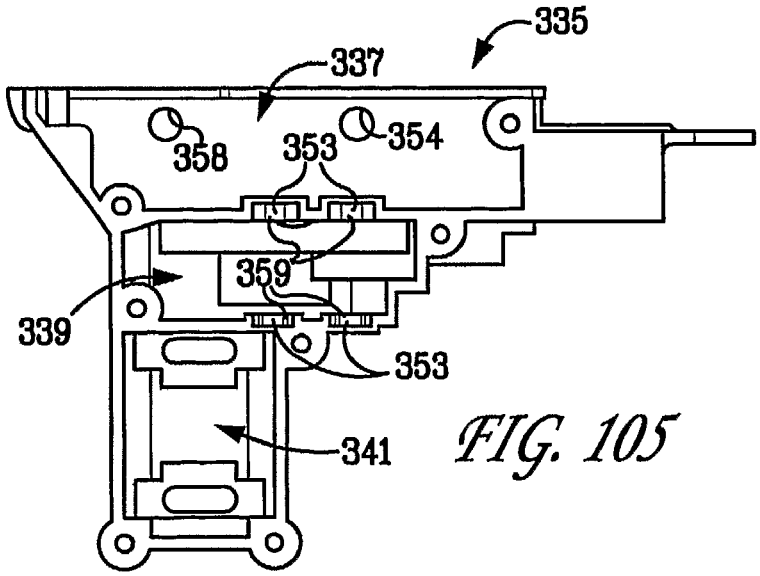
Figure 106:
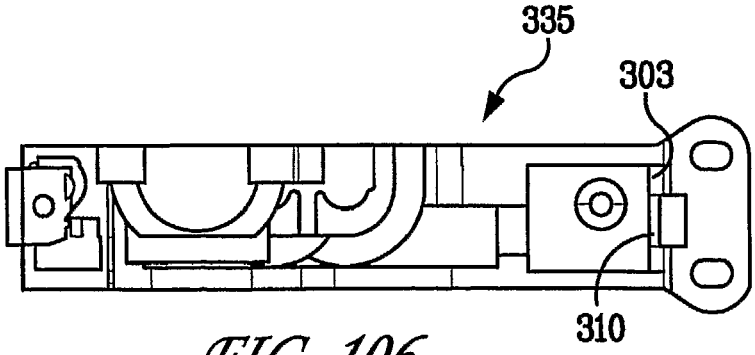
Figure 108:
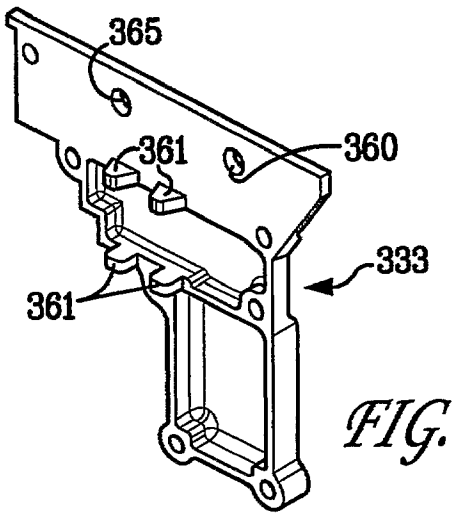
FIGS. 107-114 are views showing the cover portion of the housing of the magnetic latch mechanism of the present invention.
Figure 109:
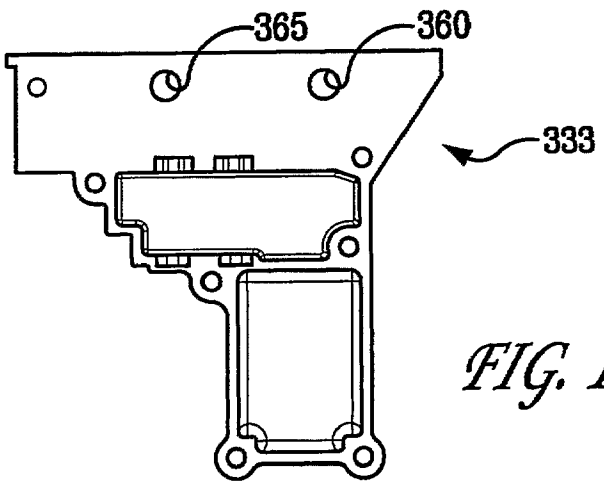
Figure 107:
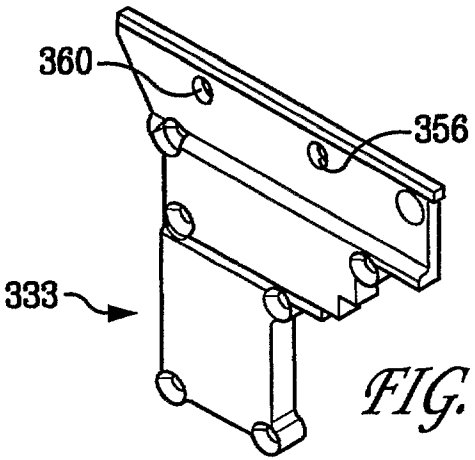
Figure 110:
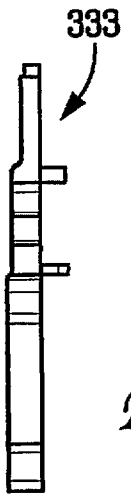
Figure 111:
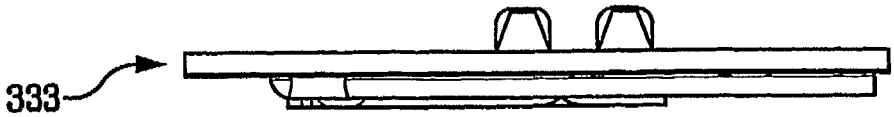
Figure 113:
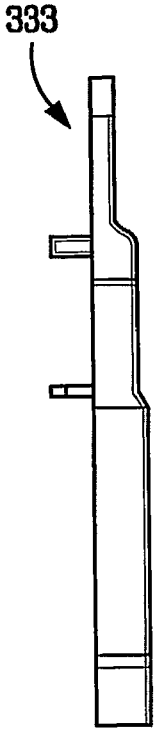
Figure 112:
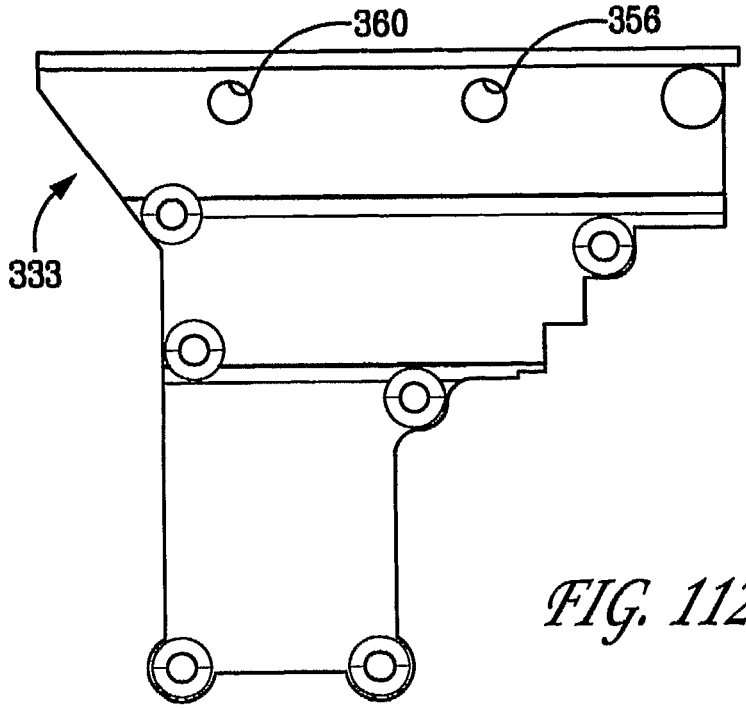
Figure 114:
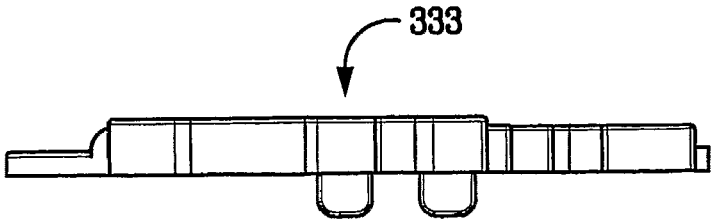
Figure 116:
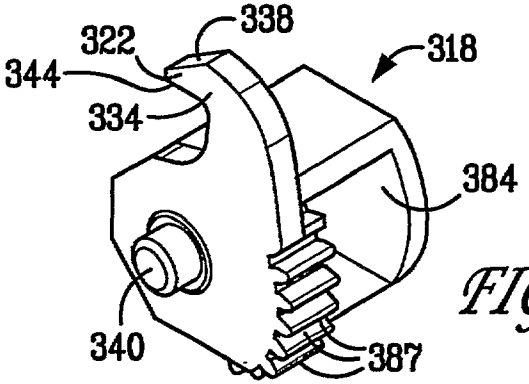
FIGS. 115-122 are views showing the magnet carrier and the associated hook-shaped pawl of the magnetic latch mechanism of the present invention.
Figure 118:
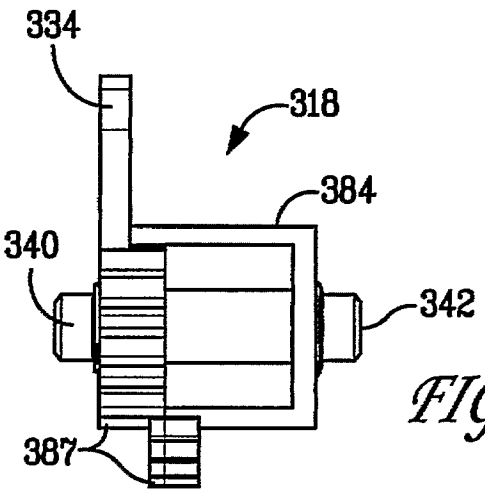
Figure 115:
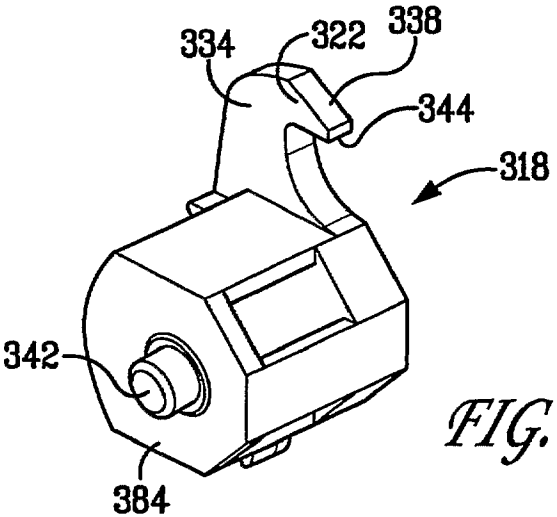
Figure 117:
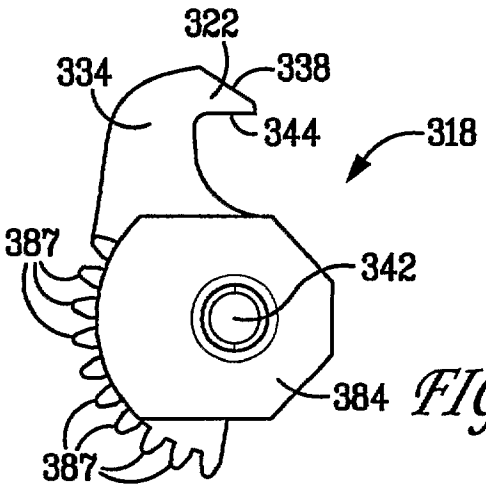

When the rotary magnets 306, 308 are in their unlatched positions (illustrated in FIGS. 95, 96, 98, 151 and 152) and the doors 302 and 304 are in their closed positions (illustrated in FIGS. 92 and 94), the pole of each of each of the rotary magnets 306, 308 that is of an opposite type compared to the pole of the respective magnetic insert 314, 316 facing the rotary magnet 306, 308, is positioned farther from the respective magnetic insert 314, 316, while the pole of each of each of the rotary magnets 306, 308 that is of the same type compared to the pole of the respective magnetic insert 314, 316 facing the rotary magnet 306, 308, is positioned closer to the respective magnetic insert 314, 316, relative to the latched position of the rotary magnets 306, 308. In the unlatched position, the repulsive force between the like poles of each rotary magnet 306, 308 and the respective magnetic insert 314, 316 overcomes the attractive force between the opposite poles of each rotary magnet 306, 308 and the respective magnetic insert 314, 316. Accordingly, a net repulsive force is exerted between each rotary magnet 306, 308 and its respective magnetic insert 314, 316. In addition, the hook-shaped pawls 334, 336 rotate to their unlatched positions along with the rotary magnets 306, 308 and their magnet carriers 318, 319, which removes the mechanical impediment to the opening of the doors 302, 304, with the result that the doors 302, 304 to which the magnetic inserts 314, 316 are attached are moved from the closed position toward the open position.

Recall that in the illustrated example, the magnetic inserts 314, 316 are positioned such that their south poles face their respective rotary magnet 306, 308 when the doors 302 and 304 are in their closed positions. In the illustrated example, the north poles of the rotary magnets 306, 308 move away from the south poles of their respective magnetic inserts 314, 316 and the south poles of the rotary magnets 306, 308 move toward the south poles of their respective magnetic inserts 314, 316 as the rotary magnets 306, 308 and their carriers 318, 319 move from the latched position to the unlatched position, such that a net repulsive force is exerted between each rotary magnet 306, 308 and its respective magnetic insert 314, 316 when the rotary magnets 306, 308 reach their unlatched positions.

The rotary magnets 306, 308 and their carriers 318, 319 move through an angle in the range of greater than 10° and less than or equal to 180° as they move from the latched position to the unlatched position. More preferably, the rotary magnets 306, 308 and their carriers 318, 319 move through an angle in the range of greater than or equal to 30° and less than or equal to 180° as they move from the latched position to the unlatched position. Even more preferably, the rotary magnets 306, 308 and their carriers 318, 319 move through an angle in the range of greater than or equal to 45° to and less than or equal to 145° as they move from the latched position to the unlatched position. Yet even more preferably, the rotary magnets 306, 308 and their carriers 318, 319 move through an angle in the range of greater than or equal to 60° and less than or equal to 120° as they move from the latched position to the unlatched position.

The opposite type pole of the respective rotary magnet 306, 308 need not directly face the pole of the magnetic insert 314, 316 facing its respective rotary magnet 306, 308 in the latched position. The rotary magnets 306, 308 may deviate from the preferred direct facing relationship between the opposite type poles of the rotary magnets and of their respective magnetic inserts by an angle θ in the range of $0° \leqq \theta < 90°$. The position of the hook-shaped pawls relative to the rotary magnets 306, 308 would of course have to be adjusted accordingly. Of course, the direct facing relationship between the opposite type poles of the rotary magnets and of their respective magnetic inserts (i.e. at or about 0°) is preferred for the latched position because that position gives the greatest holding power to the latch mechanism.

Each magnetic insert 314, 316 is attached to a respective one of the doors 302, 304 by being inserted in a magnetic insert housing 376, 378, respectively, which in turn are attached to a respective one of the doors 302, 304. In the illustrated example, the magnetic insert housings 376, 378 are attached to the doors 302, 304 by screws 380.

The means for attaching the magnetic insert housings 376, 378 to the doors 302, 304 is not critical to the present invention and any suitable fastening means including screws, rivets, pins, nails and adhesives may be used. Furthermore, the magnetic insert housings 376, 378 may be of unitary construction with the doors 302, 304. The magnetic insert housings 376, 378 may also be dispensed with entirely and the magnetic inserts 314, 316 may be attached to the doors 302, 304 directly. As with the housings 376, 378, any suitable fastening means including screws, rivets, pins, nails and adhesives may be used to attach the magnetic inserts 314, 316 to the doors 302, 304. As yet another alternative, the magnetic inserts 314, 316 may be embedded in the material of the doors 302, 304.

In the illustrated embodiment, the strikers 324, 326 are of unitary construction with the magnetic insert housings 376, 378, respectively. As with the housings 376, 378, the means for attaching the strikers 324, 326 to the doors 302, 304 are not critical to the present invention. Any suitable structure that supports the striker 324, 326 such that the striker is spaced apart a sufficient amount from the respective door's interior surface in order for the head 322 of the hook-shaped pawl 334, 336 to fit between the respective striker 324, 326 and the respective door 302, 304 may be employed and any suitable fastening means including screws, rivets, pins, nails and adhesives may be used to attach the structure to the respective door. Furthermore, the strikers 324, 326 may be of unitary construction with the doors 302, 304.

The magnetic latch mechanism 300 includes a housing 332 that rotationally supports the magnet carriers 318, 319 having the rotary magnets 306, 308, respectively, attached thereto. The top openings 301 and 305 of the housing 332 allow the hook-shaped pawls 334, 336 to extend out of the housing 332 to engage the strikers 324, 326 in the latched position.

Each magnet carrier 318, 319 includes a receptacle 384, 386 for receiving the respective rotary magnet 306, 308. Each magnet carrier 318, 319 has a pair of spindles, 340, 342 and 350, 352, respectively, with each pair of spindles projecting outward on opposite sides of the respective receptacle 384, 386. The receptacles 384, 386, and consequently carriers 318, 319, are positioned in tandem along the longitudinal axis of the housing 332 with their axes of rotation being transverse, i.e. perpendicular, to the longitudinal axis of the housing 332. The spindles 340, 342, 350, 352 are received in and rotationally supported by the holes 354, 356, 358, 360 in the sides of the housing 332, respectively. The housing 332 has a cover portion 333 that forms one side of the housing 332, and a casing portion 335 that in cooperation with the cover portion 333 defines the space into which the various components of the magnetic latch mechanism 300 are received in substantial part. The casing portion 335 and the cover portion 333, and consequently the housing 332, are divided into a rotary magnet compartment 337, a gear compartment 339, and a motor compartment 341. The spindles 340 and 350 are inserted into the holes 354 and 358, respectively, during assembly when the cover portion 333 is removed. The spindles 342 and 352 are received into the holes 356 and 360 when the cover portion 333 is secured to the casing portion 335. Thus the magnet carriers 318, 319 are rotationally supported by the housing 332. The particular modality used for rotationally supporting the magnet carriers 318, 319 in the housing 332 is not critical to the present invention. The illustrated modality for rotationally supporting the carriers 318, 319 in the housing 332 was selected for ease of assembly. Alternatively, the carriers 318, 319 could be supported for rotation by the housing 332 through the use of axles, shafts, or pins, or with other types of bearing arrangements used in place of the holes 354, 356, 358, 360. As yet another alternative, the carriers 318, 319 can be snap-fitted into the housing 332, with the spindles 340, 342, 350, 352 snapping into appropriate bearing structures that rotationally support the spindles.

Each hook-shaped pawl 334, 336 is integrally formed with its respective magnet carrier 318, 319. Thus, there is no relative rotation between each receptacle 384, 386 and the respective hook-shaped pawl 334, 336 and each hook-shaped pawl 334, 336 and the respective receptacle 384, 386, and consequently the respective magnet carrier 318, 319, rotate as a unit.

Alternatively, the hook-shaped pawls 334, 336 may be made separately from the magnet carriers 318, 319, and attached to the magnetic carriers in a way that provides for each hook-shaped pawl to rotate with its respective magnet carrier as a unit. As yet another alternative, some range of relative motion between each carrier 318, 319 and the respective hook-shaped pawl 334, 336 may be provided for in the case where the hook-shaped pawls and the magnet carriers are made as separate pieces. In such a case each hook-shaped pawl 334, 336 would need to be spring biased toward their current position illustrated in the drawings relative to the respective carrier 318, 319. This relative motion would allow each hook-shaped pawl 334, 336 to move out of the way of the respective striker 324, 326, and allow the respective door to move to the closed position if the respective hook-shaped pawl happens to be in the latched position when the respective door is being moved to the closed position, without necessarily moving the respective rotary magnet 306, 308.

Each magnet carrier 318, 319 also has a plurality of gear teeth 387 and 389, respectively. Each set of gear teeth 387, 389 is distributed along an arc defined by a sector of a circle centered at the axis of rotation of the respective magnet carrier 318, 319. The axis of rotation of each magnet carrier 318, 319 is of course defined by the central axis of the respective pair of spindles 340, 342 or 350, 352 of each magnet carrier 318, 319. The gear teeth 387, 389 of each magnet carrier 318, 319 are supported by, and are integral with, the respective receptacle 384, 386 of each magnet carrier. Some of the gear teeth 387, 389 in at least one of the magnet carriers 318, 319 may be shifted to one side relative to the rest of the gear teeth to provide clearance for the hook-shaped pawl 334, 336 of the other magnet carrier 318, 319 when the magnet carriers 318, 319 are both in their unlatched positions. The gear teeth 313 of the rack bar 317 are wide enough to properly engage both the shifted and un-shifted gear teeth 387, 389 when required.

The latch mechanism 300 includes a rack bar 317 that has two sets of gear teeth 313 and 315 distributed along its length. Each set of gear teeth 313, 315 includes a plurality of gear teeth. The gear teeth 313 and 315 are oriented at right angles relative to one another. The gear teeth 313 are in constant mesh with the gear teeth 387, 389 such that the magnet carriers 318, 319 are linked by the rack bar 317. The rack bar 317 is supported for rectilinear motion back and forth in the direction of its longitudinal axis between a latched position, illustrated in FIGS. 85, 86, 88, 94, 97, 149, and 150, and an unlatched position, illustrated in FIGS. 95, 98, 151, and 152. The rack bar 317 causes the magnet carriers 318, 319 to move in unison such that they and the rotary magnets 306, 308 can be moved from the latched position to the unlatched position by a common actuation mechanism in order to provide for the simultaneous opening of the dual doors 302, 304. The rack bar 317 has a receptacle 307 adapted for receiving the cylindrical dowel 309 at the end of a Bowden cable 320 for actuating the latch mechanism 300. The receptacle 307 is in the form of a cylindrical barrel or sleeve that is open at least at one end. An L-shaped slot 311 cuts through the wall of the barrel-shaped receptacle 307. The L-shaped slot 311 extends along the length of the receptacle 307 from the open end of the receptacle 307 to about the middle of the receptacle 307. From that position the L-shaped slot 311 extends along an arc perpendicular to the longitudinal direction of the barrel of the receptacle 307, thus forming an 'L' shape. The slot 311 is wide enough to allow the Bowden cable 320 to extend through the slot 311. The dowel 309 may also be spherical or have any other shape and size such that it will not fit through the slot 311 but that it will fit into the receptacle 307.

The housing 332 has a bracket 303 with a U-shaped slot 310 that can support one end of the sheath 323 of the Bowden cable 320. The Bowden cable 320 allows the remote operation of the latch mechanism 300. With the one end of the sheath 323 of the Bowden cable 320 installed in the U-shaped slot 310 of the bracket 303 and with the dowel 309 positioned in the receptacle 307, pulling the remote end (not illustrated)

of the Bowden cable 320 will cause the rectilinear movement of the rack bar 317 from the latched position to the unlatched position and consequently the rotation of the rotary magnets 306, 308, magnet carriers 318, 319, and hook-shaped pawls 334, 336 from their latched positions, assuming them to initially be in the latched position, to their unlatched positions.

The remote end of the Bowden cable 320 can be pulled manually or by using an electrical actuator. Generally some type of remotely located handle or push button would be provided as a user interface for the manual or electrical operation of the latch mechanism 300, respectively.

The latch mechanism 300 is mounted to the frame or compartment 394 by mounting the housing 332 to the frame or compartment 394. The rotary magnets 306 and 308 need not be exposed or visible when viewed from the position of the magnetic inserts 314, 316. However, slots 396 and 398 or the like must be provided in the doorframe 394 allow the hook-shaped pawls 334, 336 to extend through the doorframe 394 to engage the strikers 324, 326 as they rotate to their latched positions. The means for attaching the housing 332 to the doorframe 394 is not critical to the present invention and any suitable fastening means including screws, rivets, pins, nails and adhesives may be used. Furthermore, the housing 332 may be of unitary construction with the doorframe 394.

The magnets 306, 308 pull the doors 302, 304 in to ensure they both latch correctly. The magnets 306, 308 control the final movement and position and the gap conditions of the doors 302, 304 in the closed position. The magnets 306, 308 also aid the opening of the doors 302, 304 when the mechanism is unlatched.

To open the latch mechanism 300 the button (not shown), for example, is pushed. This would cause the remote end of the Bowden cable 320 to be pulled by one of the mechanisms previously mentioned. The pulling of the Bowden cable 320 causes the rotation of the rotary magnets 306, 308, magnet carriers 318, 319, and hook-shaped pawls 334, 336 from their latched positions to their unlatched positions. This action disengages the hook-shaped pawls 334, 336 from their respective strikers 324, 326, which mechanically releases the doors 302 and 304. In addition, the magnets 306, 308 are rotated to their unlatched positions where these magnets repel the magnetic inserts 314, 316 attached to the doors 302, 304, forcing the doors to swing open. Once the magnets 306, 308 are clear of the influence of the magnetic field of the magnetic inserts 314, 316 and the Bowden cable 320 is released, the magnetic attraction of the north pole of one of the magnets 306, 308 for the south pole of the other one of the magnets 306, 308, or vice versa, will maintain the rotary magnets 306, 308, the magnet carriers 318, 319, and the hook-shaped pawls 334, 336 near their unlatched positions. In the illustrated embodiment, the magnetic attraction of the north pole of the rotary magnet 306 for the south pole of the rotary magnet 308 maintains the rotary magnets 306, 308, the magnet carriers 318, 319, and the hook-shaped pawls 334, 336 in a position close enough to their unlatched positions such that the rotary magnets 306, 308 and the hook-shaped pawls 334, 336 stand ready to secure the doors 302, 304 in the closed position as the doors 302, 304 are moved toward the closed position.

Figure 120:
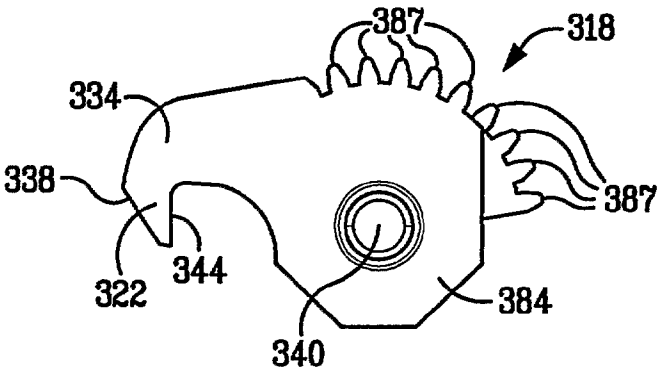
Figure 122:
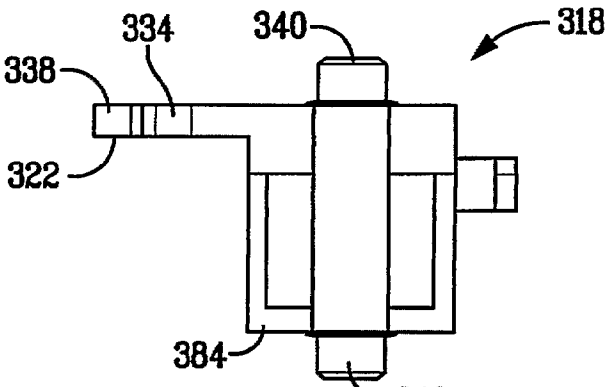
Figure 119:
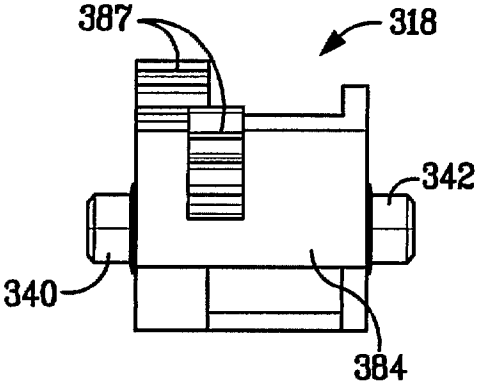
Figure 121:
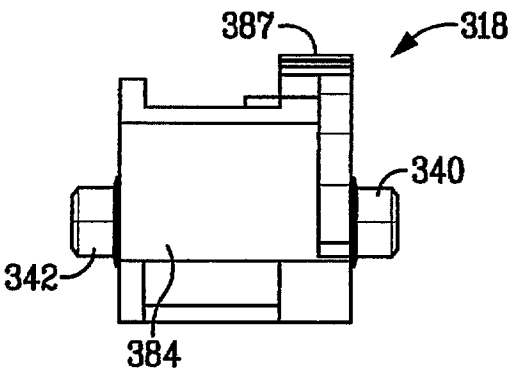
Figure 124:
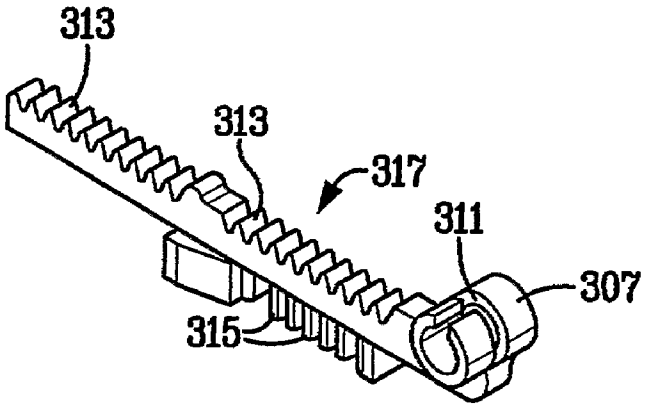
FIGS. 123-130 are views showing the rack bar of the magnetic latch mechanism of the present invention.
Figure 126:
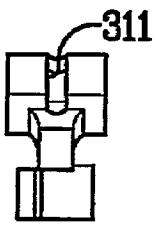
Figure 123:
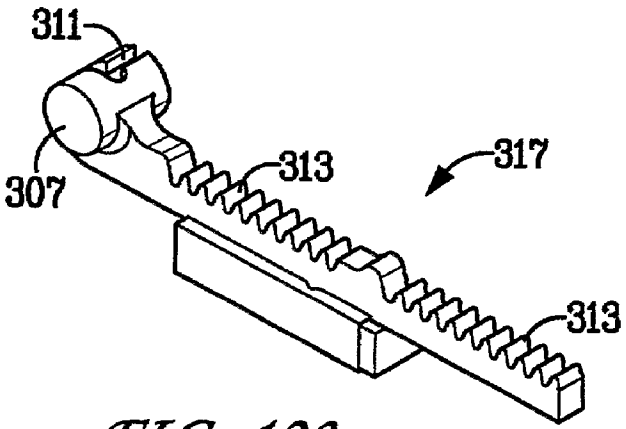
Figure 125:
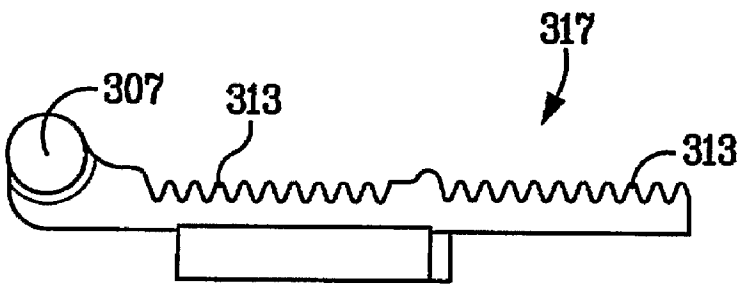
Figure 127:
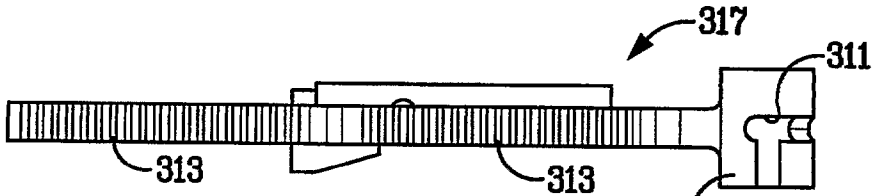
Figure 128:
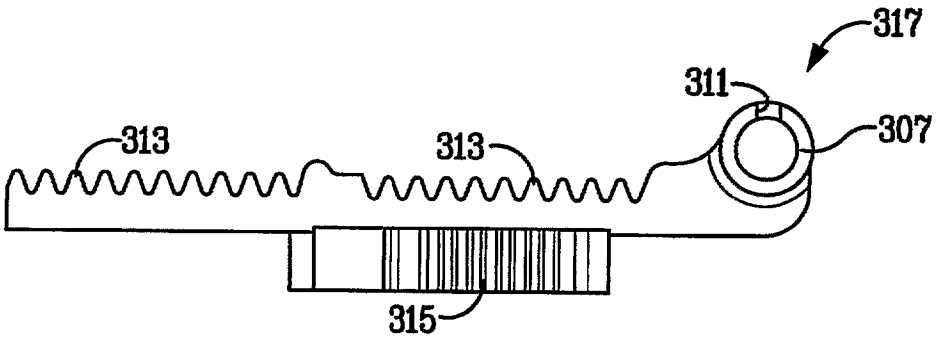
Figure 129:
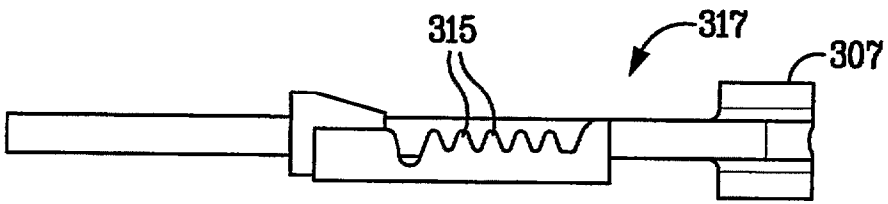
Figure 130:
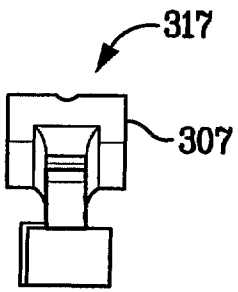
Figure 131:
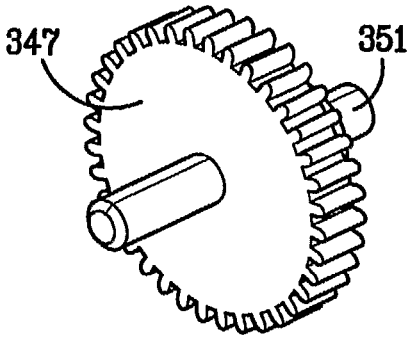
FIGS. 131-138 are views showing one of the large diameter gears and the coaxial sector gear of the magnetic latch mechanism of the present invention.
Figure 132:
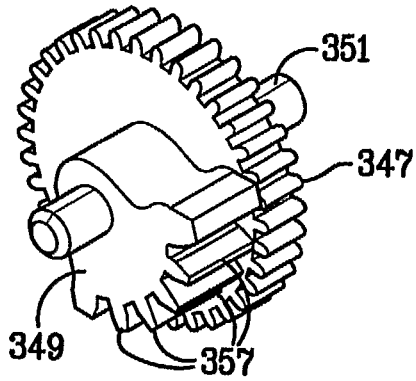
Figure 133:
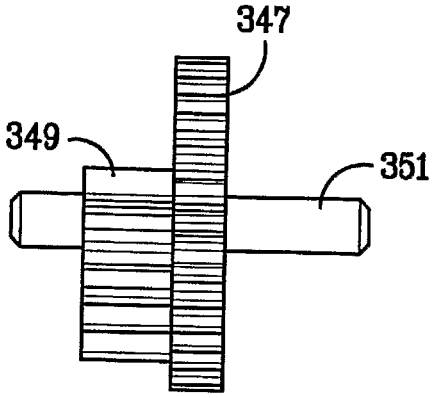
Figure 134:
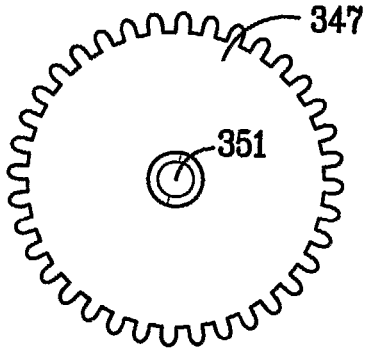
Figure 135:
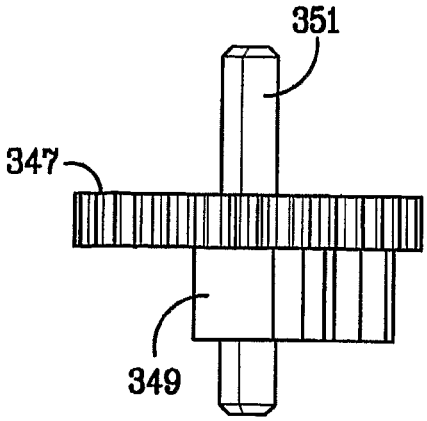
Figure 136:
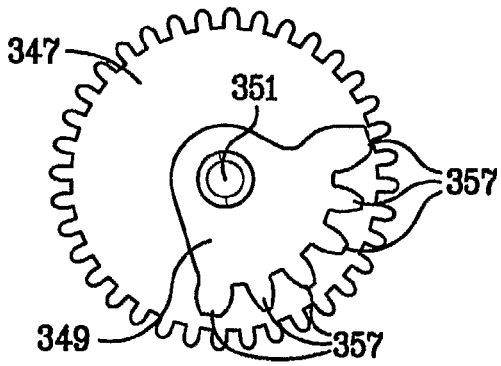
Figure 138:
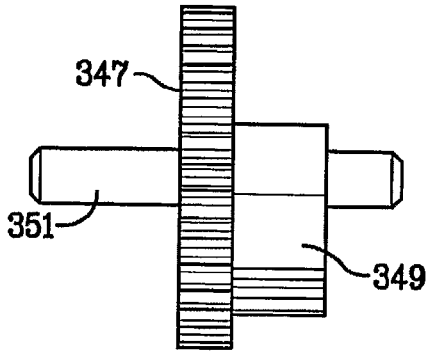
Figure 137:
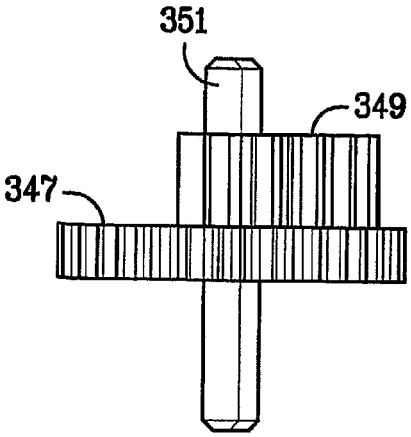
Figure 139:
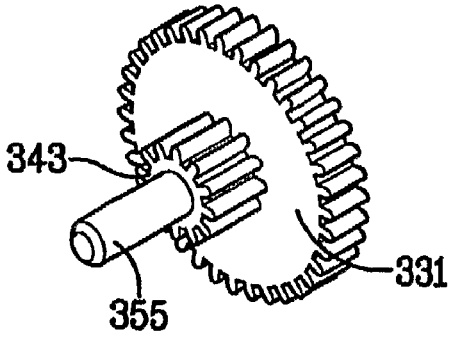
FIGS. 139-144 are views showing one of the large diameter gears and the coaxial small diameter gear of the magnetic latch mechanism of the present invention.
Figure 140:
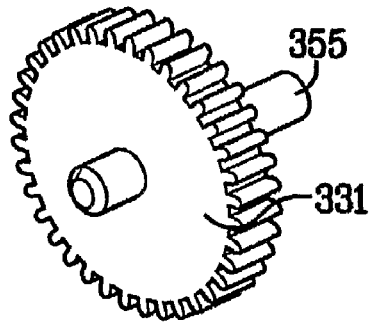
Figure 141:
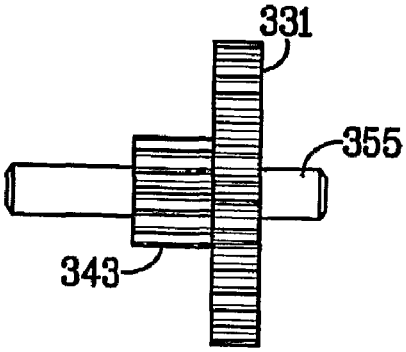
Figure 142:
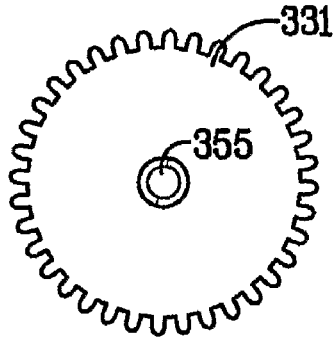
Figure 143:
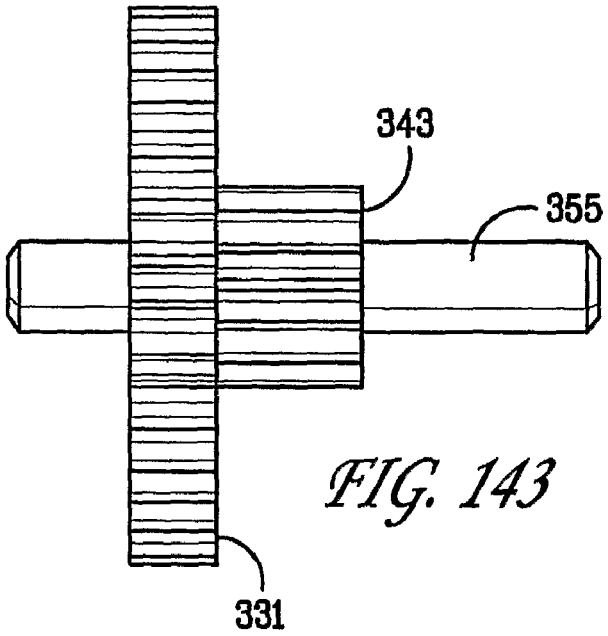
Figure 144:
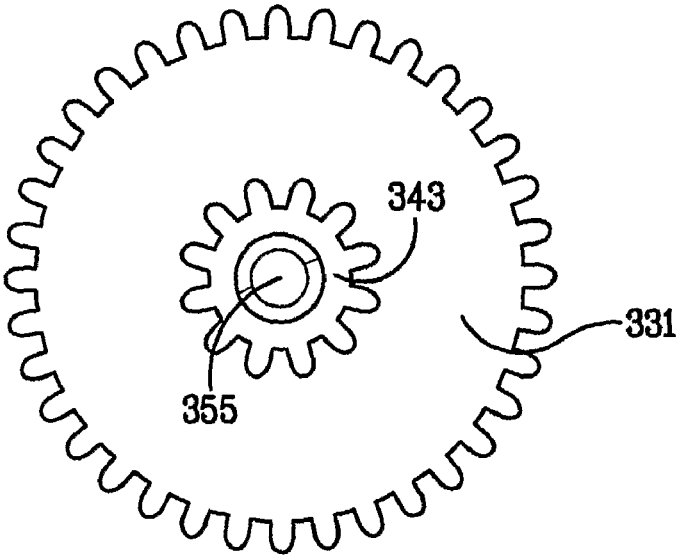
Figure 146:
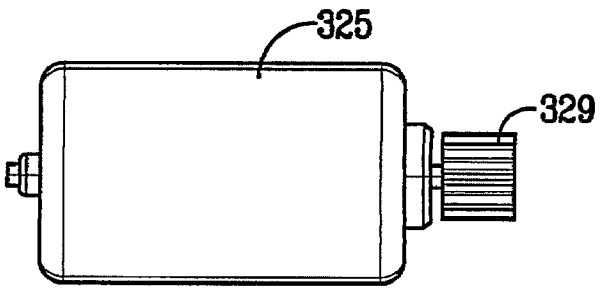
FIGS. 145-148 are views showing the motor and the small diameter gear attached to the output shaft of the motor of the magnetic latch mechanism of the present invention.
Figure 145:
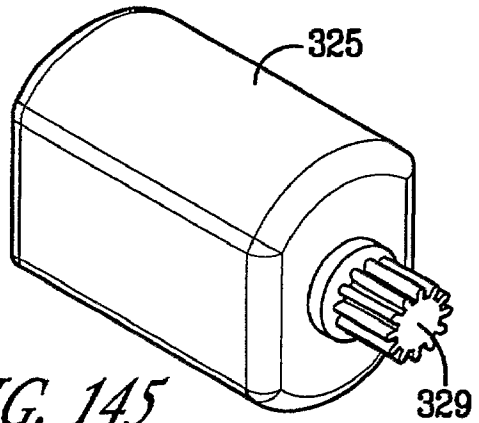
Figure 148:
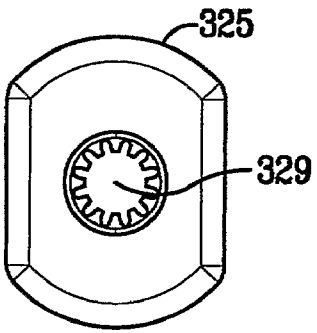
Figure 147:
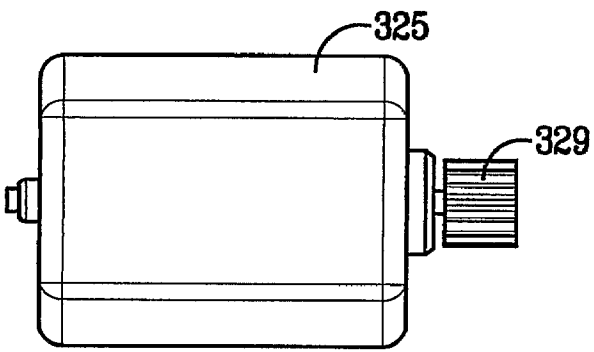

To close the doors 302, 304, one of the doors 302, 304 is pushed closed. This action pulls the other door shut through the mechanical linkage between the doors (not shown), however, one door will lag behind the other due to the free play of the linkage. Once the doors 302, 304 are almost closed the rotary magnets 306, 308, the magnet carriers 318, 319, and the hook-shaped pawls 334, 336 will begin to rotate toward their latched positions under the influence of the magnetic field of the magnetic inserts 314, 316, such that they will be in an intermediate position similar to that illustrated in FIG. 120. At this point the strong magnetic attraction between the magnetic inserts 314, 316 and their respective rotary magnets 306, 308 causes the lagging door to accelerate such that both doors close simultaneously, and the rotary magnets 306, 308 and the hook-shaped pawls 334, 336 simultaneously rotate to their latched positions. At this point the hook-shaped pawls 334, 336 engage the strikers 324, 326 and there is strong magnetic attraction between the magnetic inserts 314, 316 and their respective rotary magnets 306, 308. Accordingly, both doors are held in the closed position mechanically and magnetically. Thus, the magnetic latch mechanism 300 provides a latching system that tolerates the free play of the mechanical linkage of the doors 302, 304 and the positional difference between the doors near closing, but still closes the doors flush and simultaneously.

If the lag between the doors 302, 304 is great enough, one door may close completely, causing both rotary magnets 306, 308 and both hook-shaped pawls 334, 336 to move to their respective latched positions, before the lagging door reaches its closed position. In such event, the striker of the lagging door will move the respective hook-shaped pawl out of the way as previously described and allow the lagging door to move to the closed position where upon the respective hook-shaped pawl and respective rotary magnet return to their latched positions to secure the previously lagging door in the closed position. Because of the linkage between the magnet carriers 318 and 319, the hook-shaped pawl corresponding to the leading door that is already closed may be temporarily disengaged from its respective striker, but the leading door will remain closed due to magnetic attraction such that the leading door's respective hook-shaped pawl can reengage its respective striker once the lagging door is fully closed. It should be evident from the relative proportions of the hook-shaped pawls and their respective strikers, that the movement of the rotary magnets during the closing of the lagging door will be slight enough such that a strong enough attraction exists at all times during the closing of the lagging door between the striker of the lagging door and the respective rotary magnet to accomplish the closing of the lagging door as just described.

The magnetic latch mechanism 300 may also include a motor drive 321 for selectively moving the rack bar 317 in the direction of its longitudinal axis between the latched position and the unlatched position. Thus the motor drive 321 serves the same function as the Bowden cable 320 and is provided as an adjunct system to the Bowden cable 320 for use in applications where, for example, the motor drive 321 is provided to allow the magnetic latch mechanism 300 to be electrically actuated while the Bowden cable provides a manual override. It is also possible for the Bowden cable 320 to be electrically actuated for applications where a redundant electrical actuation system is desirable.

The motor drive 321 includes a motor 325 and a speed reduction gear train 327. The speed reduction gear train 327 includes a first small diameter gear 329 that is driven by the output shaft of the motor 325. The speed reduction gear train 327 also includes a first large diameter gear 331 that is in constant mesh with the gear 329. The speed reduction gear train 327 further includes a second small diameter gear 343 that is supported on the same shaft 355 as the gear 331 such that the gear 331 and the gear 343 rotate at the same angular speed. In addition, the speed reduction gear train 327 includes a second large diameter gear 347 that is in constant mesh with the gear 343. Furthermore, the speed reduction gear train 327 includes a sector gear 349 that is so called because it resembles a sector of a circular spur gear and has its teeth 357 distributed along an arc of a sector of a circle. The sector gear 349 and the gear 347 are supported on the same shaft 351 such that the sector gear 349 and the gear 347 rotate at the same angular speed. The ends of the shafts 355 and 351 are received in the journal bearing recesses 353 provided in the gear compartment 339 of the housing 332 to rotationally support the shafts 355 and 351. The journal bearing recesses 353 are provided with funnel-shaped or divergent entry slots 359 to allow the ends of the shafts 355 and 351 to be positioned in the journal bearing recesses 353. The housing cover portion 333 is provided with projections 361 that mate with corresponding entry slots 359 and prevent the ends of the shafts 355 and 351 from being dislodged from the journal bearing recesses 353 once the cover portion 333 is secured to rest of the housing 332, i.e. once the housing 332 is fully assembled. The motor 325 is housed at least in substantial part in the motor compartment 341. The gear train 327 is substantially housed in the gear compartment 339. The gear compartment 339 is in communication with the rotary magnet compartment 337 to allow the teeth 357 of the sector gear 349 to selectively engage the gear teeth 315 of rack bar 317.

Figure 149:
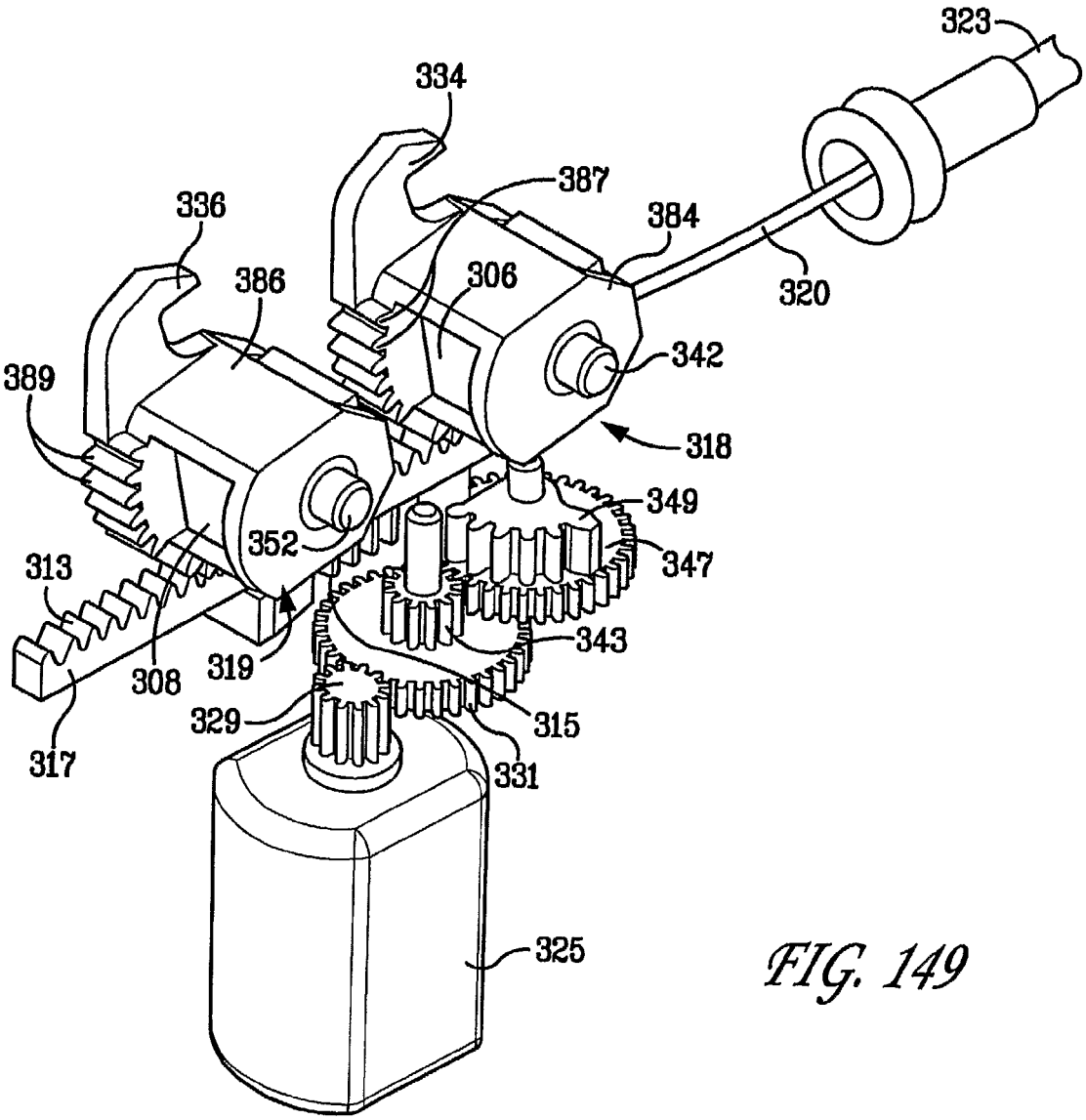
FIG. 149 is a fragmentary perspective view illustrating the operation of the magnetic latch mechanism of the present invention when the motor drive is used to actuate the magnetic latch mechanism and showing the rotary magnets and the hook-shaped pawls in the latched position and showing the sector gear in the initial position.
Figure 150:
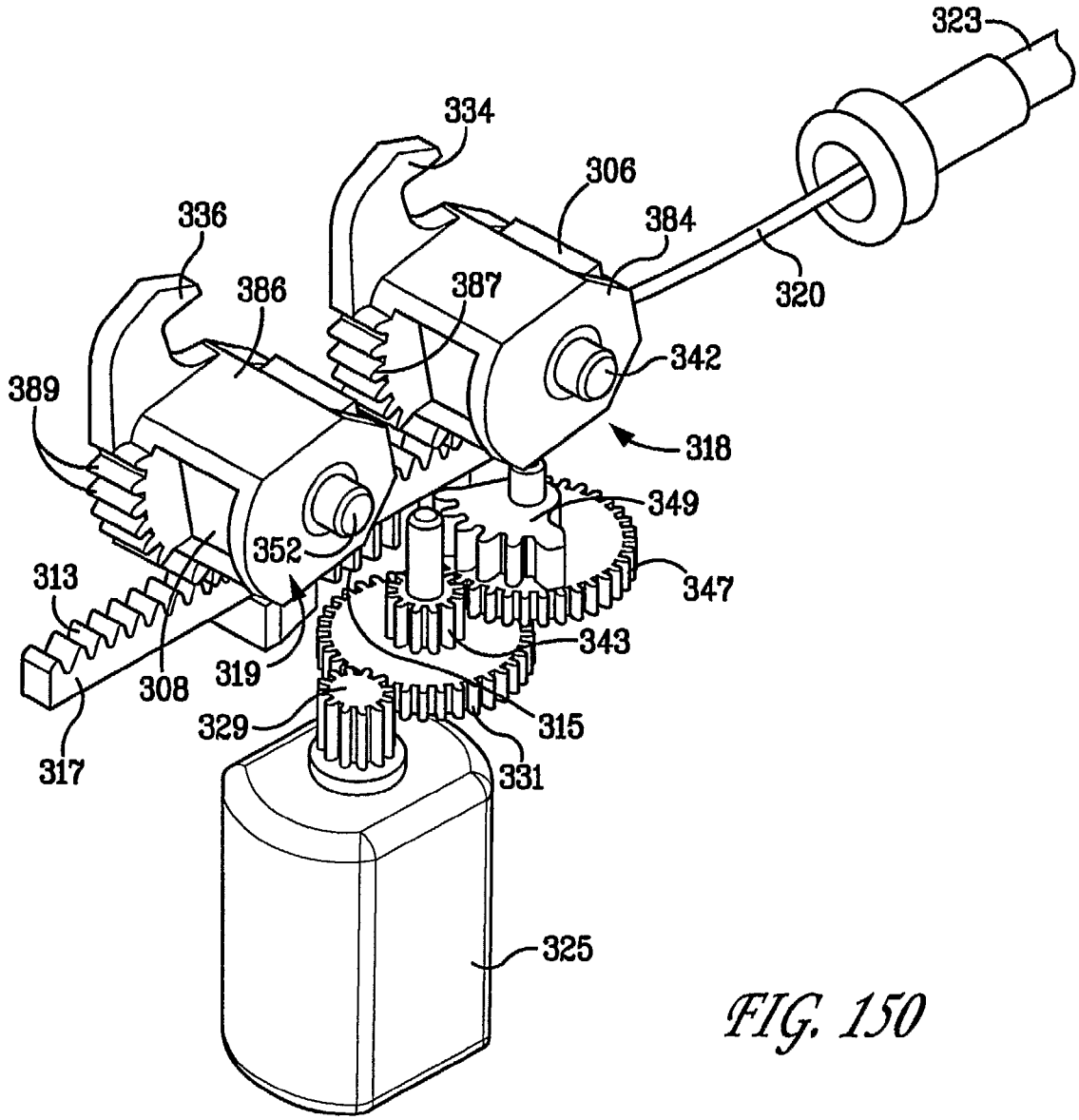
FIG. 150 is a fragmentary perspective view illustrating the operation of the magnetic latch mechanism of the present invention when the motor drive is used to actuate the magnetic latch mechanism and showing the rotary magnets and the hook-shaped pawls in the latched position and showing the sector gear beginning to engage the rack bar.
Figure 151:
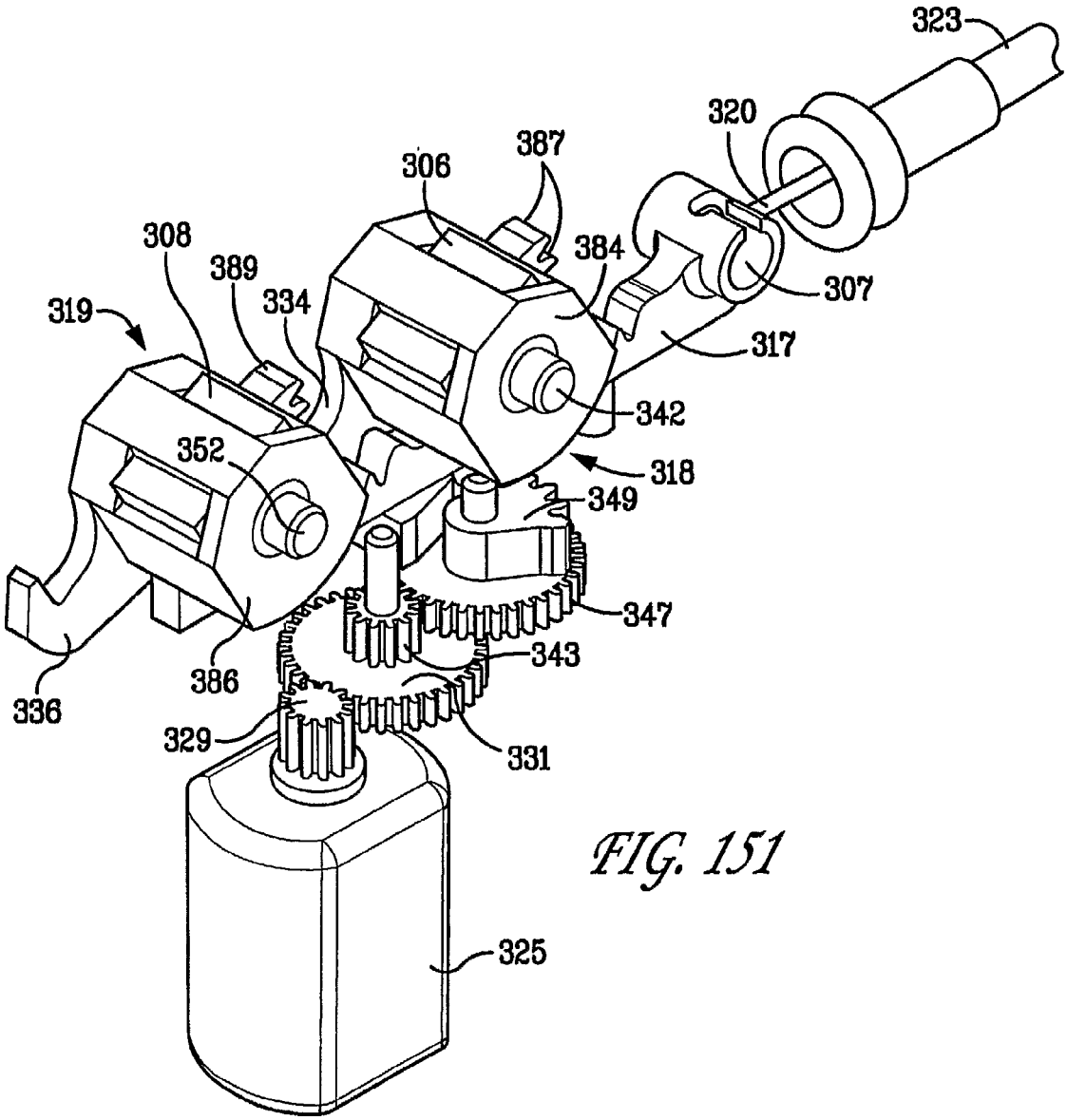
FIG. 151 is a fragmentary perspective view illustrating the operation of the magnetic latch mechanism of the present invention when the motor drive is used to actuate the magnetic latch mechanism and showing the rotary magnets and the hook-shaped pawls in the unlatched position and showing the sector gear beginning to disengage from the rack bar.

The teeth 357 of the sector gear 349 can selectively engage the gear teeth 315 of rack bar 317 such that the rack bar 317 is moved from the latched position to the unlatched position upon rotation of the sector gear 349 from its starting position to its final position. The starting position of the sector gear 349 is illustrated in FIG. 149. In the starting position the teeth 357 of the sector gear 349 do not engage the gear teeth 315 of rack bar 317 such that the sector gear 349 and the motor drive 321 do not interfere with the actuation of the rack bar 317 by the Bowden cable 320 when the motor drive 321 is not in use. When the motor 325 is energized the sector gear 349 rotates through the action of the other gears in the gear train 327, such that the first one of the teeth 357 of the sector gear 349 is brought into engagement with at least one of the gear teeth 315 of the rack bar 317 as illustrated in FIG. 150. As the rotation of the sector gear 349 continues, the rack bar 317 is moved from the latched position to the unlatched position where the teeth 357 of the sector gear 349 are almost out of engagement with the gear teeth 315 of the rack bar 317 as illustrated in FIG. 151. Movement of the rack bar 317 to the unlatched position causes the magnet carriers 318, 319 to rotate to their unlatched positions as previously described, which in turn allows opening of the doors 302, 304. Also as previously described, in the unlatched position the attraction between the opposite poles of the magnets 306, 308 will maintain the magnet carriers 318, 319 in their unlatched positions until the doors 302, 304 are once again moved toward their closed positions. The motor 325 continues to be energized to rotate the sector gear 349 until the teeth 357 of the sector gear 349 are completely out of engagement with the gear teeth 315 of the rack bar 317 and the sector gear 349 reaches its final position, as illustrated in FIG. 152. In the illustrated embodiment, the starting and final positions of the sector gear 349 are the same such that the sector gear 349 has made a complete revolution. With the sector gear 349 once again in its starting position, the sector gear 349 is ready to repeat its operating cycle the next time the motor 325 is energized.

It is to be understood that the present invention is not limited to the embodiments described above. Furthermore, it is to be understood that the embodiments of the present invention disclosed above are susceptible to various modifications, changes and adaptations by those skilled in the art, without departing from the spirit and scope of the invention.

The invention claimed is:

1. A magnetic latch mechanism for securing a first member in a closed position relative to a second member, the first member being movable between the closed position and an open position relative to the second member, the first member being provided with magnetically attractable material, and the first member being provided with a striker, the magnetic latch mechanism comprising:

a housing adapted for attachment to the second member;

at least one magnet rotationally supported by said housing, said at least one magnet being rotationally movable between latched and unlatched positions, when in said latched position said at least one magnet being positioned such that with the first member in the closed position relative to the second member said at least one magnet holds the first member in the closed position through magnetic attraction between said at least one magnet and the magnetically attractable material, and when in said unlatched position said at least one magnet being positioned such that with the first member in the closed position relative to the second member said at least one magnet repels the magnetically attractable material so as to cause the first member to move from the closed position toward an open position relative to the second member;

an actuation mechanism capable of selectively moving said at least one magnet from said latched position to said unlatched position responsive to an input from a user; and a hook-shaped pawl supported for rotation with said at least one magnet, said pawl being capable of engaging the striker, said pawl engaging the striker to mechanically prevent the first member from being moved toward the open position when said at least one magnet is in said latched position.

2. The magnetic latch mechanism according to claim 1, wherein the magnetic latch mechanism further comprises:

at least one magnet carrier rotationally supported by said housing, said at least one magnet being carried by said at least one magnet carrier, said at least one magnet carrier being rotationally movable between latched and unlatched positions corresponding to said latched and unlatched positions of said at least one magnet.

3. The magnetic latch mechanism according to claim 2, wherein said pawl is of one-piece construction with said at least one magnet carrier.

4. A magnetic latch mechanism for securing a first member and a third member in respective closed positions relative to a second member, the first member being movable between the closed position of the first member and an open position thereof relative to the second member, the first member being provided with magnetically attractable material, and the first member being provided with a first striker, wherein the third member is movable between the closed position of the third member and an open position thereof relative to the second member, wherein the third member is provided with magnetically attractable material, and wherein the third member is provided with a second striker, the magnetic latch mechanism comprising:

a housing adapted for attachment to the second member;

a first magnet rotationally supported by said housing, said first magnet being rotationally movable between latched and unlatched positions thereof, when in said latched position said first magnet being positioned such that with the first member in the closed position relative to the second member said first magnet holds the first member in the closed position through magnetic attraction between said first magnet and the magnetically attractable material of the first member, and when in said unlatched position said first magnet being positioned such that with the first member in the closed position relative to the second member said first magnet repels the magnetically attractable material of the first member so as to cause the first member to move from the closed position toward an open position relative to the second member;

a second magnet rotationally supported by said housing, said second magnet being rotationally movable between latched and unlatched positions, when in said latched position said second magnet being positioned such that with the third member in the closed position relative to the second member said second holds the third member in the closed position through magnetic attraction between said second magnet and the magnetically attractable material of the third member, and when in said unlatched position said second magnet being positioned such that with the third member in the closed position relative to the second member said second magnet repels the magnetically attractable material of the third member so as to cause the third member to move from the closed position toward the open position relative to the second member; and an actuation mechanism capable of selectively moving said first magnet and said second magnet from their respective latched positions to their respective unlatched positions responsive to an input from a user;

a first hook-shaped pawl supported for rotation with said first magnet, said first pawl being capable of engaging said first striker, said first pawl engaging said first striker to mechanically prevent the first member from being moved toward the open position when said first magnet is in said latched position of said first magnet; and a second hook-shaped pawl supported for rotation with said second magnet, said second pawl being capable of engaging said second striker, said second pawl engaging said second striker to mechanically prevent the third member from being moved toward the open position when said second magnet is in said latched position of said second magnet.

5. The magnetic latch mechanism according to claim 4, wherein the magnetic latch mechanism further comprises:

a first magnet carrier rotationally supported by said housing, said first magnet being carried by said first magnet carrier, said first magnet carrier being rotationally movable between latched and unlatched positions corresponding to said latched and unlatched positions of said first magnet; and a second magnet carrier rotationally supported by said housing, said second magnet being carried by said second magnet carrier, said second magnet carrier being rotationally movable between latched and unlatched positions corresponding to said latched and unlatched positions of said second magnet.

6. The magnetic latch mechanism according to claim 5, wherein said first hook-shaped pawl is supported for rotation with said first magnet carrier, and said second hook-shaped pawl is supported for rotation with said second magnet carrier.

7. The magnetic latch mechanism according to claim 6, wherein said first magnet carrier rotates about a first axis of rotation, wherein said second magnet carrier rotates about a second axis of rotation, wherein said first axis of rotation is parallel to said second axis of rotation, and wherein said first axis of rotation is spaced apart from said second axis of rotation.

8. The magnetic latch mechanism according to claim 7, wherein said actuation mechanism comprises:

a first lever arm attached to said first magnet carrier, said first lever arm rotating with said first magnet carrier;

a second lever arm attached to said second magnet carrier, said second lever arm rotating with said second magnet carrier; and a linkage bar pivotally attached to said first lever arm at a first location, said linkage bar being pivotally attached to said second lever arm at a second location spaced apart from said first location along said linkage bar, such that said first magnet carrier and said first magnet move between their latched and unlatched positions in a coordinated manner with said second magnet carrier and said second magnet as said second magnet carrier and said second magnet move between their latched and unlatched positions.

9. The magnetic latch mechanism according to claim 7, wherein said actuation mechanism comprises:

a first plurality of gear teeth attached to said first magnet carrier, said first plurality of gear teeth rotating with said first magnet carrier;

a second plurality of gear teeth attached to said second magnet carrier, said second plurality of gear teeth rotating with said second magnet carrier; and a rack bar supported for rectilinear movement relative to said housing, said rack bar being provided with a third plurality of gear teeth, a first portion of said third plurality of gear teeth being capable of engaging said first plurality of gear teeth of said first magnet carrier, a second portion of said third plurality of gear teeth being capable of engaging said second plurality of gear teeth of said second magnet carrier, such that said first magnet carrier and said first magnet move between their latched and unlatched positions and said second magnet carrier and said second magnet move between their latched and unlatched positions as said rack bar moves rectilinearly between a first position and a second position.

10. The magnetic latch mechanism according to claim 9, wherein said rack bar includes a fourth plurality of gear teeth, and wherein said actuation mechanism further comprises:

a gear wheel supported for rotational motion relative to said housing, said gear wheel having a fifth plurality of gear teeth that are in mesh with said fourth plurality of gear teeth such that at least rotation of said gear wheel in a first direction moves said rack bar from said first position thereof to said second position thereof to thereby move said first magnet and said second magnet from their latched positions to their unlatched positions.

11. The magnetic latch mechanism according to claim 10, wherein said actuation mechanism further comprises:

an electric motor; and a set of gears, said motor driving said gear wheel via said set of gears.

12. The magnetic latch mechanism according to claim 11, wherein said first pawl is of one-piece construction with said first magnet carrier and said second pawl is of one-piece construction with said second magnet carrier.

* * * * *